US012742330B2

(12) United States Patent
Johnson et al.

(10) Patent No.: US 12,742,330 B2
(45) Date of Patent: Sep. 22, 2026

(54) FRAME MEMBERS FOR DECKS AND DECKING SYSTEMS HAVING THE SAME

(71) Applicant: The AZEK Group LLC, Chicago, IL (US)

(72) Inventors: Elijah R. Johnson, Chicago, IL (US); Eric Wehrli, Sugar Grove, IL (US); Jason Andrew Davoll, Chicago, IL (US); Roger Edwin Winter, Chicago, IL (US)

(73) Assignee: The AZEK Group LLC, Chicago, IL (US)

( * ) Notice: Subject to any disclaimer, the term of this patent is extended or adjusted under 35 U.S.C. 154(b) by 434 days.

(21) Appl. No.: 18/188,397

(22) Filed: Mar. 22, 2023

(65) Prior Publication Data

US 2023/0304303 A1 Sep. 28, 2023

Related U.S. Application Data

(60) Provisional application No. 63/322,912, filed on Mar. 23, 2022, provisional application No. 63/322,913, filed on Mar. 23, 2022.

(51) Int. Cl.
*E04F 15/06* (2006.01)
*E04F 15/02* (2006.01)

(52) U.S. Cl.
CPC .. *E04F 15/02183* (2013.01); *E04F 15/02044* (2013.01); *E04F 15/06* (2013.01); *E04F 2203/04* (2013.01)

(58) Field of Classification Search
None
See application file for complete search history.

(56) References Cited

U.S. PATENT DOCUMENTS 1,258,408 A 3/1918 Hill
1,385,209 A 7/1921 Hall
2,976,969 A * 3/1961 Gillespie ..... E04D 3/08 52/204.591
3,246,441 A * 4/1966 Horgan, Jr. ..... E04B 2/88 52/656.1
3,253,373 A 5/1966 Diack
(Continued)

FOREIGN PATENT DOCUMENTS

CN 107060108 A 8/2017
CN 110230364 A 9/2019
(Continued)

OTHER PUBLICATIONS

International Search Report and Written Opinion received for PCT Patent Application No. PCT/US2023/074262, mailed on Jan. 26, 2024, 9 pages.

(Continued)

*Primary Examiner* — Phi D A
(74) *Attorney, Agent, or Firm* — Shook, Hardy & Bacon L.L.P.

(57) ABSTRACT

Frame members for decks and decking systems comprising frame members. A perimeter frame member can include a first engagement member adjacent a first vertical end and a second engagement member adjacent a second vertical end. An inner frame member can include a first ridge adjacent a first vertical end and a second ridge adjacent a second vertical end.

15 Claims, 37 Drawing Sheets

(56) References Cited

U.S. PATENT DOCUMENTS

| | | | | |
|---|---|---|---|---|
| 3,349,538 | A | 10/1967 | Virginia | |
| 3,381,775 | A | 5/1968 | Livers | |
| 3,389,527 | A * | 6/1968 | Collard | E04B 2/967 52/468 |
| 3,398,499 | A * | 8/1968 | Moore | E06B 3/12 52/775 |
| 3,499,254 | A | 3/1970 | Jefferys | |
| 3,918,686 | A | 11/1975 | Knott et al. | |
| 4,050,828 | A | 9/1977 | Noro | |
| 4,598,510 | A * | 7/1986 | Wagner, III | E04F 15/0247 52/126.6 |
| 5,160,640 | A | 11/1992 | Badstieber | |
| 5,421,556 | A | 6/1995 | Dodge et al. | |
| 5,617,689 | A | 4/1997 | Beane | |
| 5,927,030 | A * | 7/1999 | Petit | E04F 15/02458 52/656.1 |
| 6,209,267 | B1 * | 4/2001 | Dantzer | E04F 15/02044 52/480 |
| 7,360,343 | B1 * | 4/2008 | Spransy | E04F 15/02458 52/480 |
| 8,132,791 | B2 | 3/2012 | Stucker | |
| 8,857,926 | B2 | 10/2014 | Toro | |
| 8,863,466 | B1 * | 10/2014 | Winter | E04B 5/023 52/634 |
| 9,228,345 | B2 | 1/2016 | Weber et al. | |
| 9,512,619 | B2 | 12/2016 | Winter | |
| 10,060,150 | B1 | 8/2018 | Fox | |
| 11,085,191 | B2 | 8/2021 | Burt et al. | |
| 11,186,984 | B1 * | 11/2021 | Webb | E04F 15/02458 |
| 12,345,055 | B1 * | 7/2025 | Santini | E04F 15/02044 |
| 12,476,343 | B2 | 11/2025 | Kim et al. | |
| 2007/0175132 | A1 * | 8/2007 | Spransy | F24F 13/06 52/263 |
| 2008/0054242 | A1 | 3/2008 | Petta et al. | |
| 2010/0011680 | A1 * | 1/2010 | Takahashi | E04B 5/43 52/745.05 |
| 2010/0162645 | A1 * | 7/2010 | Cox | E04F 15/02177 52/220.1 |
| 2012/0131862 | A1 * | 5/2012 | Hashimoto | E04F 15/02464 52/126.6 |
| 2014/0000184 | A1 | 1/2014 | Armstrong et al. | |
| 2015/0128519 | A1 * | 5/2015 | Weber | E04B 5/43 52/489.1 |
| 2015/0152630 | A1 * | 6/2015 | Winter | E04F 15/04 52/633 |
| 2018/0058086 | A1 * | 3/2018 | Hubbard | H05K 7/1495 |
| 2018/0094418 | A1 | 4/2018 | Winter | |
| 2018/0094426 | A1 | 4/2018 | Winter | |
| 2018/0119407 | A1 | 5/2018 | Mcnamee | |
| 2020/0340256 | A1 * | 10/2020 | Lee | E04F 15/04 |
| 2020/0407979 | A1 | 12/2020 | Jain | |
| 2020/0407982 | A1 * | 12/2020 | Schneider | E04B 1/003 |
| 2021/0381271 | A1 | 12/2021 | Schneider et al. | |
| 2022/0112729 | A1 * | 4/2022 | Chen | E04F 15/02452 |
| 2022/0243477 | A1 | 8/2022 | Barnds | |
| 2022/0381041 | A1 * | 12/2022 | Perrine | E04F 21/22 |
| 2023/0349171 | A1 * | 11/2023 | Zauderer | E04F 15/02452 |
| 2024/0026675 | A1 * | 1/2024 | Weber | E04B 5/14 |
| 2024/0110390 | A1 * | 4/2024 | Schneider | E04B 1/003 |
| 2024/0271431 | A1 * | 8/2024 | Armstrong | E04F 15/02458 |
| 2025/0027323 | A1 * | 1/2025 | Reed | E04F 15/02044 |
| 2025/0257575 | A1 * | 8/2025 | Luczycki | E04F 15/02183 |

FOREIGN PATENT DOCUMENTS

| | | | |
|---|---|---|---|
| CN | 111364706 | B | 6/2021 |
| DE | 29809125 | U1 | 8/1998 |
| JP | 2010-133244 | A | 6/2010 |
| JP | 6654889 | B2 | 2/2020 |
| KR | 20-2011-0009003 | U | 9/2011 |
| WO | 2020/212212 | A1 | 10/2020 |
| WO | 2024/059760 | A1 | 3/2024 |

OTHER PUBLICATIONS

International Search Report and Written Opinion issued in International Application No. PCT/US2023/083203, mailed on Apr. 4, 2024, 9 pages.

International Preliminary Report on Patentability issued in International Application No. PCT/US2023/064868, mailed on Jun. 12, 2024, 11 pages.

International Search Report and Written Opinion received in PCT Application No. PCT/US2023/064868, mailed on dated Jul. 17, 2023, 8 pages.

Extended European Search Report issued in European Application No. 23775894.1, mailed on Feb. 19, 2026.

Non-Final Office Action received for U.S. Appl. No. 18/467,681, mailed on Nov. 26, 2025, 15 pages.

Non-Final Office Action recieved for U.S. Appl. No. 18/534,038, mailed on Oct. 20, 2025, 11 pages.

International Preliminary Report on Patentability received for PCT Patent Application No. PCT/US2023/074262, mailed on Mar. 27, 2025, 7 pages.

Non-Final Office Action received for U.S. Appl. No. 18/467,681, mailed on Jun. 16, 2026, 10 pages.

Office Action received for Canadian Patent Application No. 3254666, mailed on Jul. 8, 2026, 6 pages.

* cited by examiner

FRAME MEMBERS FOR DECKS AND DECKING SYSTEMS HAVING THE SAME

CROSS REFERENCE TO RELATED APPLICATIONS

This application claims the priority benefit of U.S. Provisional Application No. 63/322,912, titled "Frame Members for Decks and Decking Systems Having the Same", filed on Mar. 23, 2022, and US Provisional Application No. 63/322,913, titled "Frame Members for Decks and Decking Systems Having the Same", filed on Mar. 23, 2022, both of which are incorporated herein in their entirety.

TECHNICAL FIELD

The present disclosure relates to decking systems. In particular, the present disclosure relates to frame members for decks and decking systems comprising frame members.

BACKGROUND

Certain conventional decking systems can include a frame system. In such systems, the frame can be designed to support a deck floor. However, in certain conventional systems, assembly of the frame system can be a resource intensive process and/or can be a highly technical process, which can lead to one or more assembly errors and may result in a defective deck and/or defective deck floor.

BRIEF DESCRIPTION OF THE DRAWINGS

Illustrative aspects are described in detail below with reference to the attached drawing figures, which are incorporated by reference herein and wherein.

DESCRIPTION

Figure 1A:
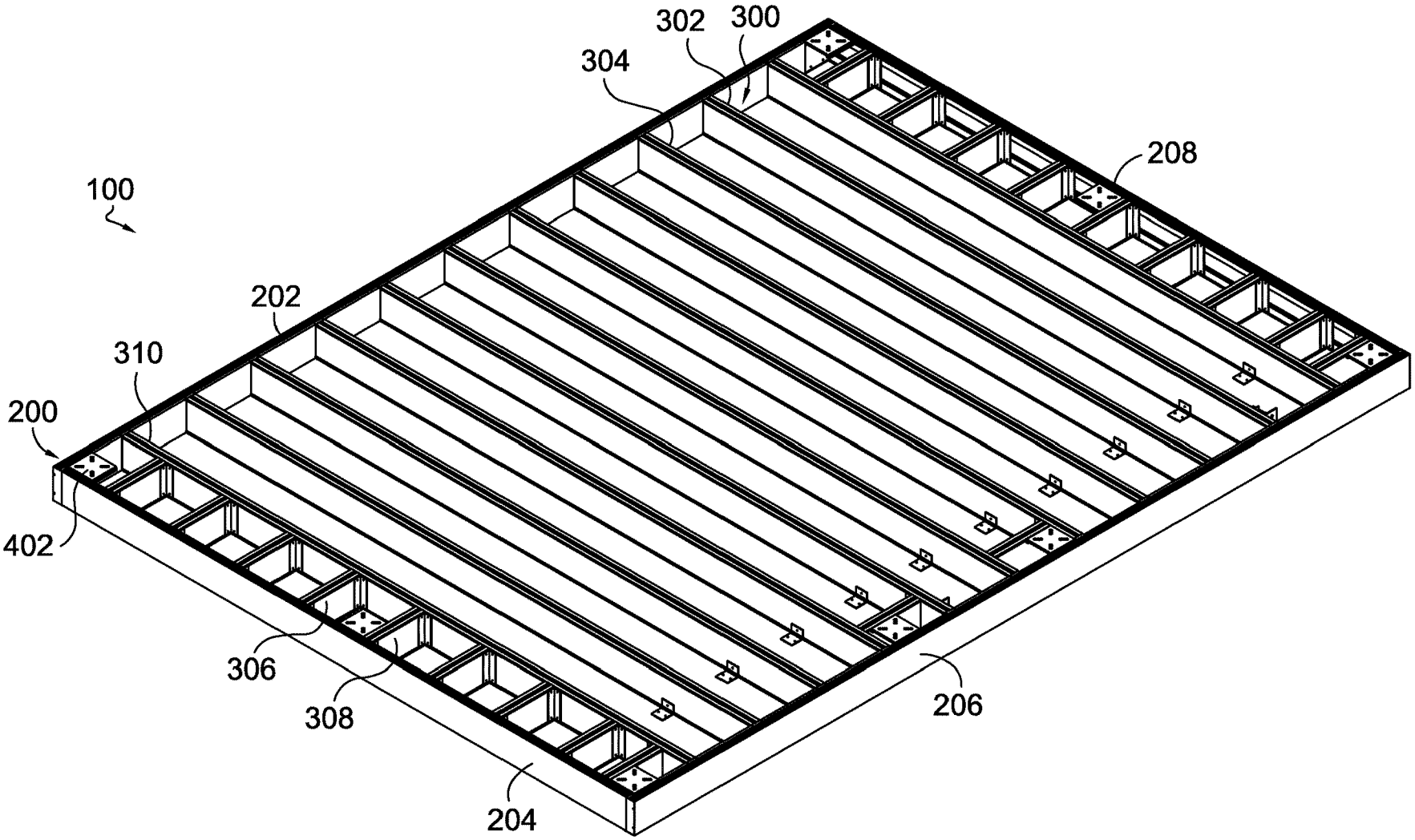
FIGS. 1A and 1B depicts an example frame structure for a decking system, including one or more perimeter frame members, one or more inner frame members, and one or more L-post brackets, in accordance with aspects hereof.

Aspects herein relate to frame members for decks and decking systems comprising frame members. As discussed above, certain conventional decking systems can include a frame system that is a resource intensive and/or highly technical process to assemble or install. Such a resource intensive and/or highly technical assembly or installation can lead to one or more assembly errors, which may result in a defective deck and/or deck floor. Further, certain decking systems may lack adequate structural capacity or loading limits.

The frame members and decking systems disclosed herein can alleviate one or more of the problems described above. For instance, in various aspects, the framing members can include one or more structural features described herein that can facilitate interactions between frame members and other framing components, connectors, and/or accessories. In such aspects, the structural features of the frame members disclosed herein may also increase structural integrity and/or loading limits, and/or reduce loading on fasteners and connections on the frame members, corners, and/or post rail supports. This is unlike certain conventional systems where the structural components may be smooth in shape, which can: place the structural integrity requirements on the fasteners being used to support the structural components; increase installation time (due to the addition of added fasteners and blocking); and allow for misuse of the components. In various aspects, the framing members disclosed herein can include one or more structural features, such as those discussed below, which may aid in aligning the various framing components for installation, and/or may reduce installation errors.

Accordingly, in one aspect, a perimeter frame member is provided. The perimeter frame member can include a first lateral end; a second lateral end that is opposite the first lateral end; a first vertical end; a second vertical end that is opposite the first vertical end; a first side extending between the first lateral end and the second lateral end, and extending between the first vertical end and the second vertical end; a second side opposite the first side, the second side extending between the first lateral end and the second lateral end, and extending between the first vertical end and the second vertical end; wherein the first side comprises first and second engagement members, wherein the first engagement member is adjacent the first vertical end, and wherein the second engagement member is adjacent the second vertical end.

In yet another aspect, a decking system is provided. The decking system can include one or more perimeter frame members. Each of the one or more perimeter frame members can include a first lateral end; a second lateral end that is opposite the first lateral end; a first vertical end; a second vertical end that is opposite the first vertical end; a first side extending between the first lateral end and the second lateral end, and extending between the first vertical end and the second vertical end; a second side opposite the first side, the second side extending between the first lateral end and the second lateral end, and extending between the first vertical end and the second vertical end; wherein the first side comprises first and second engagement members, wherein the first engagement member is adjacent the first vertical end, and wherein the second engagement member is adjacent the second vertical end. The decking system can also include one or more inner frame members, where, when in an assembled configuration, at least a first inner frame member of the one or more inner frame members is coupled to at least a first perimeter frame member of the one or more perimeter frame members.

As used herein, the term "about" means plus or minus 10% of the numerical value of the number with which it is being used unless otherwise indicated or custom in the art dictates otherwise. Therefore, for example, "about 10 millimeters (mm)" includes the value 10 mm in addition to the range of 9 mm to 11 mm.

Figure 1B:
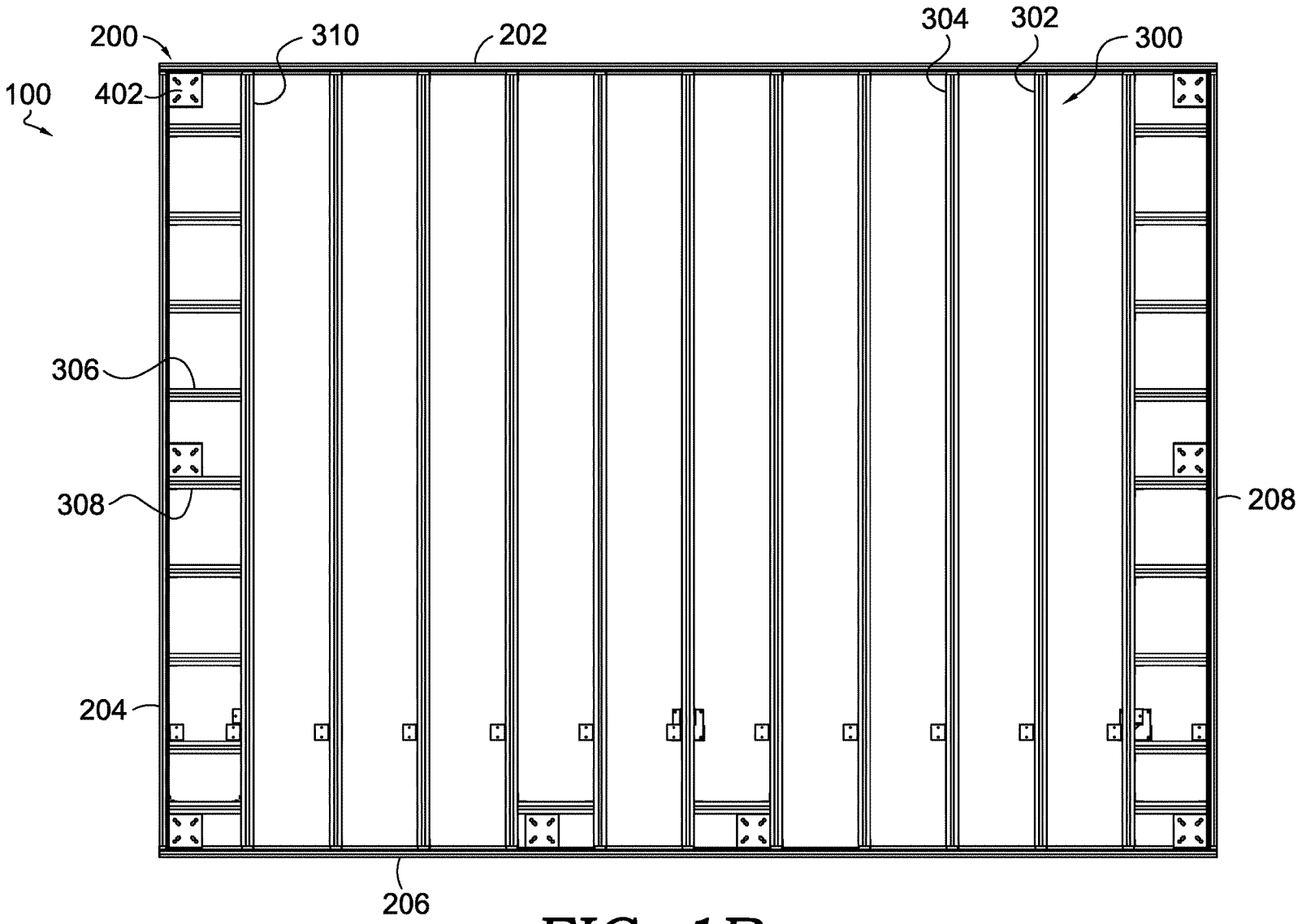

Turning to the figures, and FIGS. 1A and 1B in particular, an example decking system 100 is depicted. As can be seen in the aspect depicted in FIGS. 1A and 1B, the decking system 100 includes perimeter frame members 200 and inner frame members 300. In some examples, a perimeter frame member and/or an inner frame member can be a joist. In some examples, a perimeter frame member can include a rim joist. In some examples, an inner frame member can include a field joist. It should be understood that the decking system 100 of FIGS. 1A and 1B is provided as one example system and is not intended to include all decking components, such as a deck floor, railings, trim, and the like. In certain aspects, a deck floor, or deck boards, which can form a surface of a deck and support people, furniture, and the like, can be positioned on top of the decking system 100 depicted in FIGS. 1A and 1B. Further, it should be understood that the arrangement and number of the perimeter frame members 200 and inner frame members 300 in the decking system 100 is just one example arrangement and number of frame members and is provided to highlight various features and aspects of the frame members. Alternative arrangements and numbers of perimeter frame members and inner frame members are also contemplated by the disclosure herein.

In certain aspects, the decking system 100 can also be coupled to a support structure, e.g., a side of a dwelling or other wall. In one such example aspect, a perimeter frame member, e.g., the perimeter frame member 202, can be secured to a side or edge of a dwelling or other support structure. In some examples, the perimeter frame member 202 can include a ledger.

As discussed above, in various aspects, the decking system 100 can include one or more perimeter frame members 200. For instance, as can be seen in the aspect depicted in FIGS. 1A and 1B, perimeter frame members 202, 204, 206, and 208 can form an outer support structure for a frame of the decking system 100. In various aspects, one or more of the perimeter frame members 200 can be coupled to one or more of the inner frame members 300, e.g., to provide enhanced support to the decking system 100 across the horizontal plane of the decking system 100. For instance, in the aspect depicted in FIGS. 1A and 1B, inner frame members 302 and 304 are coupled to both the perimeter frame member 202 and to the perimeter frame member 206, and extend substantially perpendicular, e.g., about 90°, relative to the perimeter frame members 202 and 206. In the same or alternative aspects, one or more inner frame members, e.g., inner frame members 306 and 308, can be coupled to a perimeter frame member, e.g., perimeter frame member 204, and to an inner frame member, e.g., inner frame member 310.

In various aspects, the inner frame members 306 and 308 can extend substantially perpendicular, e.g., about 90°, relative to the perimeter frame members 204 and to the inner frame member 310. In various aspects, inner frame members that extend between two adjacent frame members, e.g., perimeter frame member 204 and inner frame member 310, can provide enhanced structural support for certain purposes, such as to support railings, railing posts, and/or in areas of the decking system 100 that are between underneath support structures. In other aspects not depicted in FIGS. 1A and 1B, inner frame members that extend substantially perpendicular relative to the perimeter frame members 204 and 206 can be positioned between each, or a subset, of the inner frame members that extend substantially parallel relative to the perimeter frame members 204 and 206. In some examples, the inner frame members 306 and 308 can include blocking.

While in the example decking system 100 of FIGS. 1A and 1B, the decking system 100 is generally depicted as including a rectangular or box shape, it should be understood that other shapes of a decking system are also contemplated by the disclosure herein. For instance, in one aspect, perimeter frame members can be coupled to one another at an angle other than 90°. In the same or alternative aspects, inner frame members may be coupled to perimeter frame members and/or to other inner frame members at angles other than 90°. In certain aspects, one or more frame members may not be linear. For instance, in certain aspects, curved or non-linear frame members are also contemplated by the disclosure herein. In various aspects, such non-linear frame members can include the structural and/or functional features described herein and interact with other components in a similar fashion that accounts for the non-linear shape.

Figure 1C:
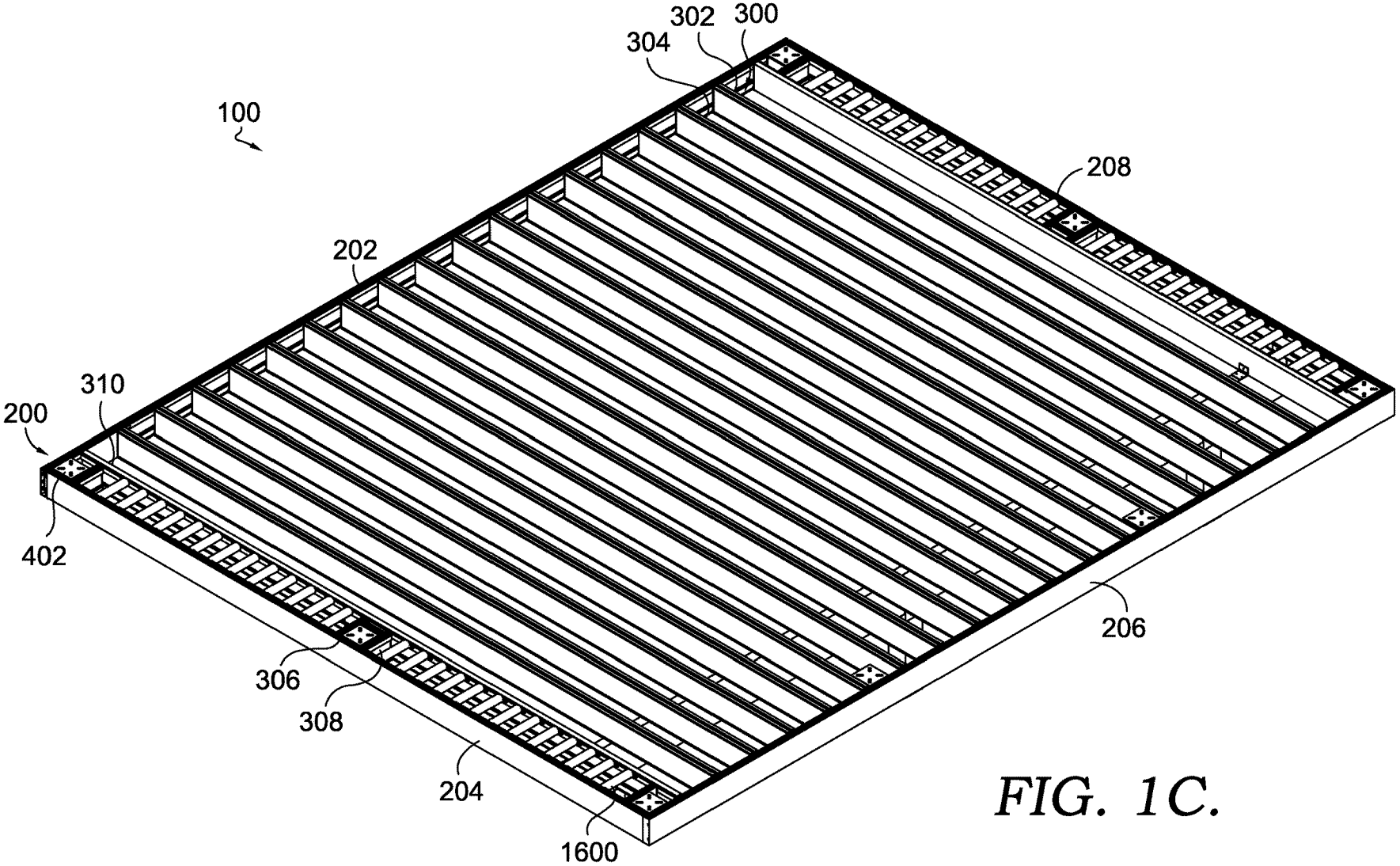
FIGS. 1C and 1D depicts another example frame structure for a decking system, including one or more perimeter frame members, one or more inner frame members, and one or more L-post brackets, in accordance with aspects hereof.
Figure 1D:
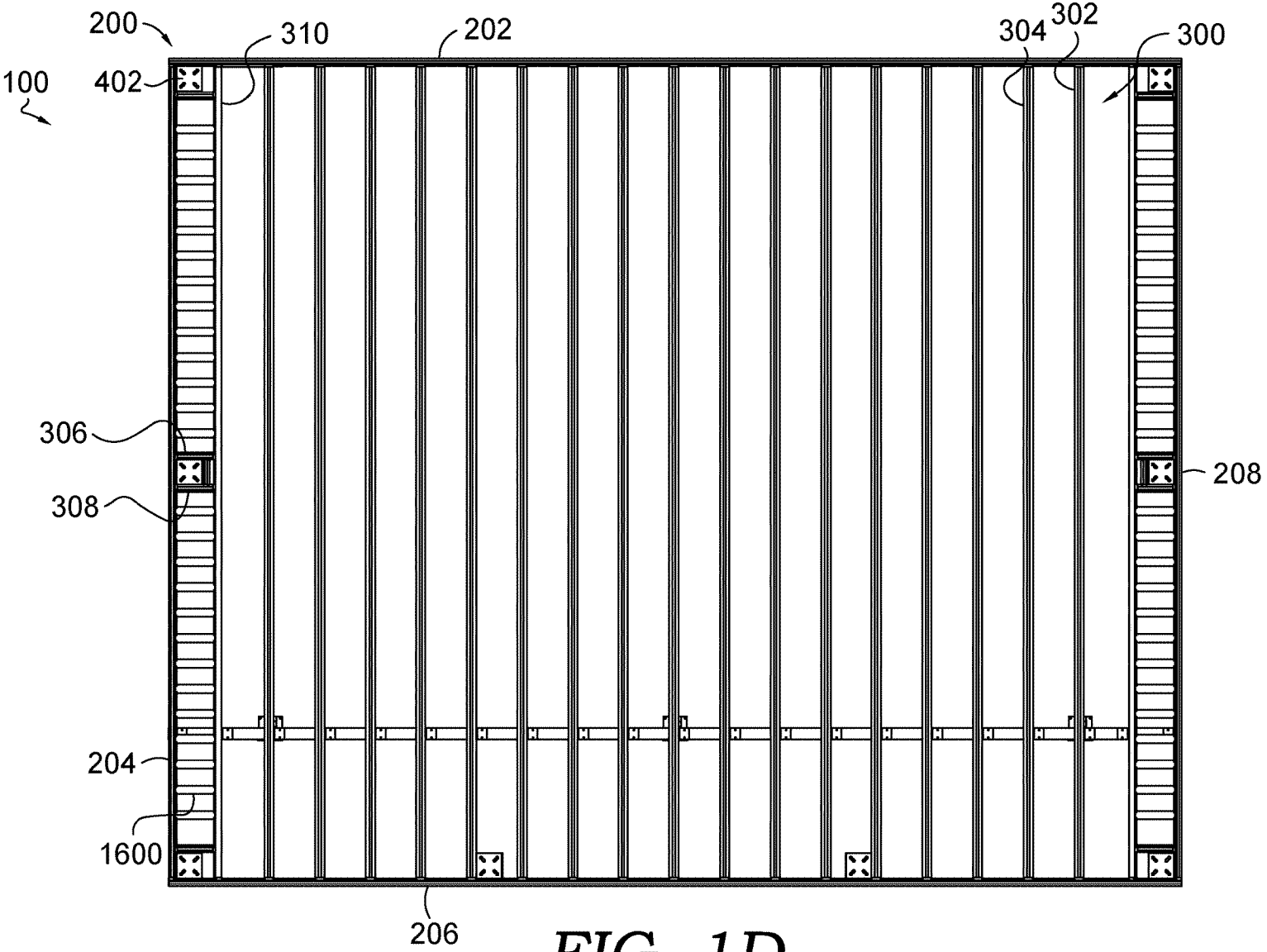
Figure 1E:
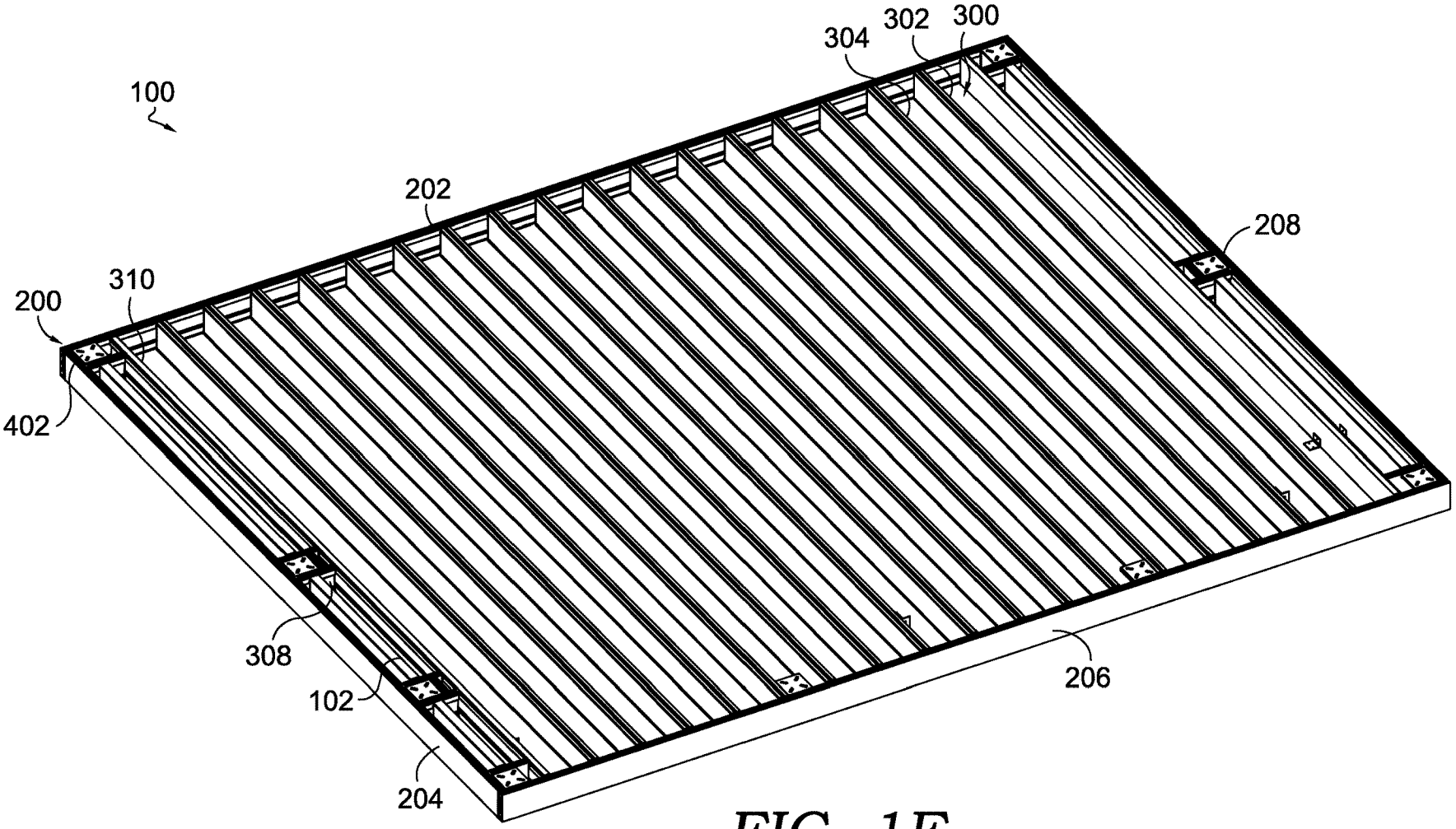
FIGS. 1E and 1F depicts another example frame structure for a decking system, including one or more perimeter frame members, one or more inner frame members, and one or more L-post brackets, in accordance with aspects hereof.
Figure 1F:
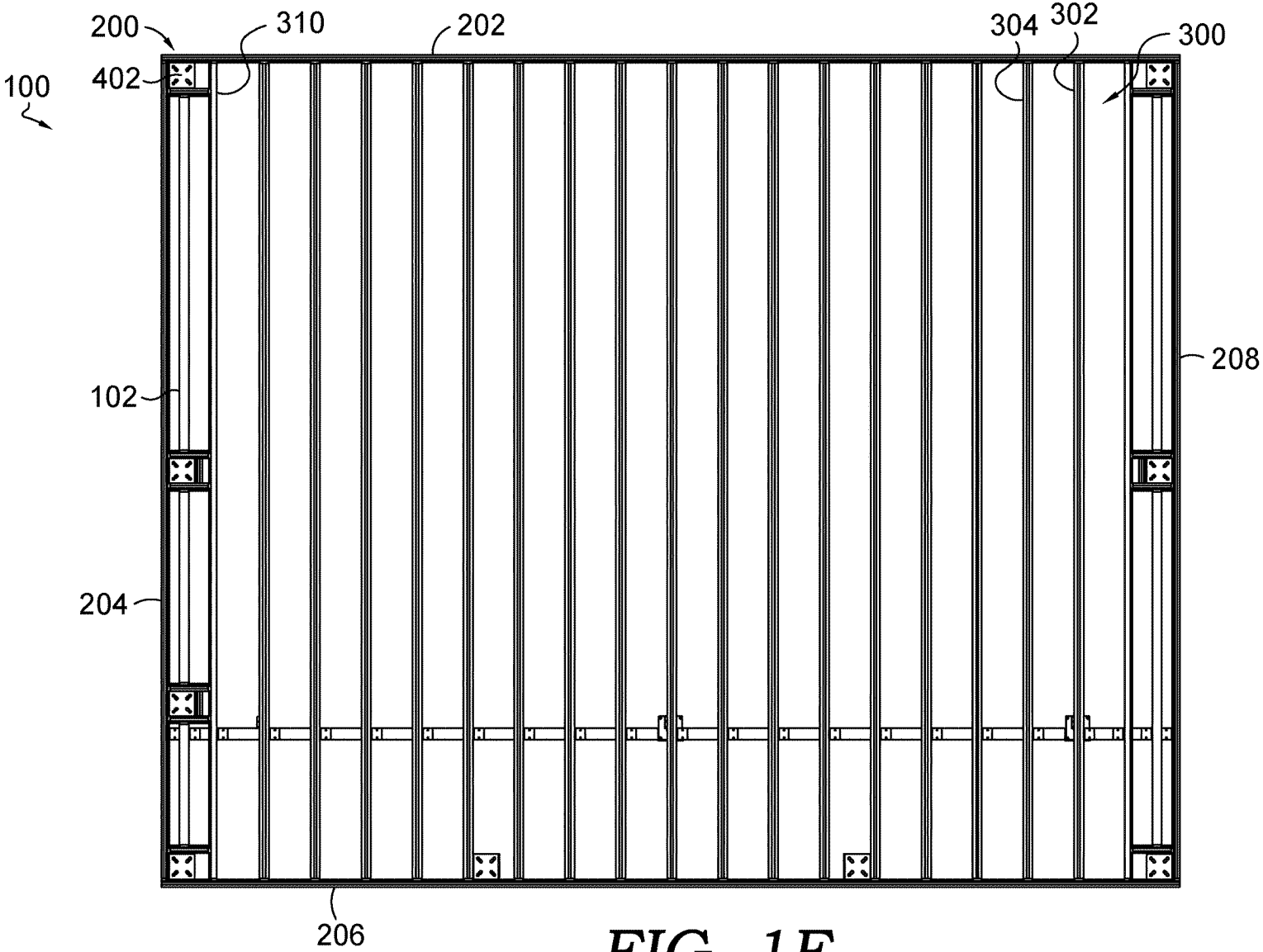

Additionally, while the example decking system 100 of FIGS. 1A and 1B includes a plurality of internal frame members 306 and 308, it should be understood that other framing techniques can be used. For example, as depicted in FIGS. 1C and 1D, an example decking system 102 includes a plurality of blocking members 1600 that span the gap between the perimeter framing member 204 and inner frame member 310. In at least some examples, a blocking member can include a pre-cut length that is standard for typical spacing between the perimeter frame member 204 (e.g., rim joist) and the internal frame member 310 (e.g., joist). For example, the blocking member 1600 can include a pre-formed length of 8", 10", 12", 16", etc. Use of blocking member 1600 may facilitate multiple "picture frame" designs while reducing the number of internal frame members that need to be cut (e.g., based on the pre-formed length) and/or assembled. Alternatively, as depicted in FIGS. 1E and 1F, and example decking system 104 may include one or more internal frame member that are parallel to and between internal frame members 310 and perimeter frame member 204.

In various aspects, as will be discussed in detail below, one or more of the perimeter frame members 200 and/or one or more of the inner frame members 300 can be coupled to one or more decking accessories, brackets, clips, and the like, such as an L-post bracket 402, as will be discussed herein.

In certain aspects, the perimeter frame members 200 and/or the inner frame members 300 can be formed from any type of material. In various aspects, the perimeter frame members 200 and/or the inner frame members 300 can include a metal material. In such aspects, metal material that is suitable for use as frame systems and/or decking systems can be utilized. In certain aspects, the metal material can include aluminum. In the same or alternative aspects, the perimeter frame members 200 and/or the inner frame members 300 can be formed of an extruded metal material, including extruded aluminum.

Figures 2A, 2B:
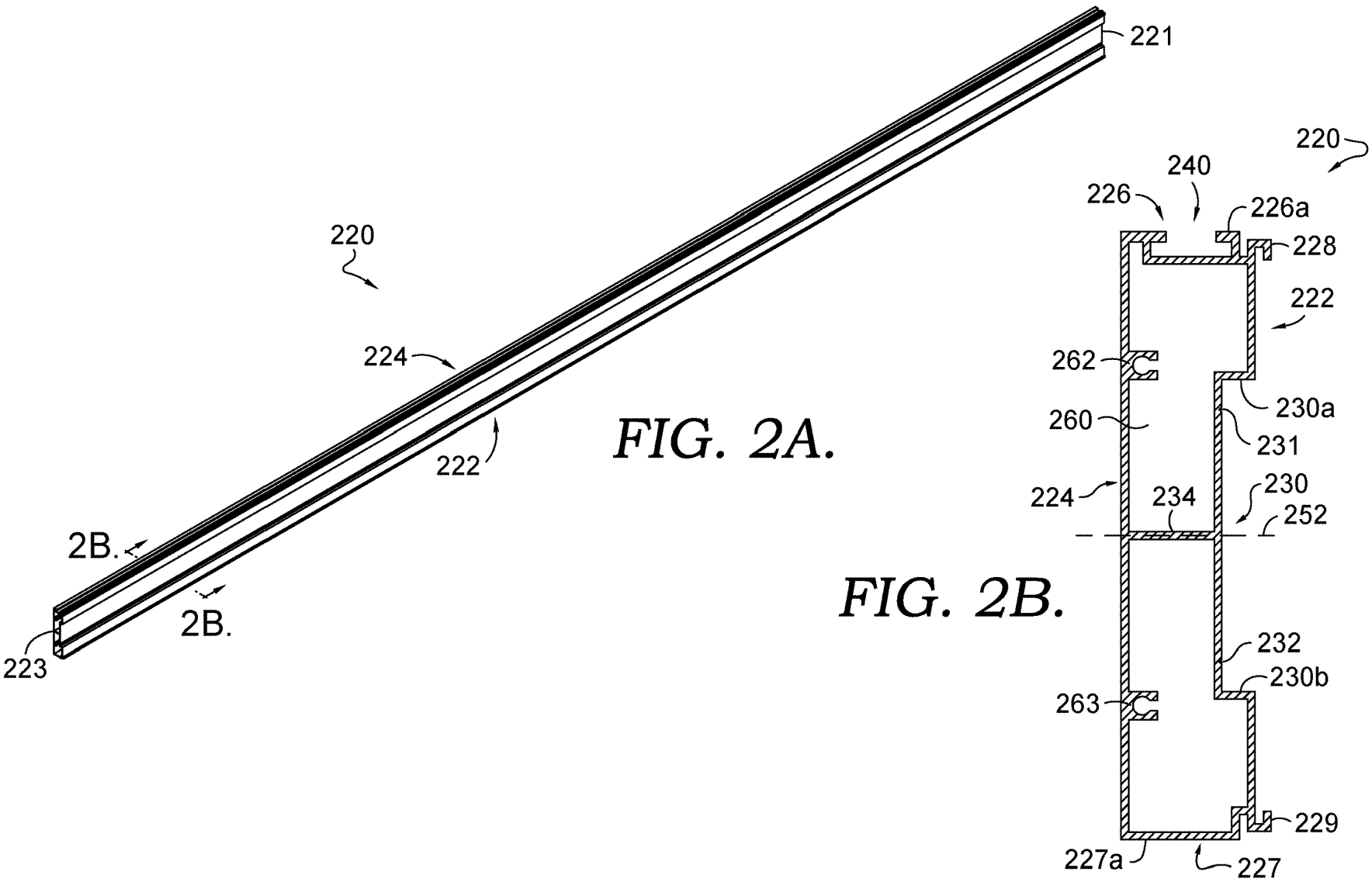
FIGS. 2A and 2B depict an example perimeter frame member, in accordance with aspects hereof.

FIGS. 2A and 2B depict an example perimeter frame member 220, with FIG. 2B being a cross-section along the cutline 2B in FIG. 2A. The perimeter frame member 220 of FIGS. 2A and 2B includes a first lateral end 221 and a second lateral end 223 opposite the first lateral end 221, a first side 222, and an opposing second side 224. As best seen in FIG. 2B, the perimeter frame member 220 also includes a first vertical end 226 and an opposing second vertical end 227.

Additionally, as best depicted in FIG. 2B, the example perimeter frame member 220 can include at least one internal support member 234 in some aspects, such as a reinforcement gusset, web, or rib. Internal support member 234 can extend internally between recessed portion 230 and the opposing second side 224. In some aspects, the internal support member 234 extends perpendicularly from both recessed portion 230 and the opposing second side 224. Internal support member 234 can extend internally along the length of the example perimeter frame member 220.

In certain aspects, the perimeter frame member 220 can be any size suitable for use in decking systems. In one aspect, the perimeter frame member 220 can have a height between the first vertical end 226 and the second vertical end 227 of about 5 inches or more, about 6 inches or more, about 7 inches or more, or about 7.25 inches. In the same or alternative aspects, the perimeter frame member 220 can include a width between the first side 222 and the second side of about 3 inches or less, about 2.5 inches or less, or about 2 inches or less.

As discussed above, in various aspects, the frame members disclosed herein can include certain structural features that may aid proper assembly of the decking system, provide additional structural support, and/or reduce the load bearing on fasteners in the decking system. For instance, in the aspect depicted in FIG. 2B, the perimeter frame member 220 can include a first engagement member 228 and a second engagement member 229. Each engagement members 228 and 229, in certain aspects, can exhibit a square hook-shaped structure, which can be used to engage with various decking components and accessories as discussed further below. As best seen in the aspect depicted in FIG. 2B, the first engagement member 228 is adjacent the first vertical end 226 and the second engagement member 229 is adjacent the second vertical end 227. In various aspects, the engagement member 228 can be offset from an outer surface 226*a* of the first vertical end 226. In such aspects, as discussed further below, such an offset can allow for one or more other components to interact with the perimeter frame member 220 and/or with the engagement member 228, so that the outer surface 226*a* remains flush or substantially level with such other components. In the same or alternative aspects, the engagement member 229 can be offset from an outer surface 227*a* of the second vertical end 227 for similar purposes as that discussed herein, or for any other purpose.

In various aspects, the first side 222 of the perimeter frame member 220 can include a recessed portion 230. In certain aspects, the recessed portion 230 can provide various structural and functional advantages to the decking systems, as will be discussed in detail below. As best seen in the aspect depicted in FIG. 2B, the recessed portion 230 can be positioned between the engagement members 228 and 229.

In certain aspects, alignment notches 231 and 232 can be positioned on the first side 222 of the perimeter frame member 220, which may facilitate interaction with various components described herein and/or function as a mark for identifying a desired location for using one or more fasteners. For example, the alignment notches 231 and 232 can include a v-shaped notch or a u-shaped notch extending the length of the perimeter frame member 220, from one end 221 to the opposing end 223.

In one or more aspects, such as that depicted in FIG. 2B, the perimeter frame member 220 can include a void 260 in an interior portion of the perimeter frame member 220. In various aspects, the void 260 can include one or more screw chases 262 and 263 for receiving one or more fasteners, as discussed further below.

In certain aspects, such as that depicted in FIG. 2B, the first vertical end 226 of the perimeter frame member 220 can include a channel 240 for receiving a clip or other fastener for securing one or more deck floor boards or other decking components. In the same or alternative aspects, the second vertical end 227 of the perimeter frame member 220 can include a substantially flat outer surface 227*a*, which can be utilized to receive one or more other types of fasteners, e.g., a screw, nail, and the like. In certain aspects, the perimeter frame member 220 can be oriented so either the first vertical end 226 or the second vertical end 227 is upward and faced to secure to one or more deck floor boards or other decking components, depending upon the desired type of floor boards and/or fasteners. In an aspect not depicted in the figures, the perimeter frame member 220 can include a channel on both vertical ends 226 and 227. In certain aspects, the channel, e.g., the channel 240, may be utilized to secure one or more accessories thereto.

In various aspects, in order for the perimeter frame member 220 to be oriented with the first vertical end 226 or the second vertical end 227 in an upward orientation to face and/or receive one or more deck floor boards, one or more of the structural features of the perimeter frame member 220 may be symmetrical about a midline 252, which can be at a midpoint that is equidistant between the outer surface 226*a* and the outer surface 227*a*. For instance, in one aspect, the screw chases 262 and 263 can be equidistant from the midline 252. In the same or alternative aspects, the engagement members 228 and 229 can be equidistant from the midline 252. In various aspects, the outer surface 226*a* of the first vertical end and the outer surface 227*a* of the second vertical end 227 can be equidistant from the midline 252. In one or more aspects, a first edge 230*a* of the recessed portion 230 and a second edge 230*b* of the recessed portion 230 can be equidistant from the midline 252.

In various aspects, any or all of the structural features of the perimeter frame member 220 described above with respect to FIGS. 2A and 2B can extend from the first lateral end 221 to the second lateral end 223.

Figure 18B:
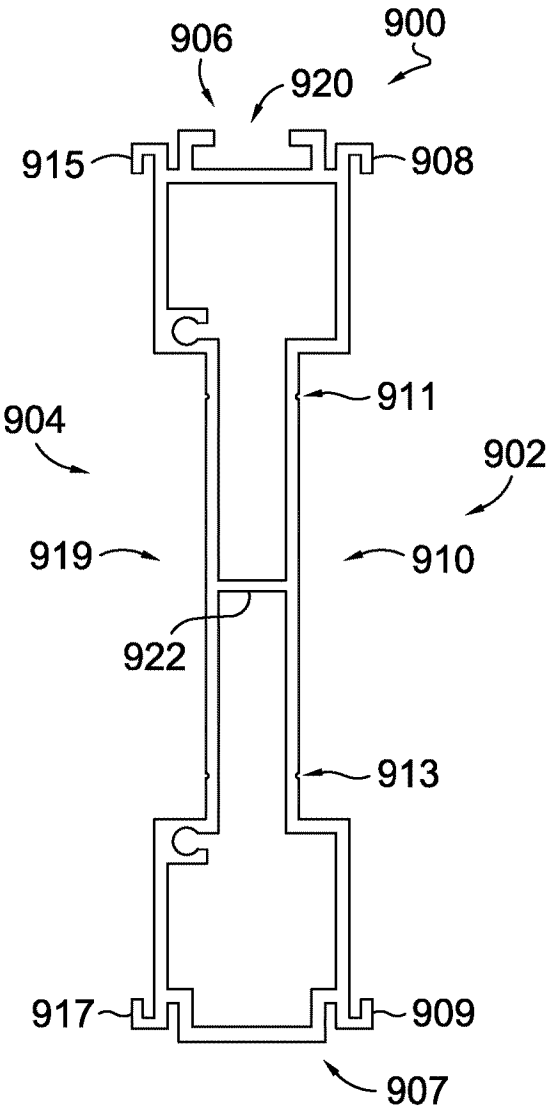
FIG. 18B depicts a side view of the perimeter frame member of FIG. 18A.
Figure 18A:
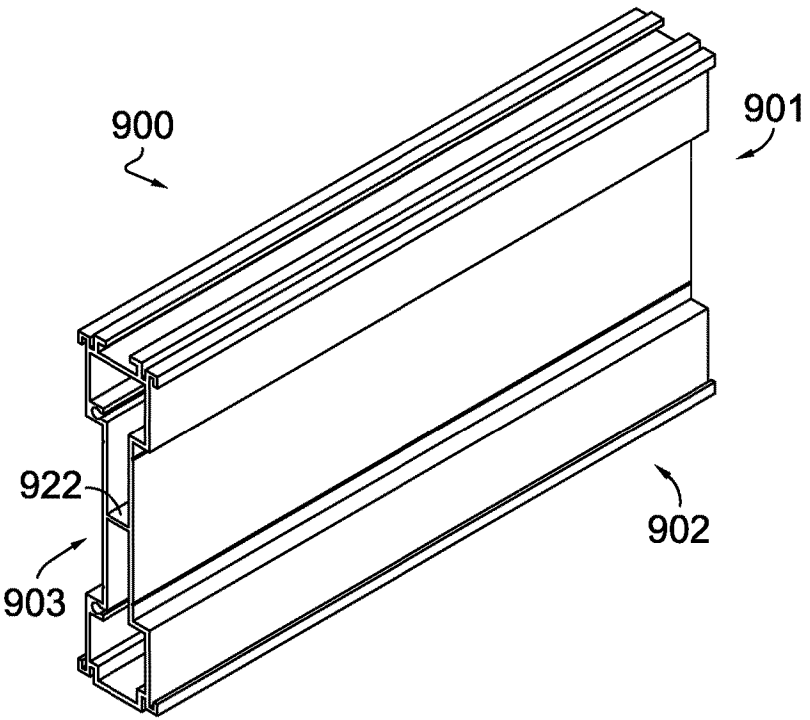
FIG. 18A depicts a top and side perspective view of another example perimeter frame member, in accordance with aspects hereof.

FIGS. 18A and 18B depict another example perimeter frame member 900. In the aspect depicted in FIGS. 18A and 18B, the perimeter frame member 900 can include similar features to the perimeter frame member 220 of FIGS. 2A and 2B. For instance, the perimeter frame member 900 can include a first side 902 and an opposing second side 904, a first lateral end 901 and a second lateral end 903 opposite the first lateral end 901, and a first vertical end 906 and an opposing second vertical end 907, in an aspect. In various aspects, the first vertical end 906 can include a channel 920, which may function similar to the channel 240 described herein. Like the perimeter frame member 220 described above, the perimeter frame member 900 can include a first engagement member 908 and a second engagement member 909 on the first side 902, in an aspect. Further, the first side 902 may include a recessed portion 910. The engagement members 908 and 909, and the recessed portion 910 can include any or all of the functions, features, and parameters described herein with respect to the engagement member 228 and 229, and the recessed portion 230. In aspects, the first side 902 can also include alignment notches 911 and 913, which may function similarly to the alignment notches 231 and 232 described herein.

As best seen in the aspect depicted in FIG. 18B, the second side 904 of the perimeter frame member 900 can include engagement members 915 and 917, and a recessed portion 919. The engagement members 915 and 917, and a recessed portion 919 can function similarly to the engagement member 228 and 229, and the recessed portion 230 as described herein. The second side 904 also may include alignment notches 911 and 913, in an aspect.

In various aspects, the perimeter frame member 900 includes at least one internal support member 922 in some aspects. Internal support member 922 extends internally between the first side 902 and the opposing second side 904. In some aspects, the internal support member 922 extends perpendicularly from both the first side 902 and the opposing second side 904. Internal support member 922 can extend internally along the length of the example perimeter frame member 900.

In various aspects, a double-sided perimeter frame member, such as the perimeter frame member 900 of FIGS. 18A and 18B, can be utilized in various areas or portions of a decking system frame. For instance, in one aspect, the perimeter frame member 900 can be utilized in place of an inner frame member, e.g., when the functionality of the engagement members and/or recessed portion is desired on both sides 902 and 904 of the perimeter frame member 900. In the same or alternative aspects, the perimeter frame member 900 can replace the perimeter frame member 206 in the system depicted in FIG. 1A, in order to extend the framing system out further than in FIG. 1A, e.g., by coupling one or more inner frame members to both sides of the perimeter frame member 900.

Figure 9A:
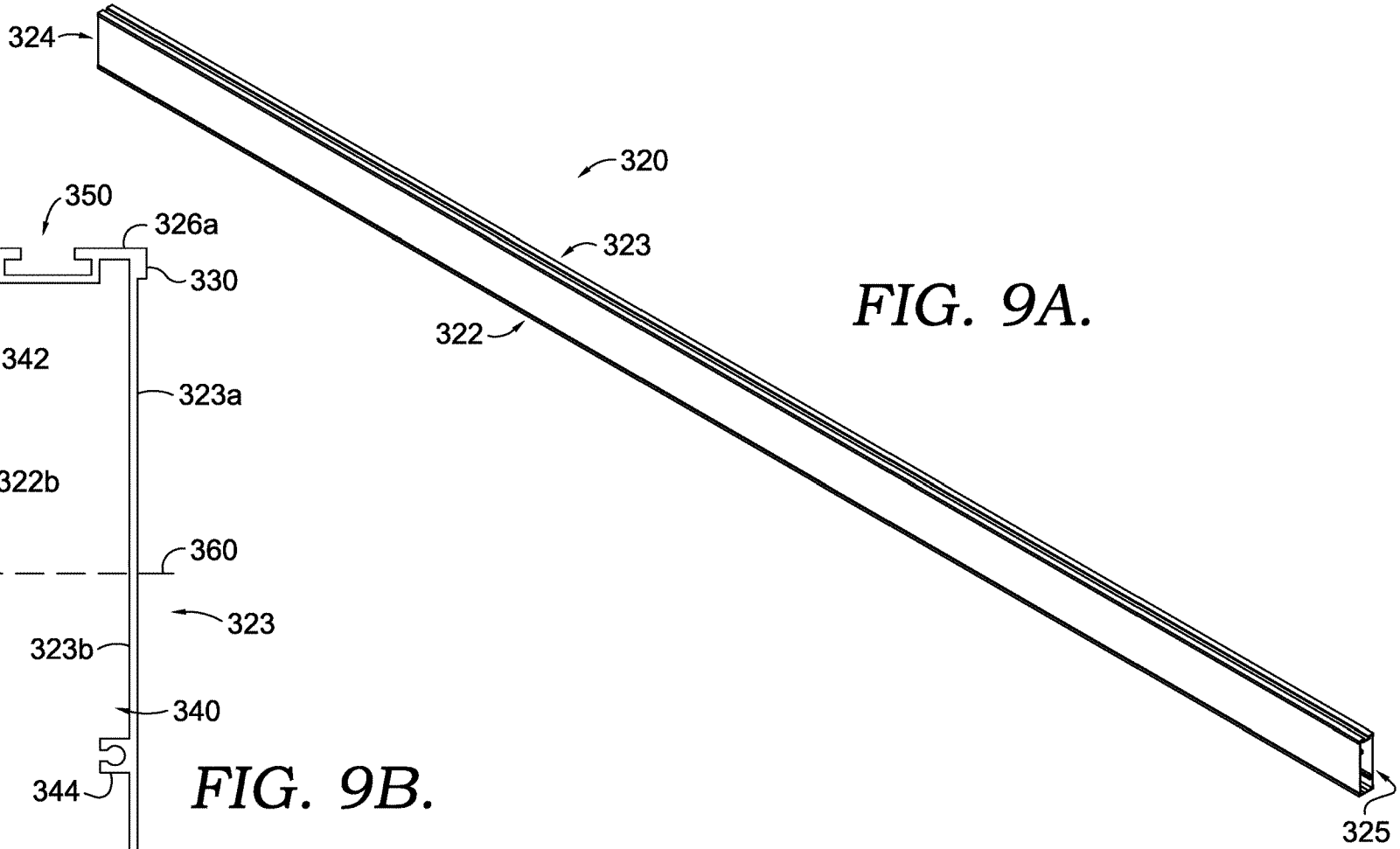
FIGS. 9A and 9B depict an example inner frame member, in accordance with aspects hereof.
Figure 9B:
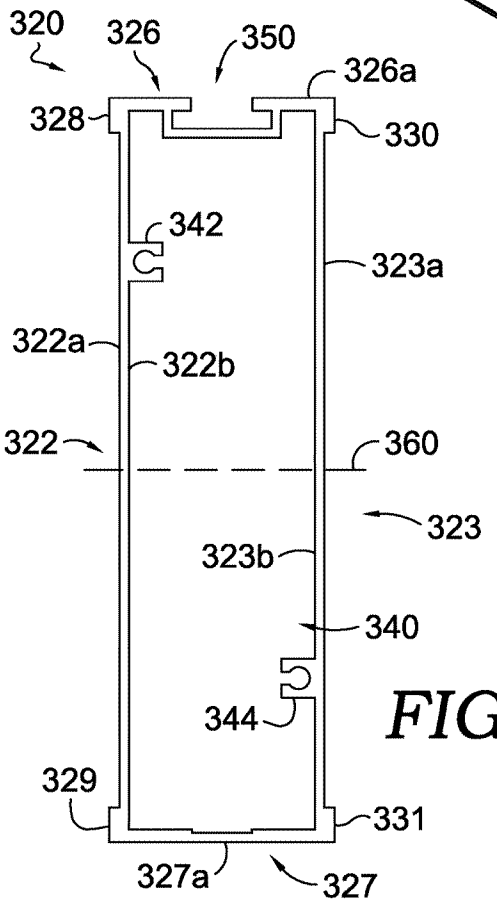

FIGS. 9A and 9B depicted an example inner frame member 320. In the aspect depicted in FIGS. 9A and 9B, the inner frame member 320 includes a first side 322 and an opposing second side 323, a first lateral end 324 and an opposing second lateral end 325. In certain aspects, as best seen in FIG. 9B, the inner frame member 320 can include a first vertical end 326 and an opposing second vertical end 327.

As discussed above, in various aspects, the frame members disclosed herein can include certain structural features that may aid proper assembly of the decking system, provide additional structural support, and/or reduce the load bearing on fasteners in the decking system. For instance, as best seen in the aspect depicted in FIG. 9B, the inner frame member 320 can include, on its first side 322, a first ridge 328 and a second ridge 329 with a main surface 322*a* extending between the first ridge 328 and the second ridge 329. In the same or alternative aspects, the inner frame member 320 can include, on its second side 323, a first ridge 330 and a second ridge 331 with a main surface 323*a* extending between the first ridge 330 and the second ridge 331. In various aspects, the first ridges 328 and/or 330 can be adjacent the first vertical end 326. In certain aspects, the first ridges 328 and/or 330 can extend from the outer surface 326*a* of the first vertical end 326 towards the second vertical end 327. In the same or alternative aspects, the first ridges 328 and/or 330 can be flush with the outer surface 326*a* of the first vertical end 326 and/or form part of a substantially flat outer surface 326*a*. In certain aspects, the second ridges 329 and 331 can be adjacent the second vertical end 327. In one or more aspects, the second ridges 329 and 331 can extend from an outer surface 327*a* of the second vertical end 327 towards the first vertical surface 326. In the same or alternative aspects, the second ridges 329 and 331 can be flush with the outer surface 327*a* of the second vertical end 327 and/or form part of a substantially flat outer surface 327*a*. In certain aspects, the thickness of the ridges, e.g., the ridge 328 can be greater than the thickness of the main surface 322*a*. In certain aspects, the first ridges 328 and 330 and/or the second ridges 329 and 331 can form flared vertical ends 326 and 327 of the inner frame member 320, which may provide additional structural support and/or facilitate framing or decking assembly. In various aspects, the inner frame member 320 may include more or less ridges on one or more sides.

In certain aspects, the inner frame member 320 can include a void 340 in an interior portion. In various aspects, the inner frame member 320 can include a first screw chase 342 and/or a second screw chase 344 in the void 340. In various aspects, the first screw chase 342 can extend out from an inner wall 322*b* of the first side 322 and/or the second screw chase 344 can extend out from an inner wall 323*b* of the second side 323. In various aspects, the first screw chase 342 and/or the second screw chase 344 can function as a guide for one or more fasteners, e.g., to secure one or more other components to the inner frame member 320.

In certain aspects, such as that depicted in FIG. 9B, the first vertical end 326 of the inner frame member 320 can include a channel 350 for receiving a clip or other fastener for securing one or more deck floor boards or other decking components. In the same or alternative aspects, the second vertical end 327 of the inner frame member 320 can include a substantially flat outer surface 327*a*, which can be utilized to receive one or more other types of fasteners, e.g., a screw, nail, and the like. In such aspects, the inner frame member 320 can be oriented so either the first vertical end 326 or the second vertical end 327 is upward and faced to secure to one or more deck floor boards or other decking components, depending upon the desired type of floor boards and/or fasteners. In an aspect not depicted in the figures, the inner frame member 320 can include a channel on both vertical ends 326 and 327. In certain aspects, the channel, e.g., the channel 350, can be utilized to secure one or more accessories thereto.

In various aspects, in order for the inner frame member 320 to be oriented with the first vertical end 326 or the second vertical end 327 in an upward orientation to face and/or receive one or more deck floor boards, one or more of the structural features of the inner frame member 320 may be symmetrical about a midline 360, which can be equidistant from the surfaces 326*a* and 327*a*. For instance, in one aspect, the screw chases 342 and 344 can be equidistant from the midline 360. In the same or alternative aspects, the ridges 328 and 329, and/or the ridges 330 and 331, can be equidistant from the midline 360. In various aspects, the outer surface 326*a* of the first vertical end 326 and the outer surface 327*a* of the second vertical end 327 can be equidistant about the midline 360.

In various aspects, any or all of the structural features of the inner frame member 320 described above with respect to FIGS. 9A and 9B can extend from the first lateral end 324 to the second lateral end 325.

Figures 3A, 3B:
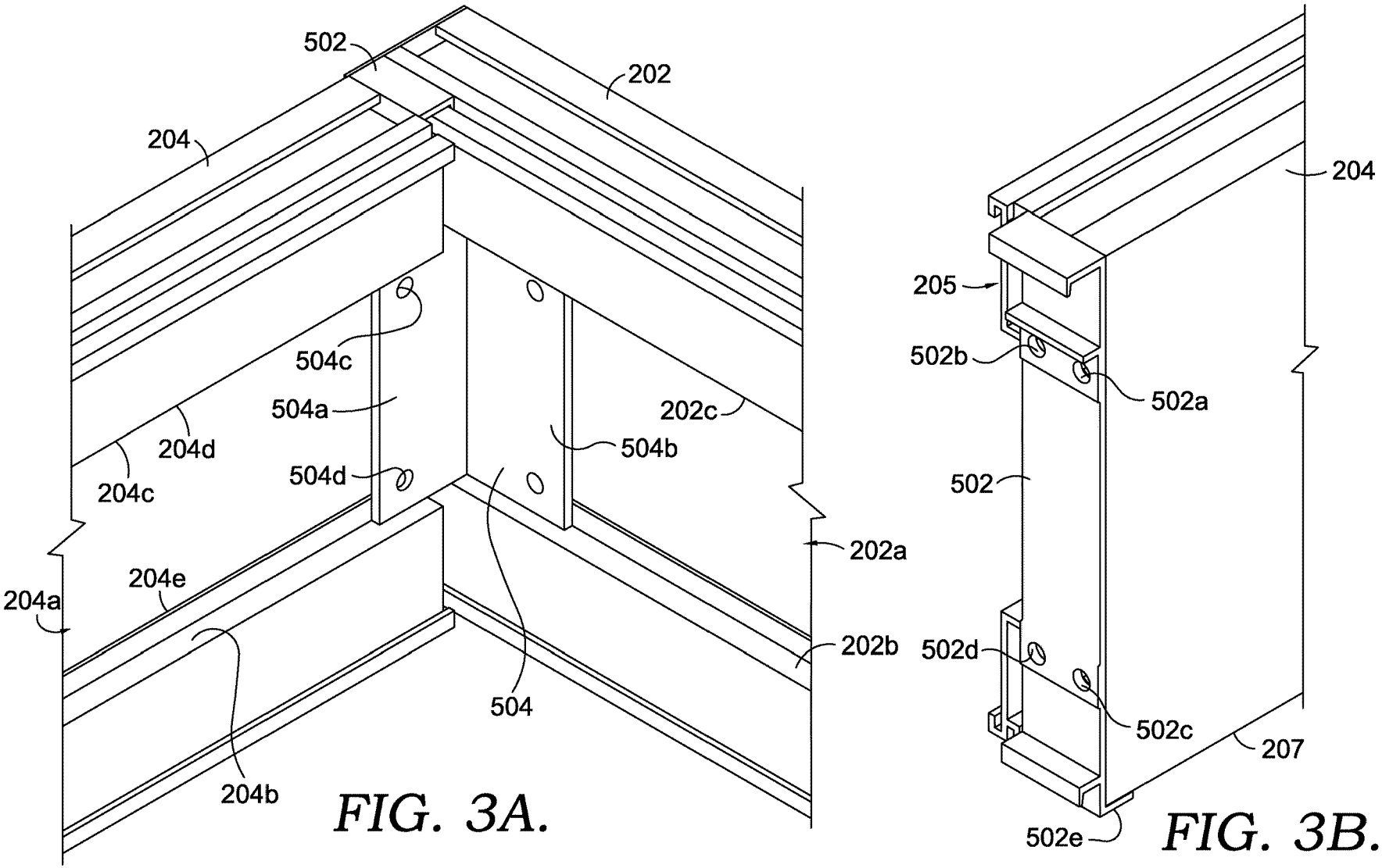
FIG. 3A depicts a first perimeter frame member coupled to a second perimeter frame member, showing a perimeter frame member hanger, and an L-bracket positioned within a recessed portion of the first perimeter frame member and within a recessed portion of the second perimeter frame member, in accordance with aspects hereof.
FIGS. 3B and 3C depict the perimeter frame member hanger of FIG. 3A coupled to the second perimeter frame member, in accordance with aspects hereof.

FIGS. 3A-3D depict one example of a perimeter frame member 202 coupled to another perimeter frame member 204. As best seen in FIG. 3A, a perimeter frame member hanger 502 is positioned between the perimeter frame members 202 and 204 to couple together the perimeter frame members 202 and 204. Further, in the aspect best seen in FIG. 3A, an L-bracket 504 contacts a recessed portion 202*a* of the perimeter frame member 202 and contacts the recessed portion 204*a* of the perimeter frame member 204. It should be understood that the example depicted in FIGS. 3A-3D is one example of an interaction between two perimeter frame members and is not limiting on the disclosure herein. For instance, in other aspects, two perimeter frame members may be coupled together using one or more L-brackets in the absence of a perimeter frame member hanger. Further, in yet other aspects, two perimeter frame members may be coupled together using one or more perimeter frame member hangers in the absence of an L-bracket.

As best seen in the aspect depicted in FIG. 3A, and discussed above, the L-bracket 504 contacts a recessed portion 202*a* of the perimeter frame member 202 and contacts the recessed portion 204*a* of the perimeter frame member 204. In certain aspects, such as that depicted in FIG. 3A, the L-bracket 504 can be sized for insertion into the recessed portions 202*a* and 204*a*. For instance, a portion 504*a* of the L-bracket 504 can contact both edges 204*b* and

204*c* of the recessed portion 204*a*, in aspects. In the same or alternative aspects, a portion 504*b* of the L-bracket 504 can contact both edges 202*b* and 202*c* of the recessed portion 202*a*. In various aspects not depicted in FIG. 3A, the L-bracket 504 can be secured to the perimeter frame members 202 and 204 using one or more fasteners. In various aspects, one or more apertures in the L-bracket 504, e.g., apertures 504*c* and 504*d*, can align with the alignment notches 204*d* and 204*e* in the recessed portion 204*a*. In various aspects, similar features regarding the portion 504*b* of the L-bracket 504 and the perimeter frame member 202, and associated alignment notches can be present. In certain aspects, the edges 202*b* and 202*c* of the recessed portion 202*a* can provide additional structural integrity and securement in the event one or more fasteners fail, e.g., by the L-bracket 504 being retained in place due to the interaction with the recessed portion 202*a* and the edges 202*b* and 202*c*.

Figure 3D:
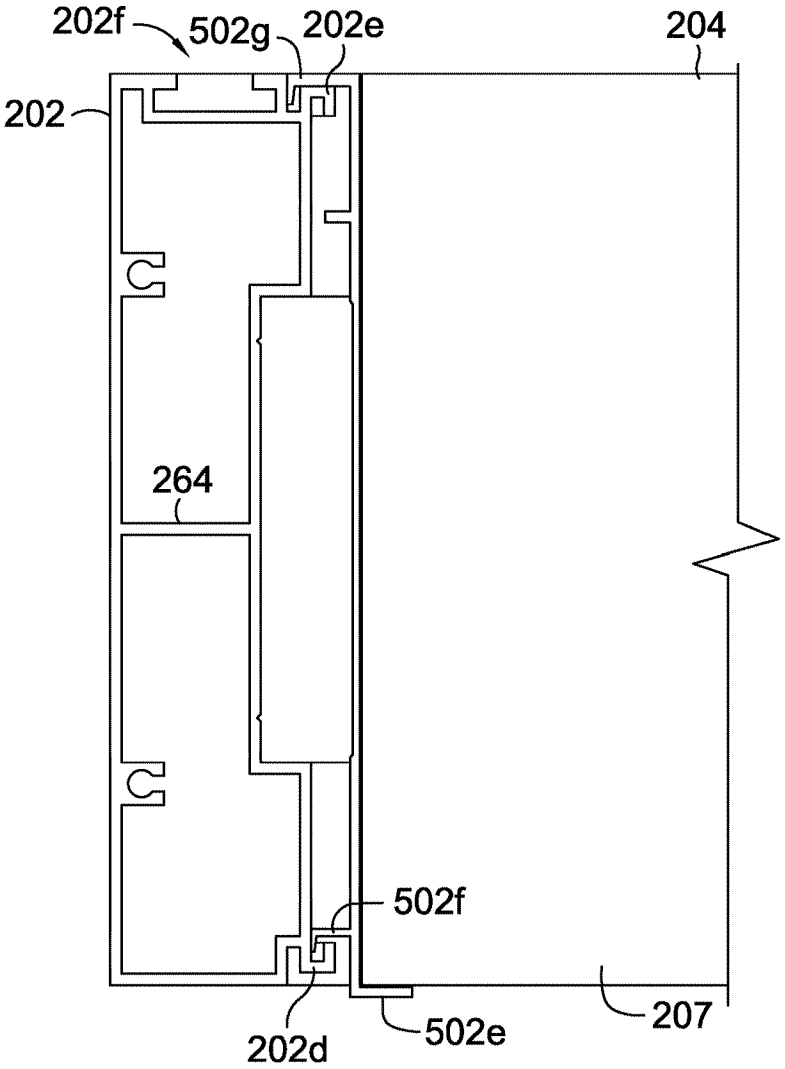
FIG. 3D depicts a side view of the perimeter frame member hanger of FIG. 3A coupled to the first perimeter frame member, in accordance with aspects hereof.
Figure 3C:
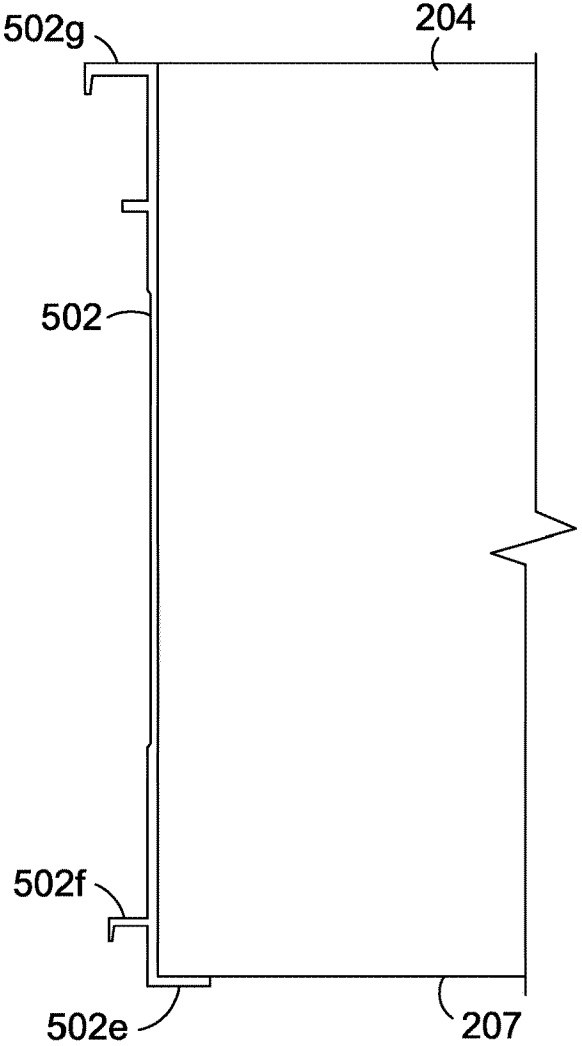
Figure 4:
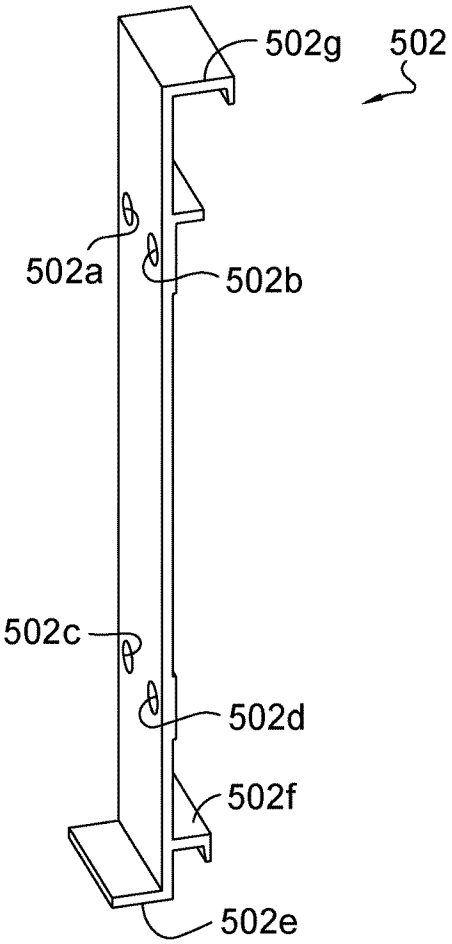
FIG. 4 depicts, the perimeter frame member hanger of FIG. 3A, in accordance with aspects hereof.

FIGS. 3B and 3C depict the perimeter frame member 204 coupled to the perimeter frame member hanger 502 in isolation. FIG. 4 depicts the perimeter frame member hanger 502 in isolation. In various aspects; the perimeter frame member 202 can be coupled to a lateral end 205 of the perimeter frame member 204 using one or more fasteners, which are excluded from the figures. In certain aspects, the perimeter frame member hanger 502 can include apertures 502*a*, 502*b*, 502*c*, and 502*d*, for one or more fasteners to secure the perimeter frame member hanger 502 to the perimeter frame member 204. In certain aspects, one or more of the apertures 502*a*, 502*b*, 502*c*, and 502*d* may align with one or more screw chases in the perimeter frame member 204, which is not depicted in FIGS. 3A-3D. Example screw chases in a perimeter frame member are discussed above with reference to FIG. 2B.

In the aspect depicted in FIG. 4, the perimeter frame member hanger 502 can include a support surface extension 502*e*. In such aspects, as best seen in FIGS. 3B-3D, the support surface extension 502*e* can provide a support surface for the second vertical end 207 of the perimeter frame member 204.

In various aspects, once the perimeter frame member hanger 502 is coupled to the perimeter frame member 204, the perimeter frame member hanger 502 can be secured to the perimeter frame member 202. For instance, as best seen in FIG. 3D, a first hanger tab 502*g* of the perimeter frame member hanger 502 can be positioned between a channel 202*f* and engagement member 202*e* of the perimeter frame member 202. In the same or alternative aspects, a second hanger tab 502*f* of the perimeter frame member hanger 502 can engage with the engagement member 202*d* of the perimeter frame member 202. Additionally, as best depicted in FIGS. 3D and 6B, the perimeter frame member 202 includes an internal support member 264. Internal support member 264 extends internally between a recessed portion of the perimeter frame member 202 and the opposing side of perimeter frame member 202.

Figure 6A:
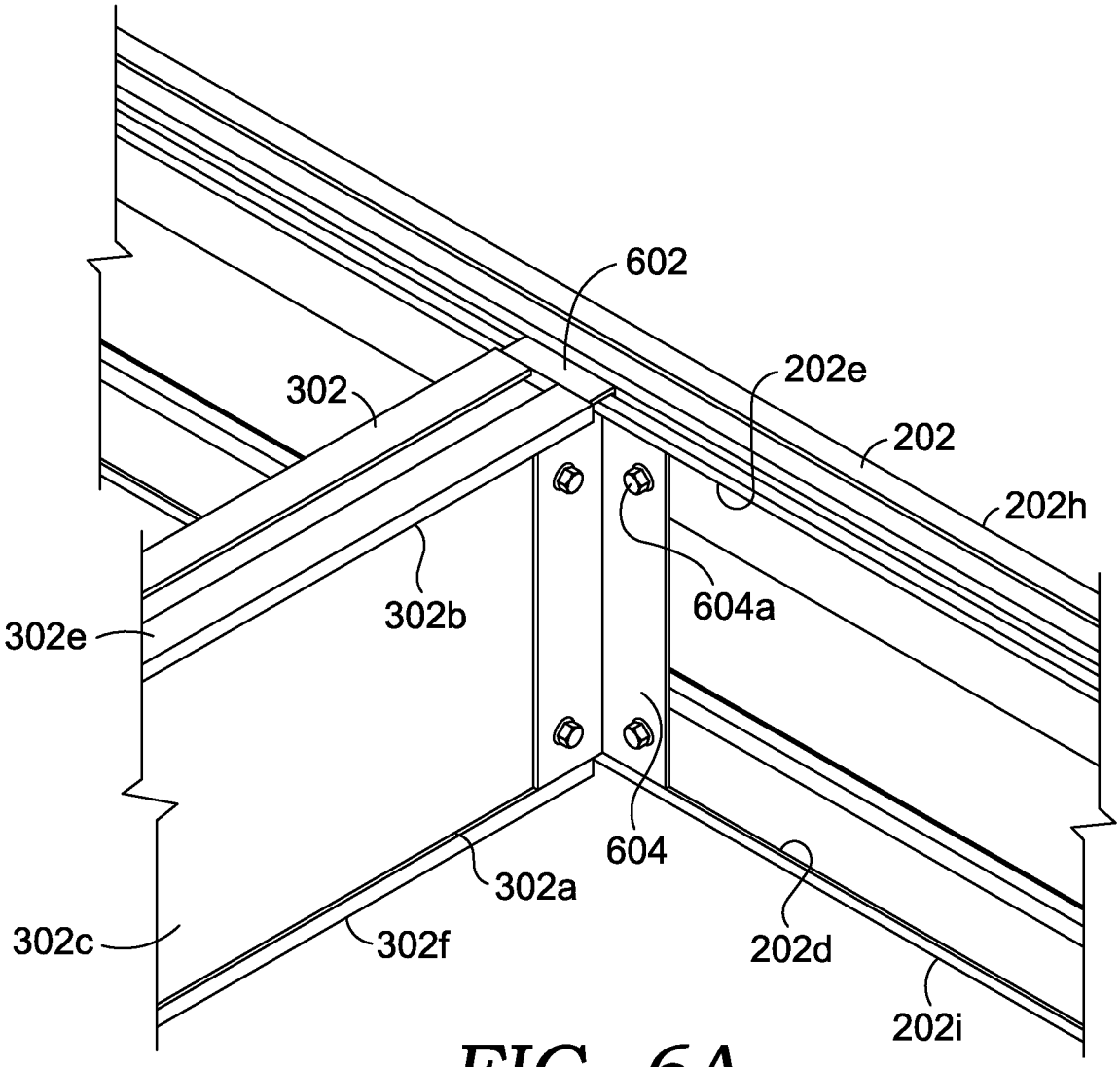
FIG. 6A depicts one example of an inner frame member coupled to a perimeter frame member, with an inner frame member hanger, and an L-bracket coupled to the inner frame member and to the perimeter frame member, in accordance with aspects hereof.
Figure 6B:
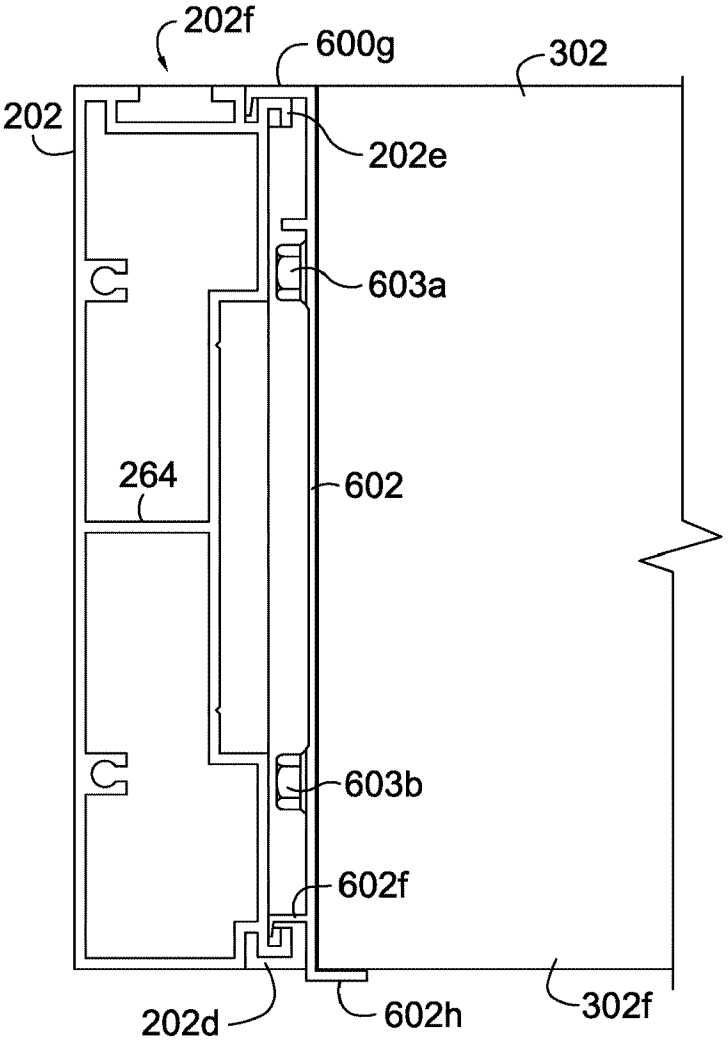
FIG. 6B depicts a side view of the inner frame member, inner frame member hanger, and perimeter frame member of FIG. 6A, in accordance with aspects hereof.

FIGS. 6A and 6B depict an example interaction between an inner frame member 302 and a perimeter frame member 202. In the aspect depicted in FIGS. 6A and 6B, the inner frame member 302 is coupled to the perimeter frame member 202 utilizing an inner frame member hanger 602 and an L-bracket 604. It should be understood that the example depicted in FIGS. 6A and 6B is one example of an interaction between an inner frame member and a perimeter frame member and is not limiting on the disclosure herein. For instance, in other aspects, an inner frame member and a perimeter frame member may be coupled together using one or more L-brackets in the absence of an inner frame member hanger. Further, in yet other aspects, an inner frame member and a perimeter frame member may be coupled together using one or more inner frame member hangers in the absence of an L-bracket.

As discussed above, in various aspects, the systems disclosed herein can facilitate proper alignment for assembly of a framing system and/or decking system. For instance, in the aspect depicted in FIG. 6A, the L-bracket 604 can be sized to fit between the engagement members 202*e* and 202*d* of the perimeter frame member 202, and/or can be sized to fit between the ridges 302*a* and 302*b* of the inner frame member 302. In such aspects, the height of the ridges 302*a* and 302*b* extending along the side 302*c* of the inner frame member 302 from the respective ends 302*e* and 302*f* can be substantially the same as the height of the engagement members 202*d* and 202*e* with respect to the respective ends 202*h* and 202*i* of the perimeter frame member 202. In the aspect depicted in FIG. 6A, the L-bracket 604 can be secured to the inner frame member 302 and/or the perimeter frame member 202 using one or more fasteners, e.g., the fastener 604*a*. In certain aspects, the ridges 302*a* and 302*b* of the inner frame member 302 and/or the engagement members 202*d* and 202*e* of the perimeter frame member 202 can provide additional structural integrity and securement in the event one on more fasteners fail, e.g., by the L-bracket 604 being retained in place due to the interaction with the ridges 302*a* and 302*b*, and/or the engagement members 202*d* and 202*e*.

Figure 7:
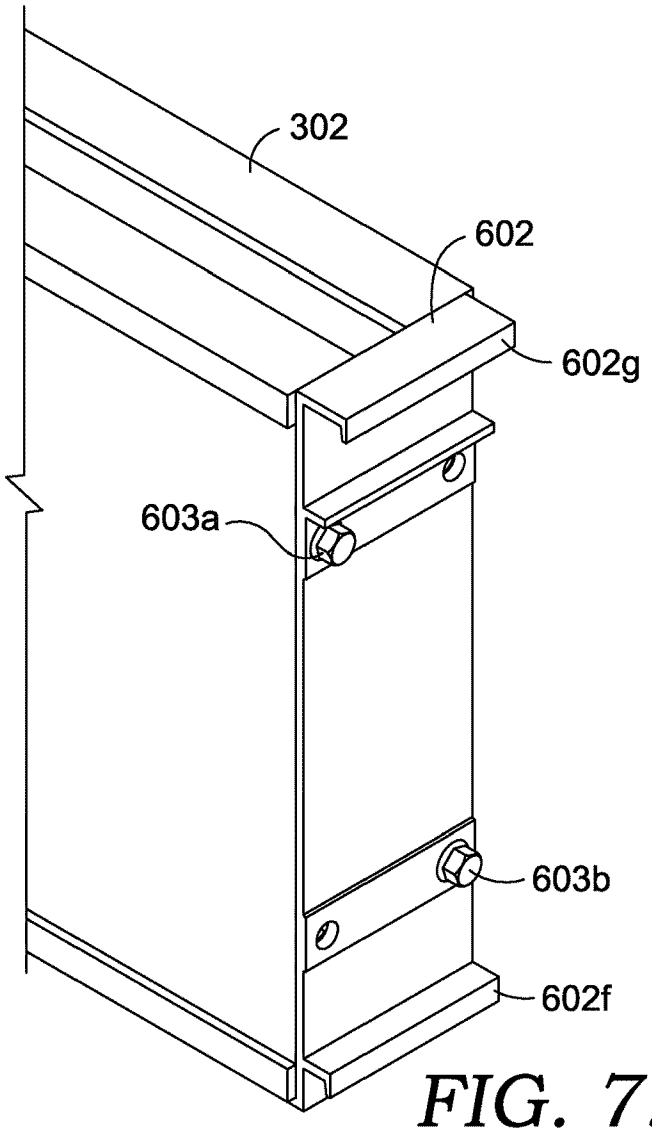
FIG. 7 depicts the inner frame member hanger and inner frame member of FIG. 6A, in accordance with aspects hereof.
Figure 8:
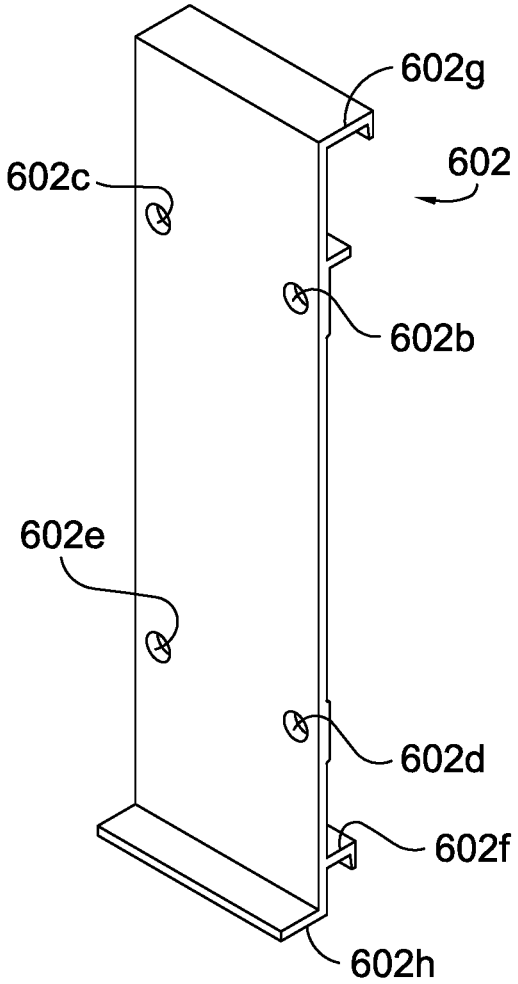
FIG. 8 depicts the inner frame member hanger of FIG. 6A, in accordance with aspects hereof.

As discussed above, in the aspect depicted in FIG. 6A, an inner frame member hanger 602 is utilized to couple the inner frame member 302 and the perimeter frame member 202. FIG. 8 depicts the inner frame member hanger 602 in isolation. As can be seen in FIG. 8, the inner frame member hanger 602 can include one or more apertures, e.g., apertures 602*b*, 602*c*, 602*d*, and 602*e*, which can guide a fastener for securing the inner frame member hanger 602 to the inner frame member 302. For instance, as can be seen in FIGS. 6B and 7, fasteners 603*a* and 603*b* secure the inner frame member hanger 602 to the inner frame member 302. In certain aspects, the fasteners 603*a* and/or 603*b* can be inserted into screw chases of the inner frame member 302. Screw chases for inner frame members are discussed herein with respect to FIGS. 9A and 9B.

As best seen in the aspect depicted in FIG. 6B, the inner frame member hanger 602 includes a support surface extension 602*h* which can support a portion of the inner frame member 302, e.g., a vertical end 302*f* of the inner frame member 302.

In various aspects, once the inner frame member hanger 602 is coupled to the inner frame member 302, the inner frame member hanger 602 can be secured to the perimeter frame member 202. For instance, as best seen in FIG. 6B, a first hanger tab 602*g* of the inner frame member hanger 602 can be positioned between a channel 202*f* and engagement member 202*e* of the perimeter frame member 202. In the same or alternative aspects, a second hanger tab 602*f* of the inner frame member hanger 602 can engage with the engagement member 202*d* of the perimeter frame member 202.

Figure 12:
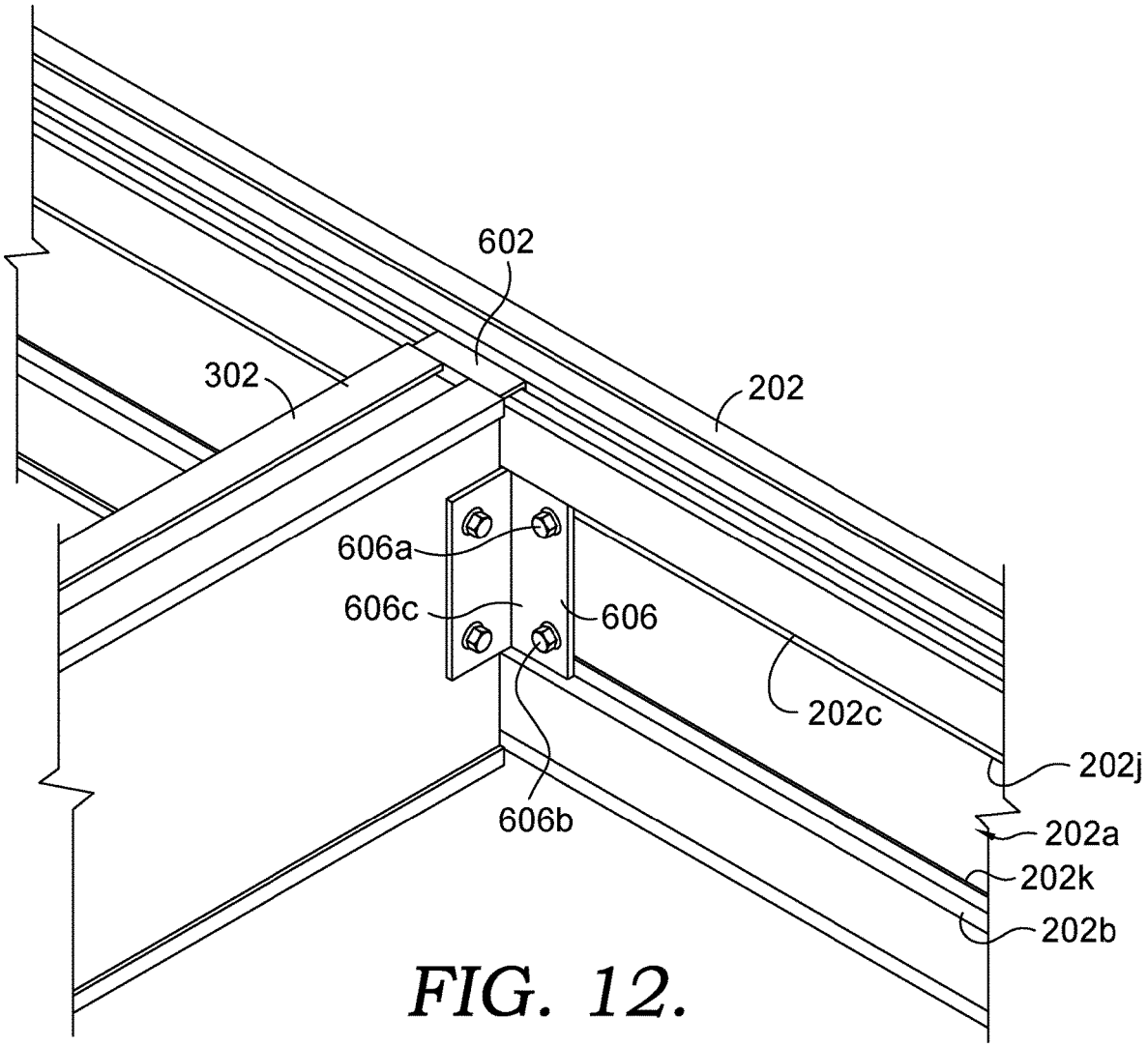
FIG. 12 depicts an example of an inner frame member coupled to a perimeter frame member, with an inner frame member hanger, and an L-bracket coupled to both the inner frame member and the perimeter frame member, in accordance with aspects hereof.

FIG. 12 is another example of an inner frame member 302 coupled to a perimeter frame member 202. In the aspect depicted in FIG. 12, the inner frame member 302 is coupled to the perimeter frame member 202 as discussed above with respect to FIGS. 6A, 6B, 7 and 8, with respect to the inner frame member hanger. Additionally, in the aspect depicted in FIG. 12, an L-bracket 606 is utilized for securing the inner frame member 302 to the perimeter frame member 202.

Unlike in the aspect depicted in FIG. 6A, a shorter L-bracket 606 is utilized, which can be positioned within a recessed portion 202*a* of the perimeter frame member 202, as discussed above with respect to FIG. 3A. For instance, in the aspect depicted in FIG. 12, the L-bracket 606 contacts a recessed portion 202*a* of the perimeter frame member 202 and/or is sized to be inserted into the recessed portion 202*a*.

In aspects, a portion 606*c* of the L-bracket 606 can contact both edges 202*b* and 202*c* of the recessed portion 202*a*. In various aspects, the L-bracket 606 can be secured to the perimeter frame member 202 and the inner frame member) using one or more fasteners, e.g., fasteners 606*a* and 606*b*. In various aspects, one or more apertures in the L-bracket, which are not shown in FIG. 12, can align with the alignment notches 202*j* and 202*k* in the recessed portion 202*a*. In certain aspects, the edges 202*b* and 202*c* of the recessed portion 202*a* can provide additional structural integrity and securement in the event one or more fasteners fail, e.g., by the L-bracket 606 being retained in place due to the interaction with the recessed portion 202*a* and the edges 202*b* and 202*c*.

Figure 10:
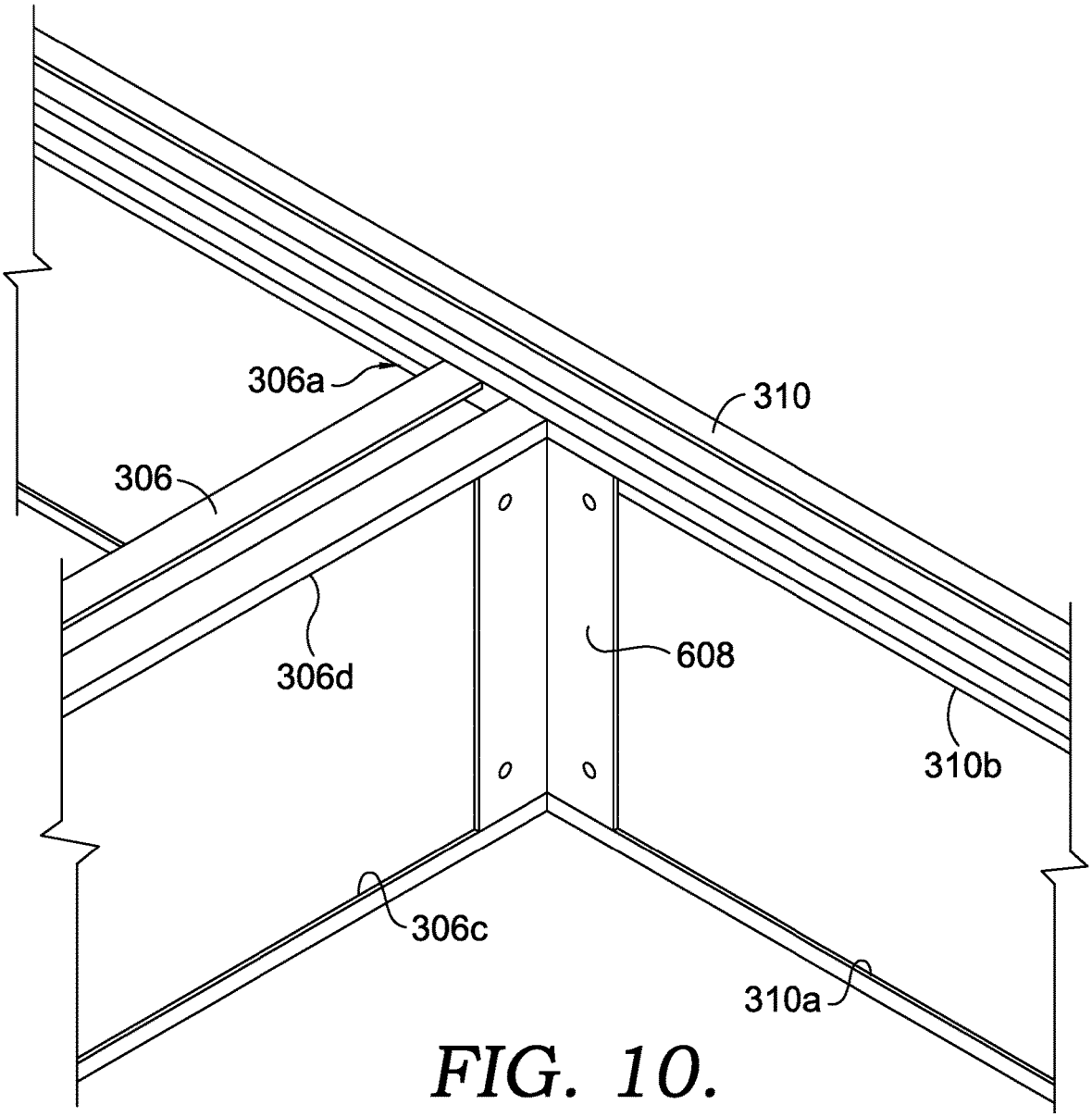
FIG. 10 depicts a first inner frame member coupled to a second inner frame member at a first later end of the first inner frame member, with an L-bracket coupled to both the first and second inner frame members, in accordance with aspects hereof.
Figure 11:
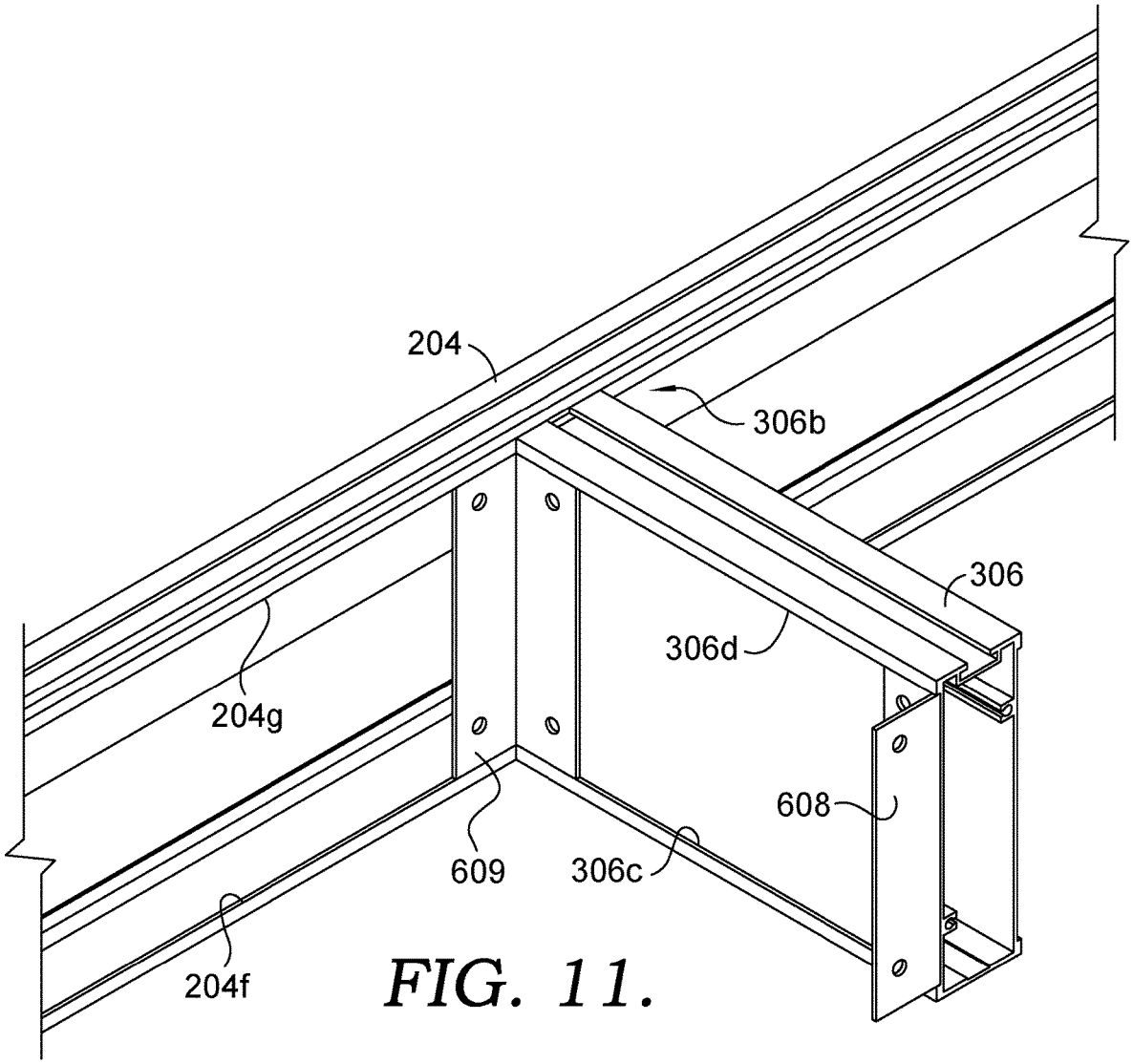
FIG. 11 depicts the first inner frame member of FIG. 10 coupled to a perimeter frame member at a second lateral end of the first inner frame member, with an L-bracket coupled to both the first inner frame member and the perimeter frame member, in accordance with aspects hereof.

FIGS. 10 and 11 depict an inner frame member 306 coupled to another inner frame member 310 at a lateral end 306*a* of the inner frame member 306, and the inner frame member 306 coupled to a perimeter frame member 204 at a lateral end 306*b* of the inner frame member 306. As best seen in the aspect depicted in FIG. 10, the inner frame member 306 is coupled to the inner frame member 310 using one or more L-brackets, e.g., the L-bracket 608. The L-bracket 608 can be secured to the inter frame members 306 and 310 using one or more fasteners, which are not depicted in FIG. 10. In various aspects, the ridges of the inner frame members 306 and 310 can provide additional structural support for the L-bracket 608, as well as provide the proper alignment of the L-bracket 608 and the inner frame members 306 and 310. For instance, in the aspect depicted in FIG. 10, the L-bracket 608 can be inserted between the ridges 306*c* and 306*d* of the inner frame member 306 and/or between the ridges 310*a* and 310*b* of the inner frame member 310.

As best seen in FIG. 11, the inner frame member 306 is coupled to the perimeter frame member 204 using one or more L-brackets, e.g., the L-bracket 609. The L-bracket 609 can be secured to the inner frame member 306 and perimeter frame member 204 using one or more fasteners, which are not depicted in FIG. 11. In various aspects, the ridges 306*c* and 306*d* of the inner frame member 306 and the engagement members 204*f* and 204*g* of the perimeter frame member 204 can provide additional structural support for the L-bracket 609, as well as provide the proper alignment of the L-bracket 609 with respect to the inner frame member 306 and the perimeter frame member 204. For instance, in the aspect depicted in FIG. 11, the L-bracket 609 can be inserted between the ridges 306*c* and 306*d* of the inner frame member 306 and/or between the engagement members 204*a* and 204*b* of the perimeter frame member 204.

Figure 13A:
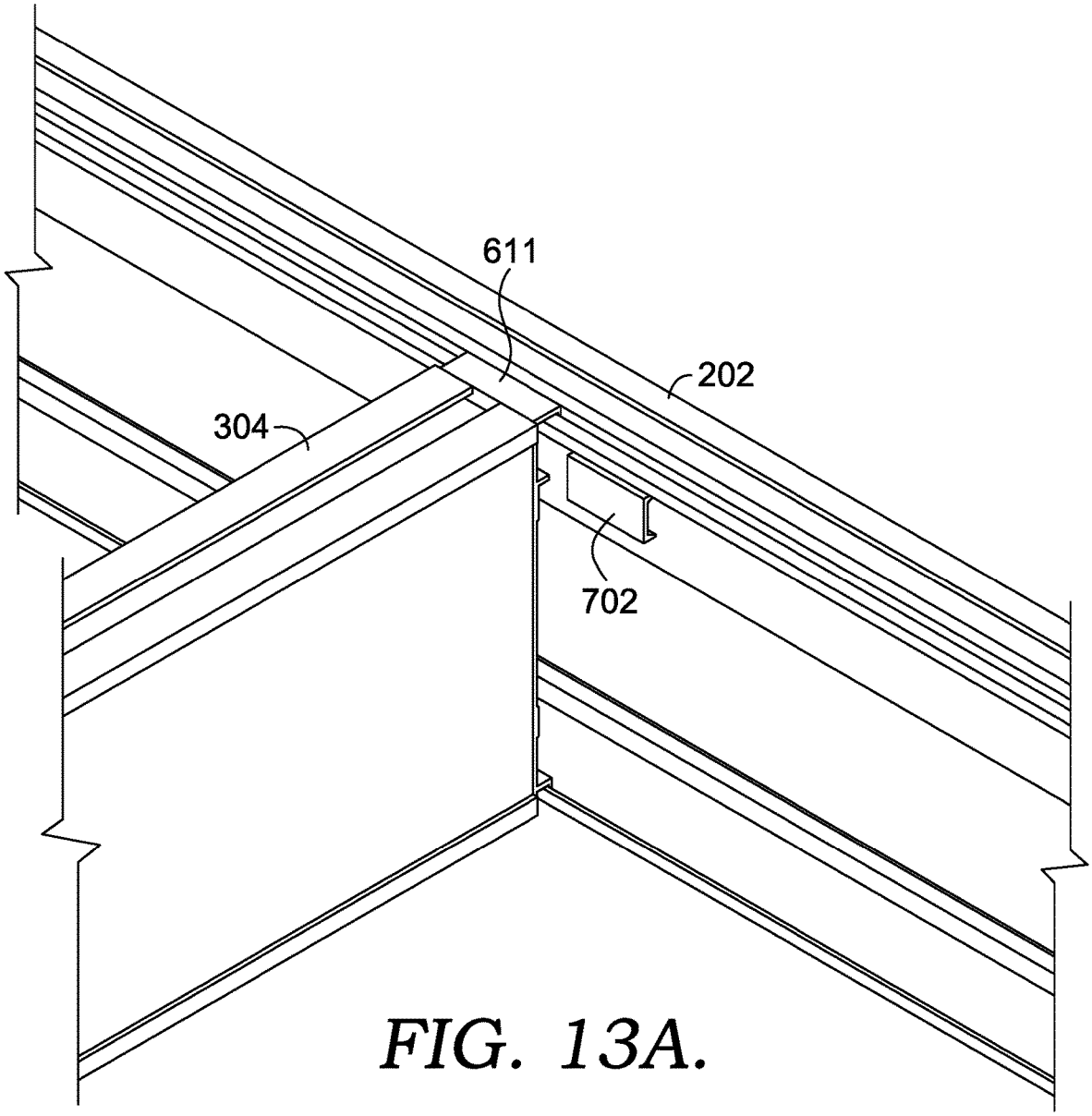
FIGS. 13A and 13B depict another example of an inner frame member coupled to a perimeter frame member, with an inner frame member hanger, and an uplift clip positioned between the inner frame member hanger and the perimeter frame member, in accordance with aspects hereof.
Figure 13C:
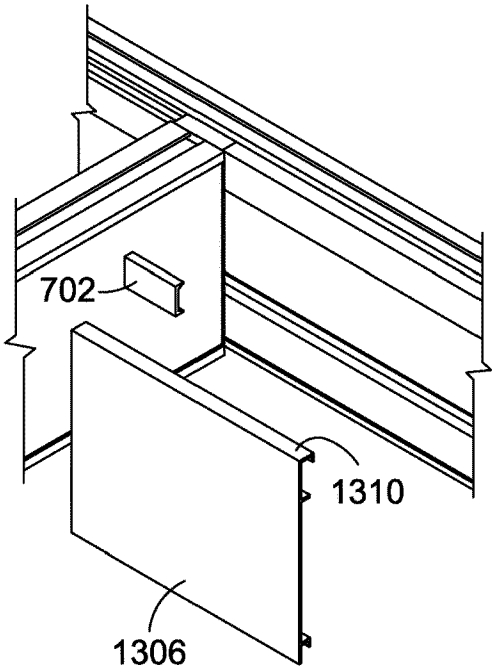
FIGS. 13C and 13D depict an example positioning of an uplift clip between the inner frame member hanger and the perimeter frame member, in accordance with aspects hereof.
Figure 13D:
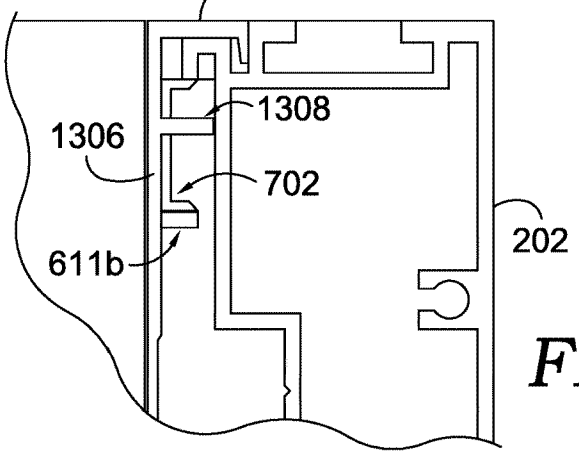
Figure 13B:
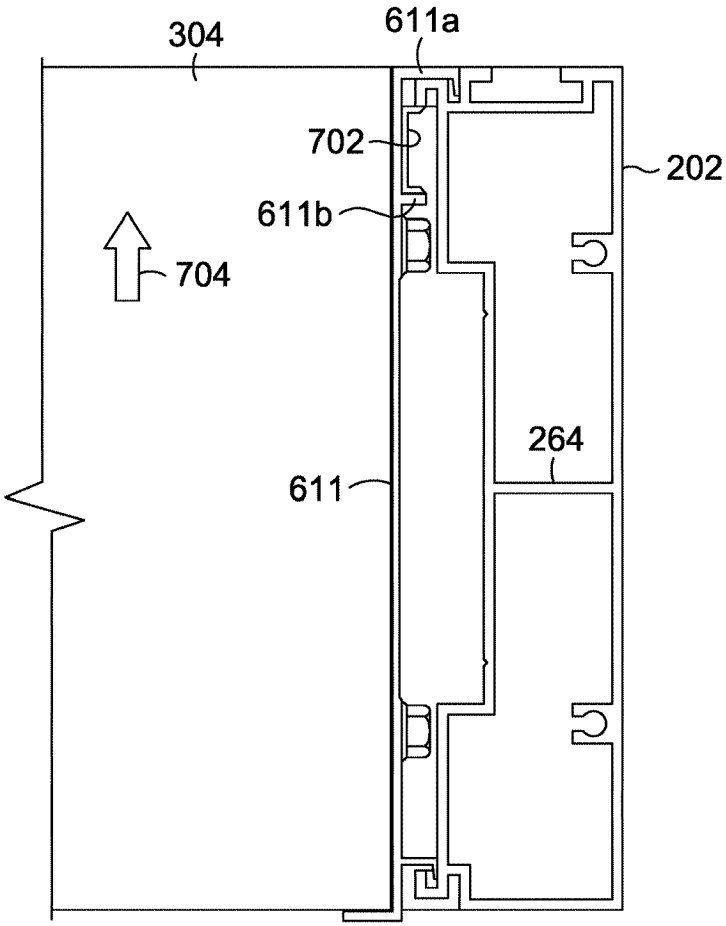

FIGS. 13A and 13B depict an inner frame member 304 coupled to a perimeter frame member 202 using an inner frame member hanger 611, similar to that described above with respect to the inner frame member 302, the perimeter frame member 202, and the inner frame member hanger 602 of FIGS. 6A, 6B, 7, and 8. FIGS. 13A and 13B also depict an uplift clip 702 positioned between the inner frame member hanger 611 and the perimeter frame member 202. As best seen in the aspect depicted in FIG. 13B, the uplift clip is a C-shaped and/or U-shaped member that is inserted between the inner frame member hanger 611 and the perimeter frame member 202. For instance, the uplift clip 702 can be inserted in a region between the first hanger tab 611*a* and the intermediate tab 611*b* of the inner frame member hanger 611. In such aspects, the uplift clip 702 can prevent the inner frame member 304 and/or the inner frame member hanger 611 from being removed from the perimeter frame member 202 in an upward direction, e.g., such as the direction provided by the arrow 704. In certain aspects, an uplift clip, e.g., the uplift clip 702, can prevent multiple types of components from being removed from the perimeter frame member 202 when such components are coupled to the perimeter frame member 202 via the engagement members of the perimeter frame member.

Additionally, in certain aspects, uplift clip 702 can be prevented from moving by one or more spacers. For example, as best shown in FIGS. 13C and 13D, a spacer 1306 includes a top flange 1310 that is positioned adjacent inner frame member hanger (e.g. inner frame member hanger 611*a*). The top flange 1310 includes a terminal ridge that extends in a downward direction and is configured to hook onto the engagement member 228. Spacer 1306 also includes a wall that extends from the top flange 1310 to a bottom edge, and in examples, a height of the wall from the top flange to the bottom edge is configured such that the spacer 1306 extends to the bottom of the perimeter frame member 202. The spacer 1306 may also include a lower ridge that is positioned to cooperatively engage the engagement member 229. Additionally, spacer 1306 includes retaining flange or rib 1308. In some aspects, retaining flange 1308 is positioned such that retaining flange 1308 engages one of the terminal edges of uplift clip 702, when the spacer 1306 is positioned adjacent the inner frame member hanger with the uplift clip 702.

Figure 14B:
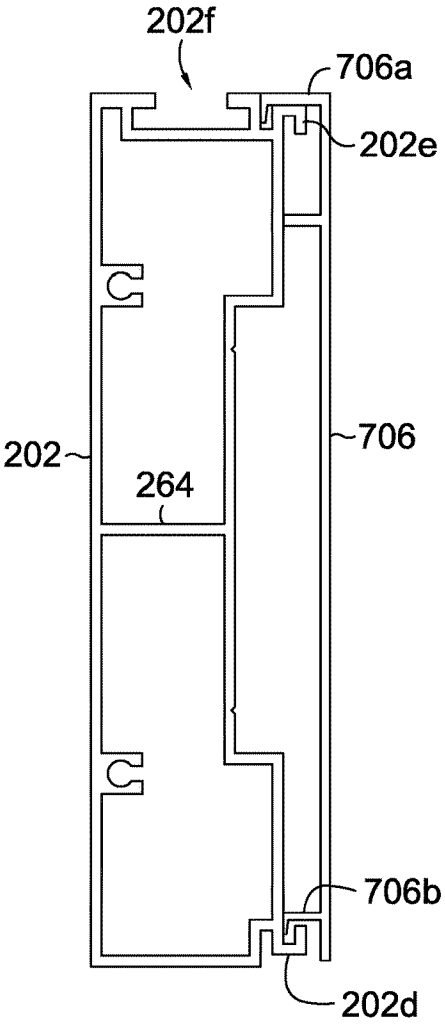
FIG. 14B depicts a side view of the spacing member and perimeter frame member of FIG. 14A, in accordance with aspects hereof.
Figure 14A:
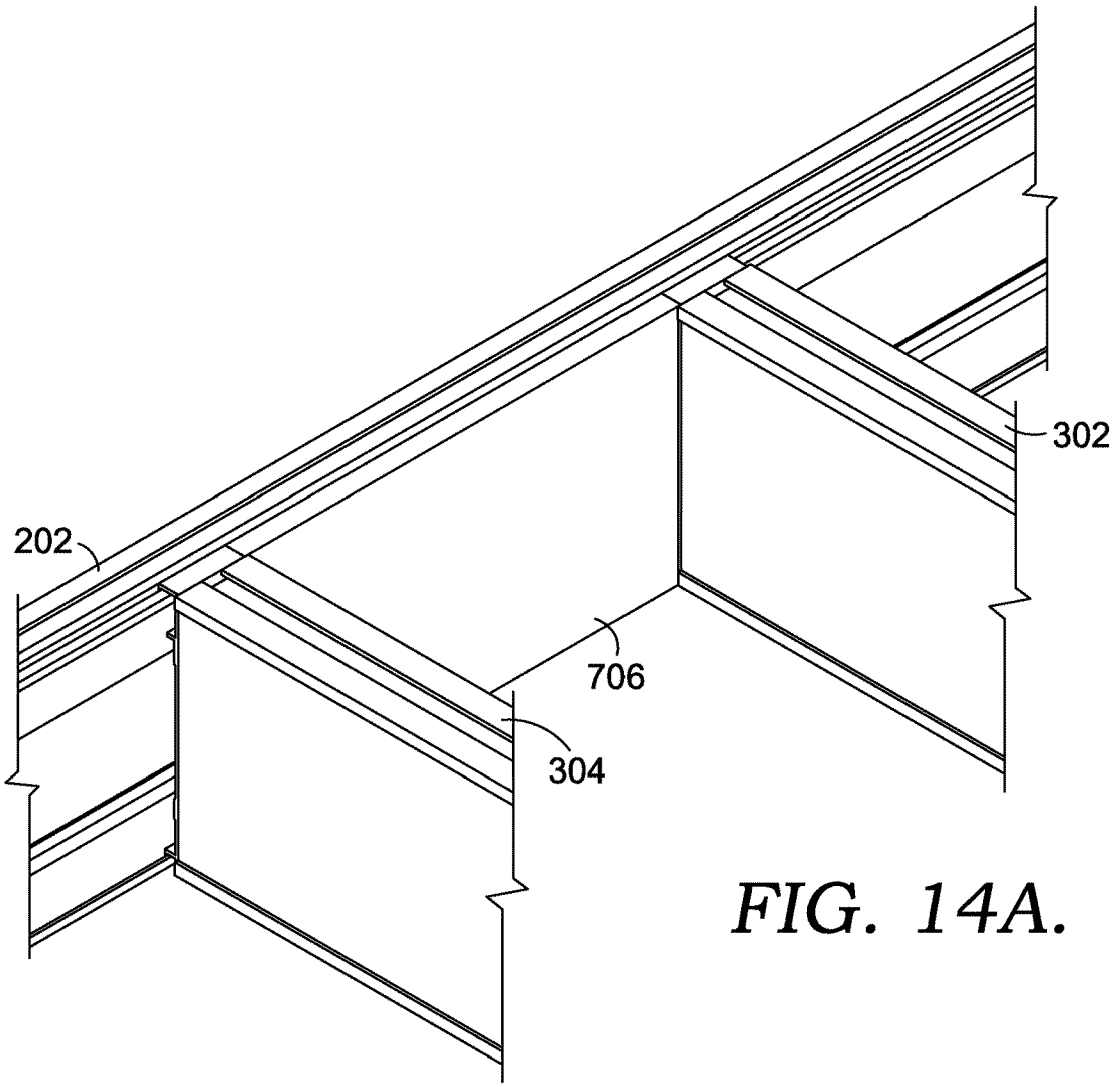
FIG. 14A depicts a spacing member positioned between two inner frame members, where the two inner frame members and the spacing member are coupled to a perimeter frame member, in accordance with aspects hereof.

FIGS. 14A and 14B depict inner frame members 302 and 304 coupled to the perimeter frame member 202. In various aspects, the inner frame members 302 and 304 can be coupled to the perimeter frame member 202 as discussed above with respect to FIGS. 6A, 6B, 7, 8, 13A, and 13B. In the aspect depicted in FIGS. 14A and 14B, a spacing member 706 is positioned between the inner frame members 302 and 304. In aspects, the spacing member 706 can be utilized to provide the desired spacing between the inner frame members 302 and 304, e.g., to meet code and/or load requirements. As best seen in FIG. 14B, the spacing member 706 is coupled to the perimeter frame member 202. In certain aspects, the spacing member 706 can be coupled to the perimeter frame member 202 in a manner similar to that of the inner frame member hanger and/or perimeter frame member hanger discussed in detail above. For instance, in aspects, a first tab 706*a* of the spacing member 706 can insert between the channel 202*f* and the engagement member 202*e* of the perimeter frame member 202. In the same or alternative aspects, a second tab 706*b* of the spacing member 706 can engage with the engagement member 202*d* of the perimeter frame member 202.

In various aspects, the systems disclosed herein can provide for a secure and/or properly aligned connection between perimeter frame members, inner frame members, or between a combination of inner frame members and perimeter frame members. In the example aspects described above, such connections and/or couplings depicted frame members connecting to one another at a substantially perpendicular orientation, e.g., about 90°. It should be understood that the present systems disclosed herein also contemplate connecting frame members at angles other than about 90°. For example, FIGS. 15A and 15B depict two perimeter frame members coupled to one another at an obtuse angle with respect to one another.

Figure 15B:
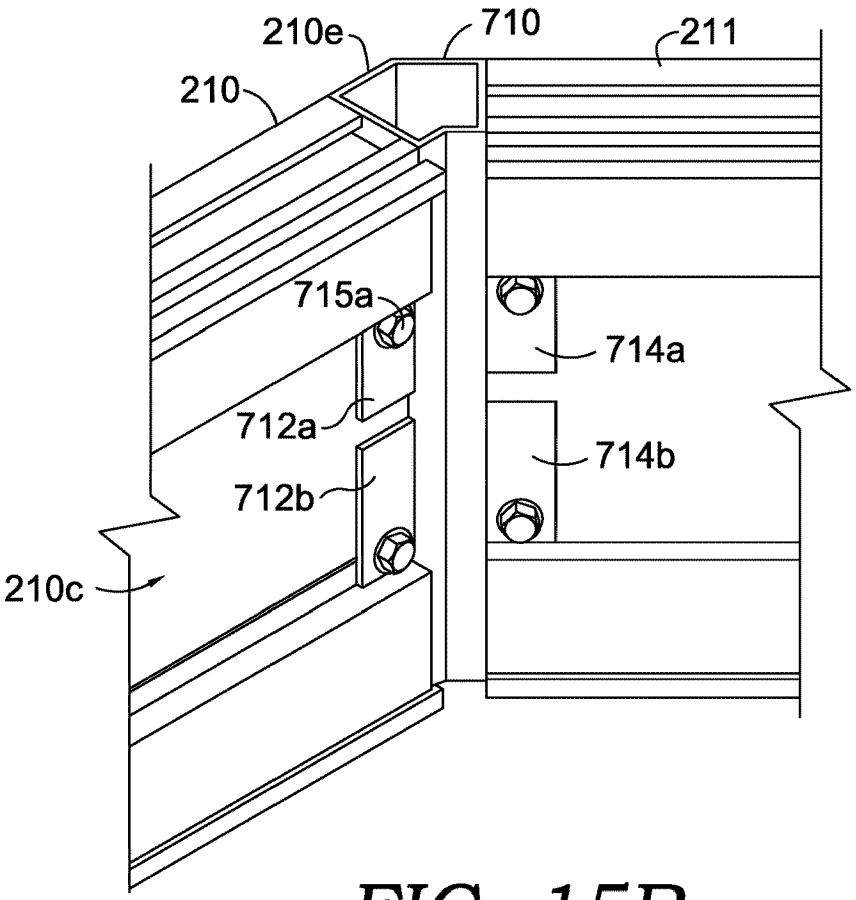
FIGS. 15A and 15B depict a first perimeter frame member coupled to a second perimeter frame member via an angle bracket; in accordance with aspects hereof.
Figure 15A:
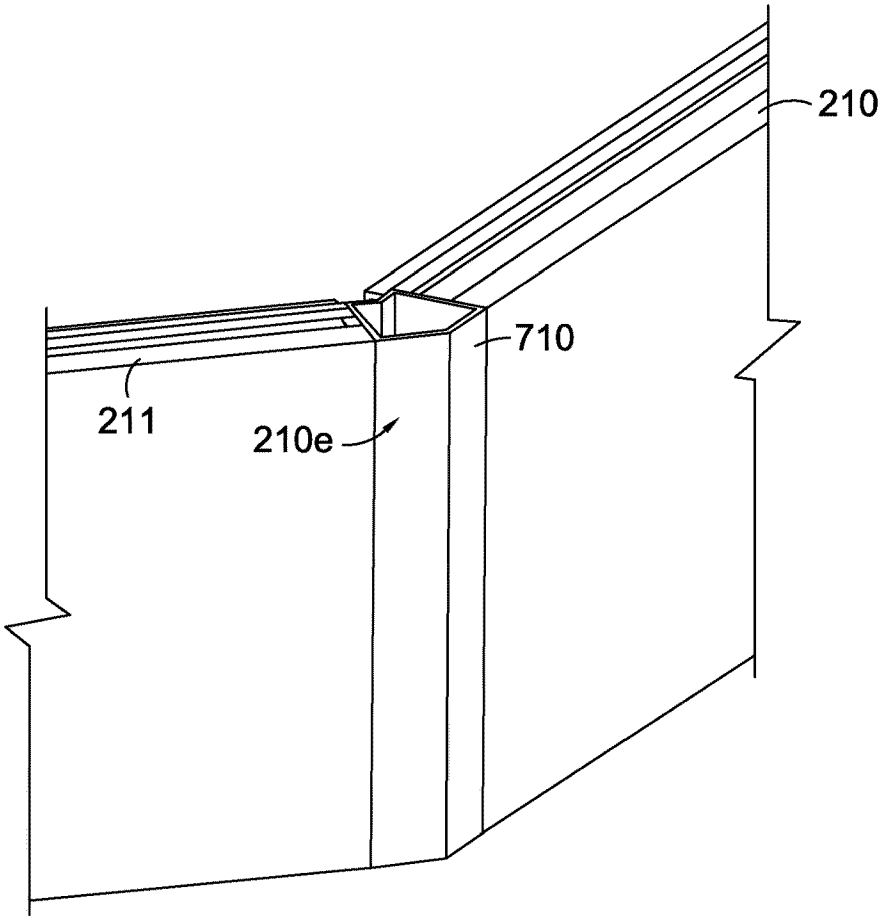
Figure 15F:
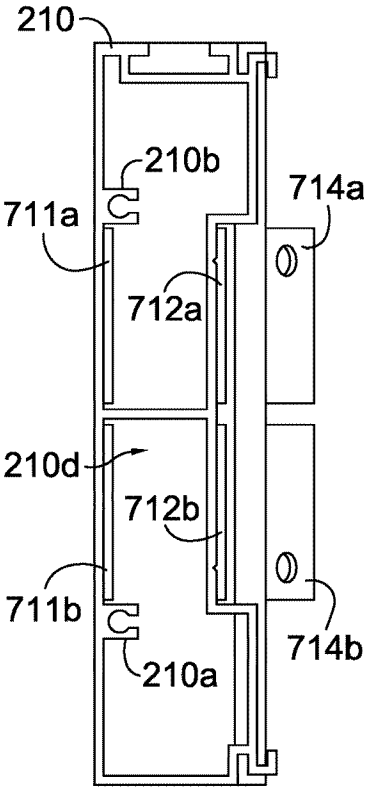
FIG. 15F depicts a side view of the example angle bracket of FIG. 15E; in accordance with aspects hereof.
Figure 15E:
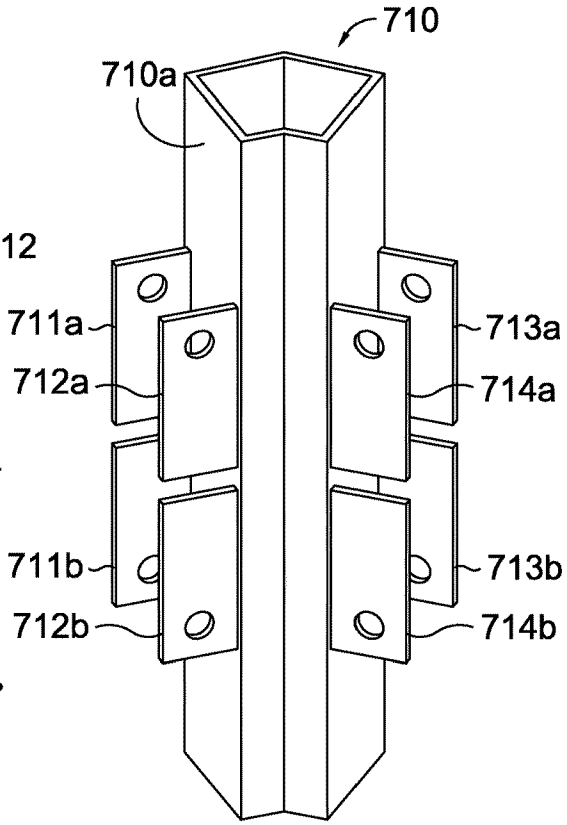
FIG. 15E depicts another example angle bracket of FIGS. 15A and 15B, in accordance with aspects hereof.

As best seen in FIG. 15A, a perimeter frame member 211 is coupled to perimeter frame member 210 at an angle A that is in the range of about 110° to about 150°, or about 135°. In the aspect depicted in FIGS. 15A and 15B, an angle bracket 710 couples together the perimeter frame members 210 and 211: The angle bracket 710 is depicted in FIG. 15C in isolation. As can be seen in the aspect depicted in FIG. 15C, the angle bracket 710 includes bracket extensions 711, 712, 713, and 714 that extend out from a main body 710*a*.

Figure 15D:
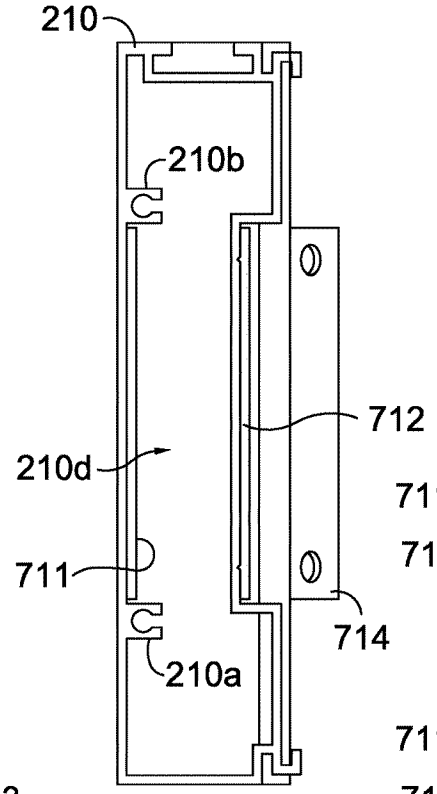
FIG. 15D depicts a side view of the first perimeter frame member of FIGS. 15A and 15B, with a first bracket extension of the angle bracket positioned in an interior portion of the first perimeter frame member and a second bracket extension of the angle bracket contacting a recessed portion of the first perimeter member; in accordance with aspects hereof.
Figure 15C:
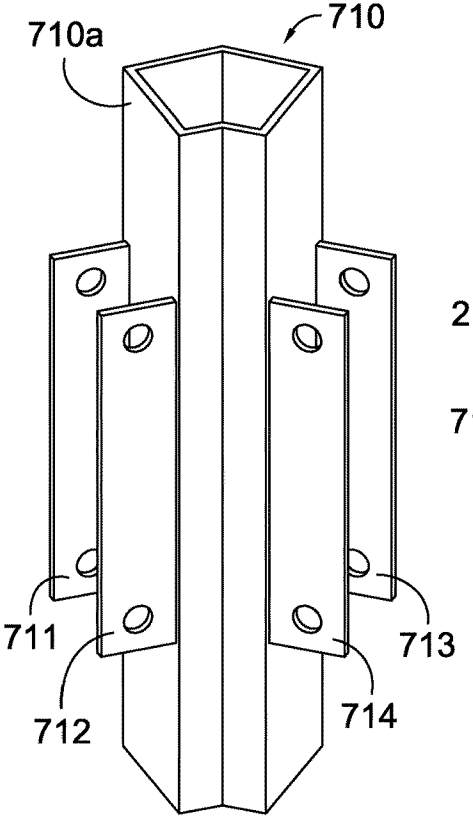
FIG. 15C depicts the example angle bracket of FIGS. 15A and 15B, in accordance with aspects hereof.

As best seen in the aspect depicted in FIGS. 15B and 15D, the bracket extension 711 is inserted into an end 210*e* of the perimeter frame member 210 into a void 210*d*, where the bracket extension 711 is sized to fit between the screw chases 210*b* and 210*a*. In the same or alternative aspects, the bracket extension 712 is inserted into the recessed portion 210*c* of the perimeter frame member 210. In various aspects, the bracket extensions 713 and 714 can interact with the perimeter frame member 211 in a similar manner to that described herein for the bracket extensions 711 and 712. In various aspects, the bracket extensions 712 and 714 can be secured to the respective perimeter frame members 210 and 211 using one or more fasteners, e.g., the fastener 715*a*.

FIGS. 15E and 15F depict another aspect of an angle bracket. For example, angle bracket 710 can include sectioned bracket extensions, such as bracket extension section 711*a* and bracket extension section 711*b*, bracket extension section 712*a* and bracket extension section 712*b*, bracket extension section 713*a* and bracket extension section 713*b*, and bracket extension section 714*a* and bracket extension section 714*b*. Each pair of bracket extension sections (e.g., bracket extension section 711*a* and 711*b*) is separated by a gap that is positioned to cooperatively align with the internal support member of the inner frame member 210. Accordingly, and similar to the discussion above, the pair of bracket extensions 711*a* and 711*b* are inserted into an end 210*e* of the perimeter frame member 210 into a void 210*d*, where the pair of bracket extensions 711*a* and 711*b* are sized to fit between the screw chases 210*b*, 210*a* and the internal support member.

Figure 19B:
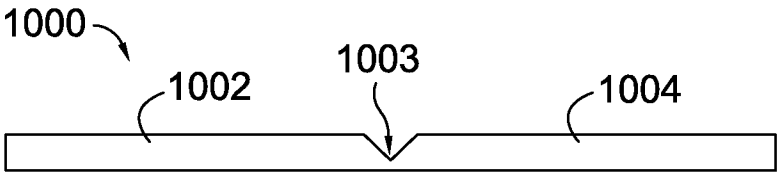
FIG. 19B depicts a side view of the angle bracket of FIG. 19A, in accordance with aspects hereof.
Figure 19A:
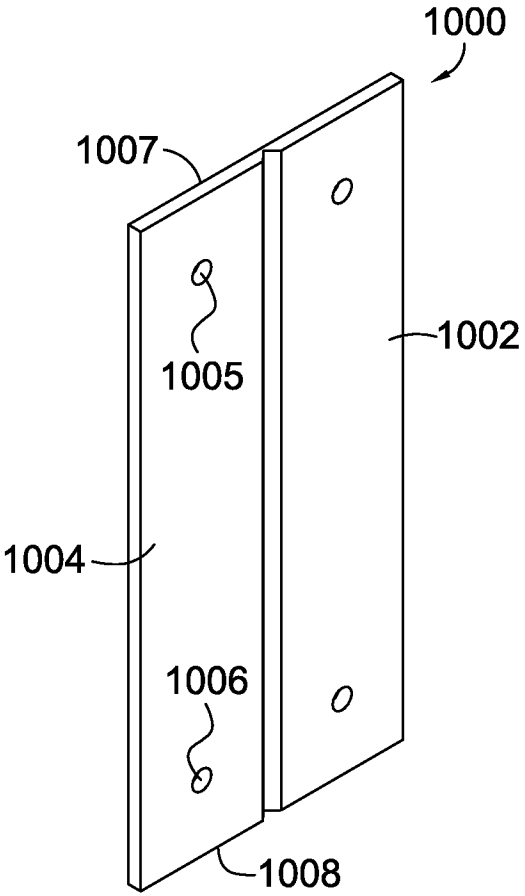
FIG. 19A depicts a top and side perspective view of another example angle bracket, in accordance with aspects hereof.

FIGS. 19A and 19B depict another example of an angle bracket, the angle bracket 1000. The angle bracket 1000 can be an adjustable bracket, e.g., the angle bracket 1000 can adjust from about 180° to about 100°, or from about 180° to about 90°. Stated differently, the angle bracket 1000 can couple together two frame members that are oriented at an angle of about 180° to about 100° or about 90° relative to one another. In the aspect depicted in FIGS. 19A and 19B, the angle bracket 1000 can include two portions 1002 and 1004 that can be manually shifted to a desired angle, in an aspect. Each portion 1002 and 1004 can include apertures, e.g., apertures 1005 and 1006 for one or more fasteners, which may be used to secure the angle bracket 1000 to one or more frame members. In certain aspects, the angle bracket 1000 can be sized to engage with one or more structural features of a frame member. For instance, in one aspect, the top edge 1007 can engage an engagement member of a perimeter frame member and/or a ridge of an inner frame member, similar to that described above with respect to the L-bracket 609 of FIG. 11. In the same or alternative aspects, the bottom edge 1008 can engage an engagement member of a perimeter frame member and/or a ridge of an inner frame member, similar to that described above with respect to the L-bracket 609 of FIG. 11.

As best seen in the aspect depicted in FIG. 19B, the angle bracket 1000 can include a V-groove 1003 with a living hinge at the base of the V-groove 1003. In certain aspects, in use, the angle bracket 1000 can be folded, e.g., to an angle less than 180° and the material of the angle bracket 1000 will cause a slight recovery and open up the angle a slight amount. For instance, the angle bracket can be opened up to an angle of about 95° and the angle bracket 1000 will then slightly recover to an angle greater than 95°, e.g., 105°.

In certain aspects, the angle of the V-groove 1003 can prevent the angle bracket 1000 from bending or folding past a certain amount, e.g., to an angle less than 90° (an acute angle). Such a fold stop feature can facilitate not over extending the living hinge of the angle bracket 1000 to an angle that may weaken the angle bracket 1000, e.g., an angle less than 90°, in aspects.

Figure 5A:
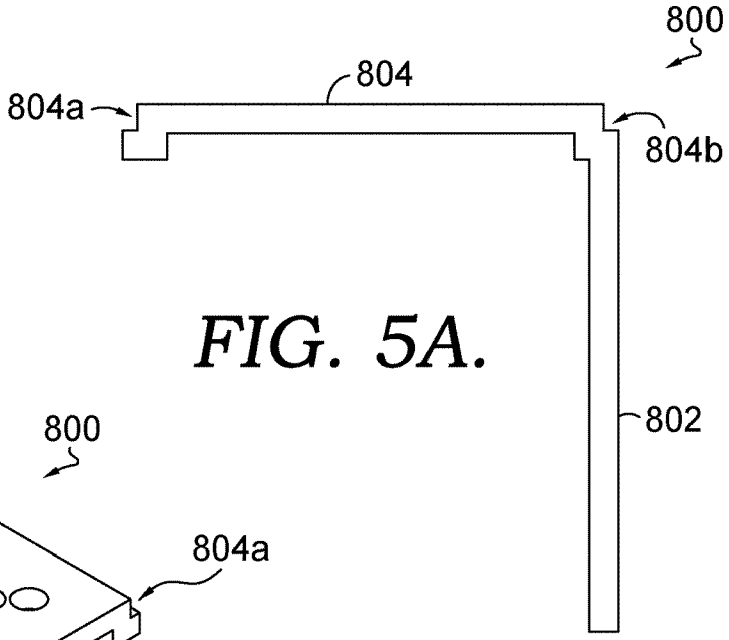
FIGS. 5A-5B depict an L-post bracket, in accordance with aspects hereof.
Figure 5B:
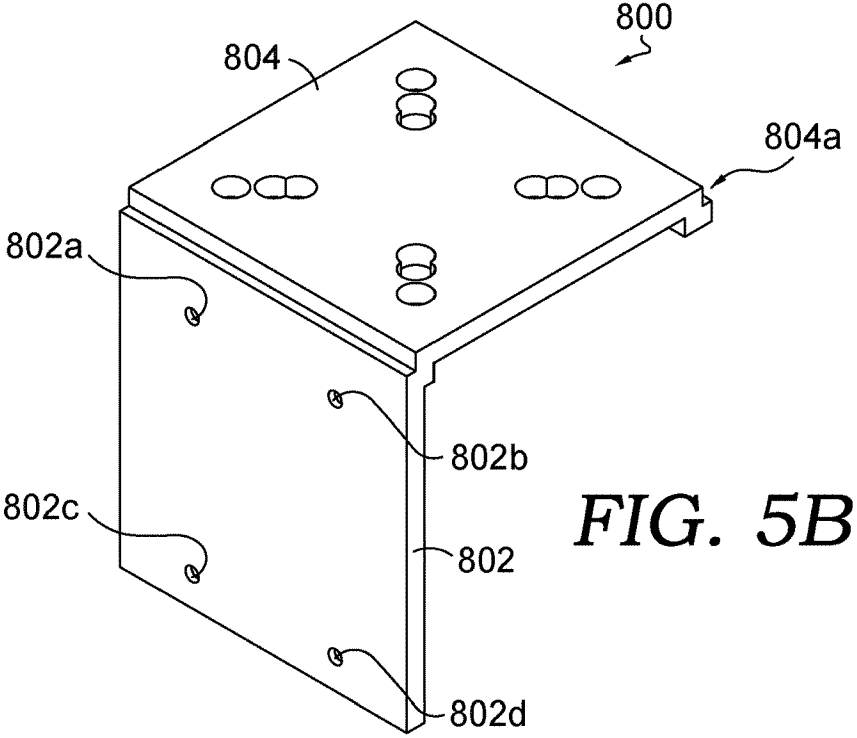

FIGS. 16A-17B depict various examples of securing an L-post bracket to one or more frame members. In various aspects, the L-post brackets disclosed herein can be secured to one or more frame members and are designed to be utilized as an anchor point to hold one or more railing posts. An example L-post bracket 800 is depicted in FIGS. 5A and 5B. It should be understood that the L-post bracket depicted in FIGS. 5A and 5B is just one example for such a bracket and/or anchor point and that other designs and/or configurations are also contemplated by the present disclosure. The L-post bracket 800 depicted in FIGS. 5A and 5B includes a frame securing portion 802 and a railing securing portion 804. In various aspects, the frame securing portion 802 can include apertures for one or more fasteners, e.g., apertures 802*a*, 802*b*, 802*c*, and 802*d*, to secure the L-post bracket 800 to one or more frame members, e.g., an inner frame member and/or a perimeter frame member. In certain aspects, the railing securing portion 804 can include a plurality of apertures for securing various sizes, styles, and/or types of railings thereto. That is, in certain aspects, the railing securing portion 804 can include a series of pre-formed apertures that allow one L-post bracket, e.g., the L-post bracket 800, to be used with a variety of differently-sized railings. In certain aspects, the L-post bracket 800 can include one or more notches, e.g., 804*a* and/or 804*b*, which may engage one or more engagement members of a perimeter frame member and/or one or more ridges of an inner frame member, as discussed further below.

Figure 16A:
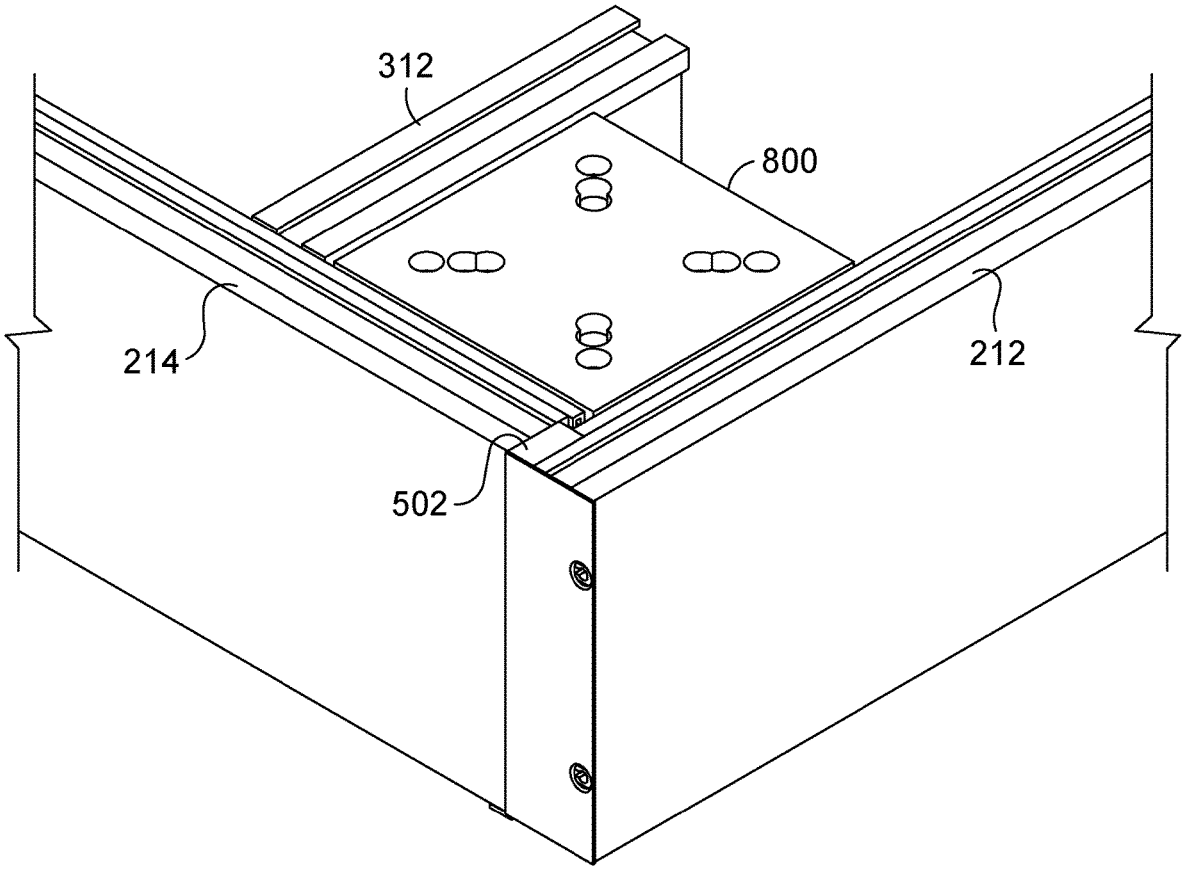
FIG. 16A depicts a first perimeter frame member coupled to a second perimeter frame member, an inner frame member coupled to the second perimeter frame member, and an L-post bracket positioned between the first perimeter frame member and the inner frame member, in accordance with aspects hereof.
Figure 16B:
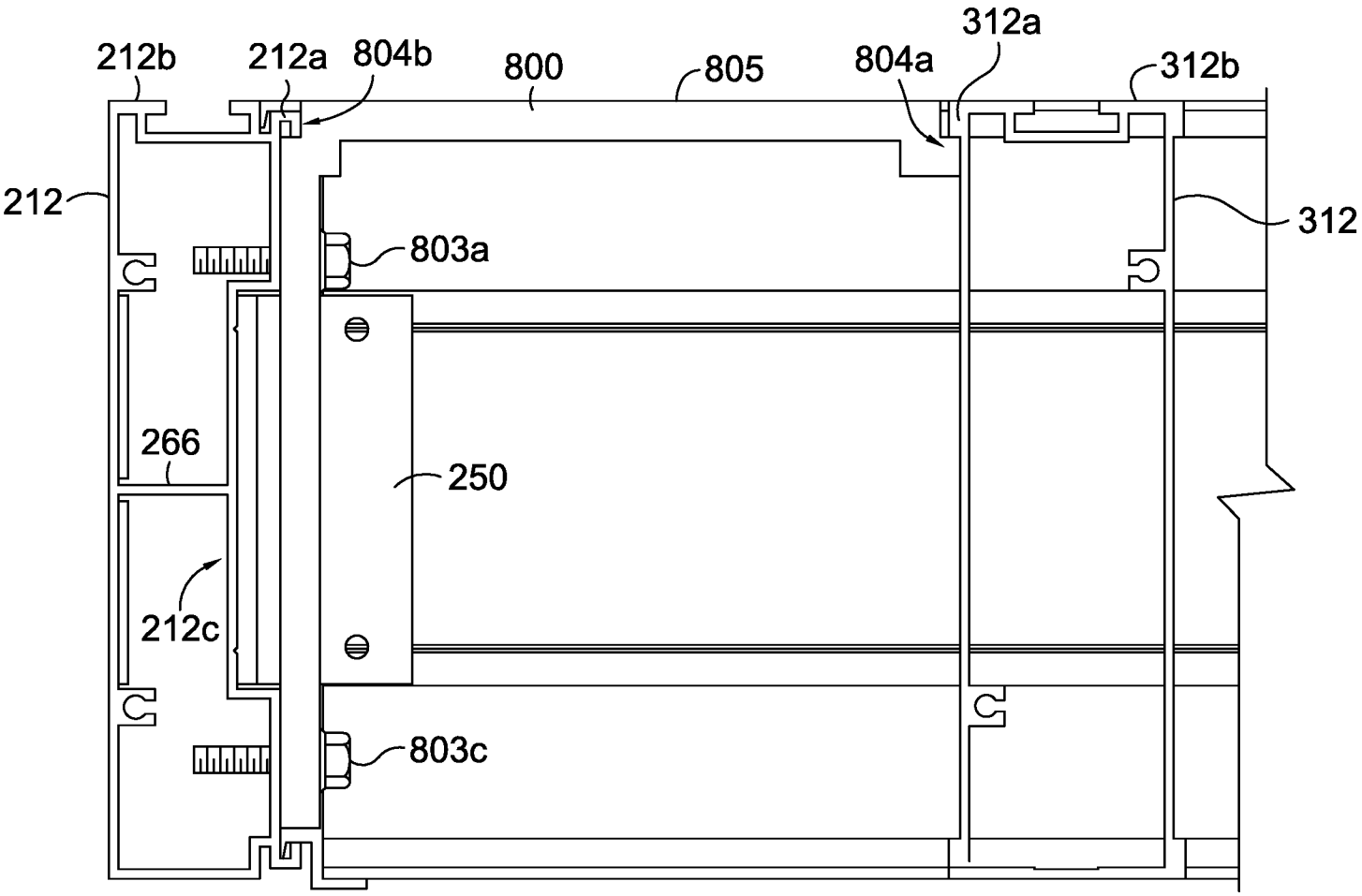
FIG. 16B depicts a side view of first perimeter frame member, second perimeter frame member, and L-post bracket of FIG. 16A, showing the L-post bracket coupled to the first perimeter frame member with fasteners, and an L-bracket positioned within a recessed portion of the first perimeter frame member and the second perimeter frame member, in accordance with aspects hereof.
Figure 16C:
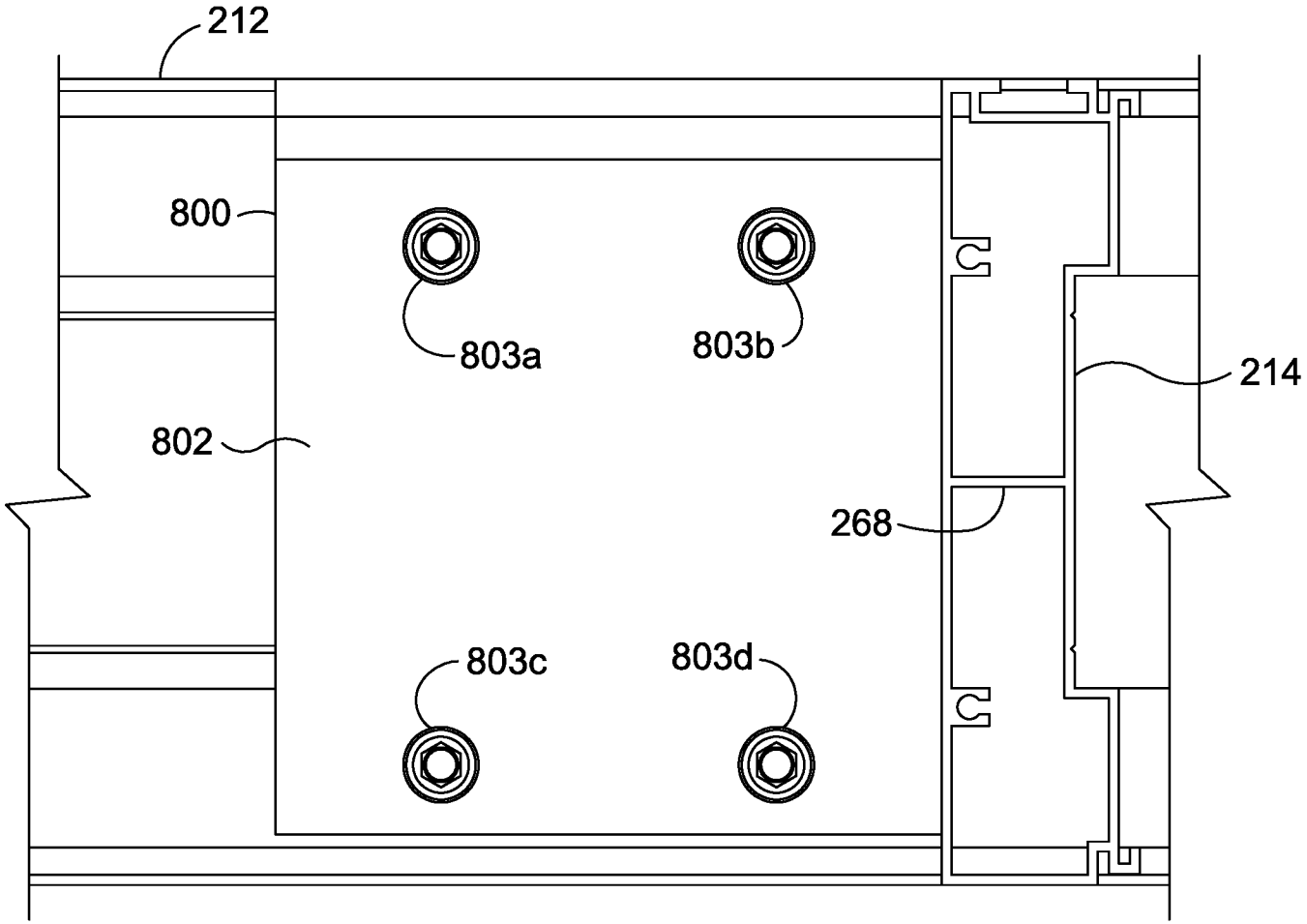
FIG. 16C depicts another side view of first perimeter frame member, second perimeter frame member, and L-post bracket of FIG. 16A, showing the L-post bracket coupled to the first perimeter frame member with fasteners, in accordance with aspects hereof.

FIGS. 16A-16C depict one example of an L-post bracket 800 coupled to a perimeter frame member 212. As best seen in the aspect depicted in FIGS. 16B and 16C, the L-post bracket 800 is secured to the perimeter frame member 212 using fasteners 803*a*, 803*b*, 803*c*, and 803*d*. In various aspects, as discussed above, the L-post bracket 800 can engage one or more structural features of the frame members to provide increased structural integrity. For instance, as best seen in the aspect depicted in FIG. 16B, a notch 804*a* of the L-post bracket 800 can engage with a ridge 312*a* of the inner frame member 312 such that the notch 804*a* and ridge 312*a* are at least partly complementary in shape and can provide a substantially flat and/or flush outer surface extending along the upper surface 805 of the L-post bracket 800 and the outer surface 312*b* of the inner frame member 312. In certain aspects, the notch 804*b* can engage with an engagement member 212*a* of the perimeter frame member 212 such that the notch 804*b* and the engagement member 212*a* are at least partly complementary in shape and can provide a substantially flat and/or flush outer surface extending along the upper surface 805 of the L-post bracket 800 and the outer surface 212*b* of the perimeter frame member 212.

In various aspects, the perimeter frame member 212 includes at least one internal support member 266 in some aspects. Internal support member 266 extends internally between recessed portion 212*c* and the opposing second side 224. In some aspects, the internal support member 266 extends perpendicularly from both recessed portion 212*c* and the opposing second side. Internal support member 266 can extend internally along the length of the example perimeter frame member 212.

In various aspects, the recessed portion 212*c* of the perimeter frame member 212 provides space between the L-post bracket 800 and the perimeter frame member 212 to allow for an L-bracket 250 to be secured to the perimeter frame members 212 and 214. While not depicted in FIG. 16B, one or more fasteners can also be utilized to secure the L-bracket 250, and not interfere with the position of the L-post bracket 800. In various aspects, the L-bracket 250 can be secured to the perimeter frame members 212 and 214 as described above with respect to FIG. 3A. Further, as best seen in the aspect depicted in FIG. 16A, a perimeter frame member hanger 502 can be utilized to couple together the perimeter frame members 212 and 214, in a manner similar to that described above with respect to FIGS. 3A-3D.

Similar to perimeter frame member 212, perimeter frame member 214 includes at least one internal support member 268 in some aspects. Internal support member 268 extends internally between recessed portion of perimeter frame member 214 and the opposing second side. In some aspects, the internal Support member 268 extends perpendicularly from both recessed portion and the opposing second side. Internal support member 268 can extend internally along the length of the example perimeter frame member 214.

Figure 17A:
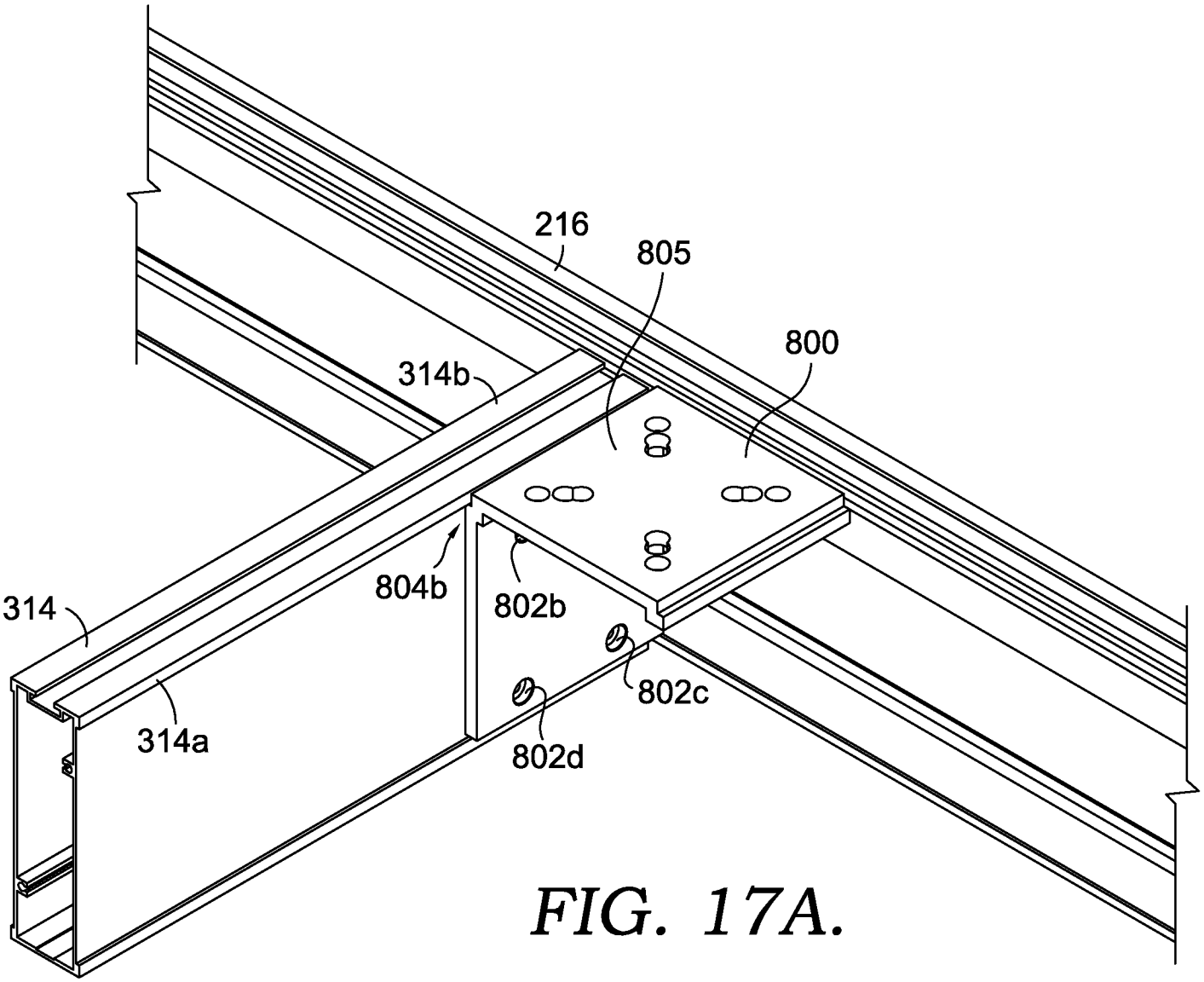
FIG. 17A depicts an L-post bracket coupled to an inner frame member on a first side, with the inner frame member coupled to a perimeter frame member, in accordance with aspects hereof.
Figure 17B:
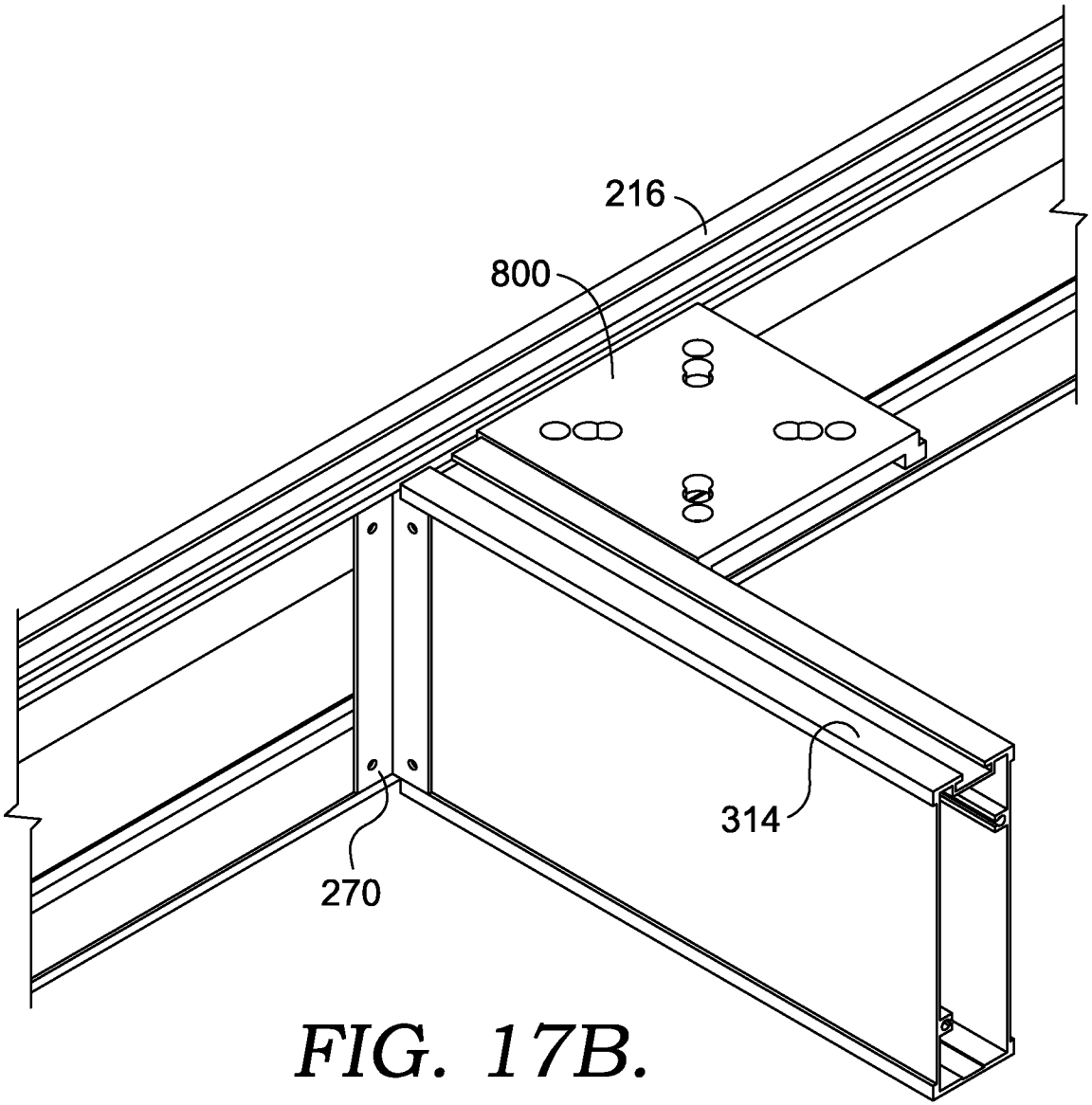
FIG. 17B depicts an L-bracket coupled to the inner frame member of FIG. 17A on a second side, in accordance with aspects hereof.

FIGS. 17A and 17B depict example of an L-post bracket 800 coupled to an inner frame member 314. As best seen in FIG. 17A, the L-post bracket 800 can be secured to the inner frame member 314 using one or more fasteners extending through one or more apertures in the L-post bracket 800, e.g., the apertures 8026, 802*c*, and 802*d*. In certain aspects, as discussed above, a notch 804*b* of the L-post bracket 800 can engage with a ridge 314*a* of the inner frame member 314 to provide a substantially flat and/or flush outer surface extending along the upper surface 805 of the L-post bracket 800 and the outer surface 314*b* of the inner frame member 314. As best seen in the aspect depicted in FIG. 17B, an L-bracket 270 can be utilized to secure the inner frame member 314 to the perimeter frame member 216, in a manner similar to that described above with respect to FIG. 11.

In various aspects, the framing systems and decking systems described herein can be used in any suitable environment. In certain aspects, a lower profile framing system and/or decking system may be desired, e.g., when there may be height restrictions. FIGS. 20A-24B depict various low-profile components that be utilized in certain environments where a low profile decking system and/or framing system is desired.

Figure 20A:
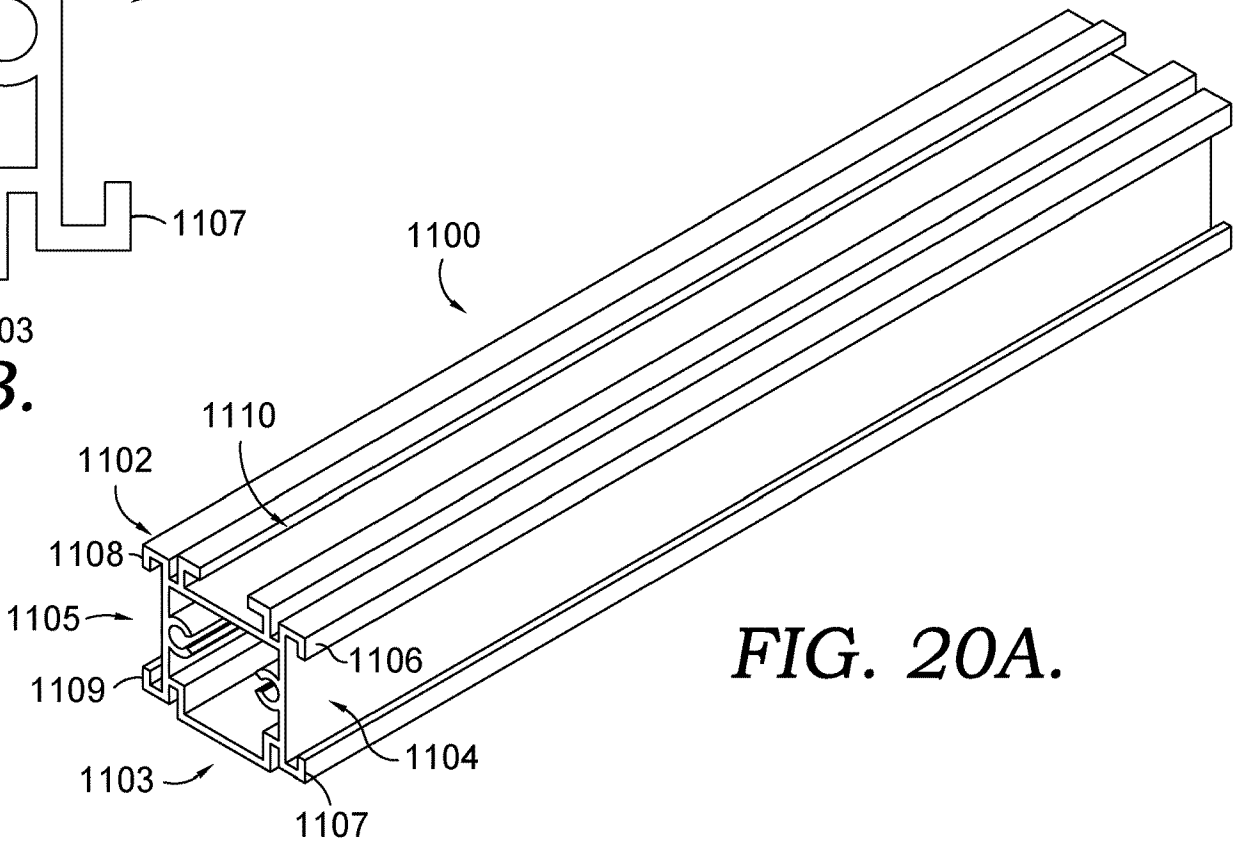
FIG. 20A depicts a top and side perspective view of another example perimeter frame member, in accordance with aspects hereof.
Figure 20B:
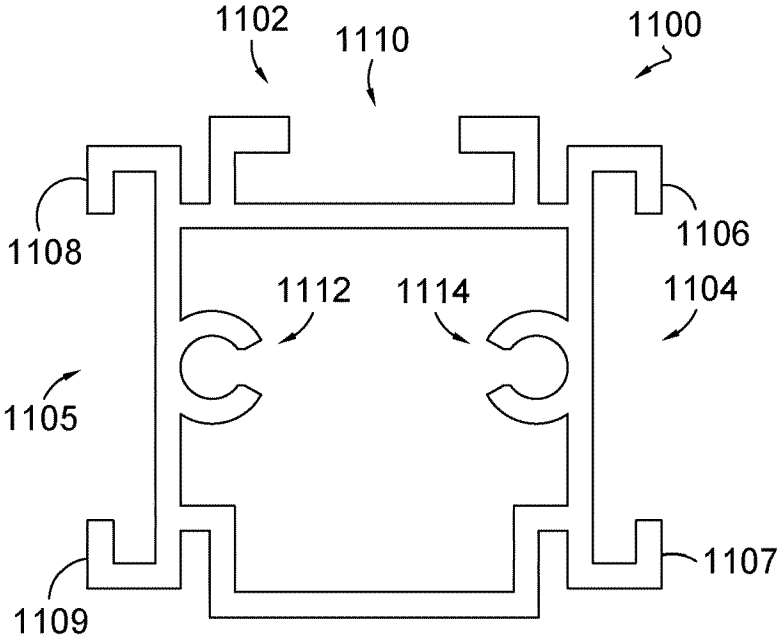
FIG. 20B depicts a side view of the perimeter frame member of FIG. 20A.

FIGS. 20A and 20B depict an example perimeter frame member 1100 having a low profile. In certain aspects, the perimeter frame member 1100 can have a height extending between a first vertical end 1102 and a second vertical end 1103 that is about 1 inch or more, about 1.25 inches or more, about 1.5 inches or more, or about 1.75 inches. In the same or alternative aspects, the perimeter frame member 1100 can have a width extending between the first side 1104 and the second side 1105 of about 1 inch or more, about 1.25 inches or more, about 1.5 inches or more, about 1.75 inches or more, or about 2 inches.

In various aspects, the perimeter frame member 1100 can include engagement members 1106, 1107, 1108, and 1109. The engagement members 1106, 1107, 1108, and 1109 can function similarly to the engagement members described herein, e.g., the engagement members 228 and 229, in aspects. In certain aspects, the perimeter frame member 1100 can include a channel 1110. In aspects, the channel 1110 can function similarly to the channel 240 described herein. In certain aspects, the perimeter frame member 1100 can include alignment notches 1112 and alignment notches 1114. Alignment notches 1112 and 1114 can be positioned on the inner portions of the first side 1104 and the second side 1105, which may facilitate interaction with various components described herein and/or function as a mark for identifying a desired location for using one or more fasteners.

Figure 21B:
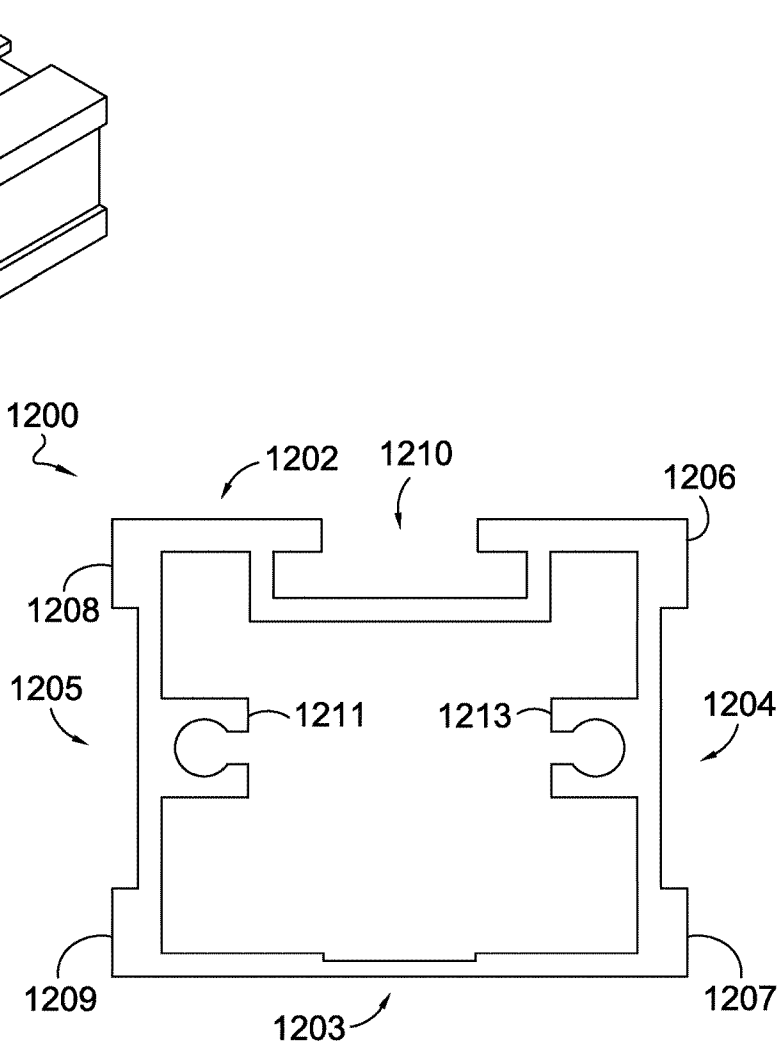
FIG. 21B depicts a side view of the inner frame member of FIG. 21A.
Figure 21A:
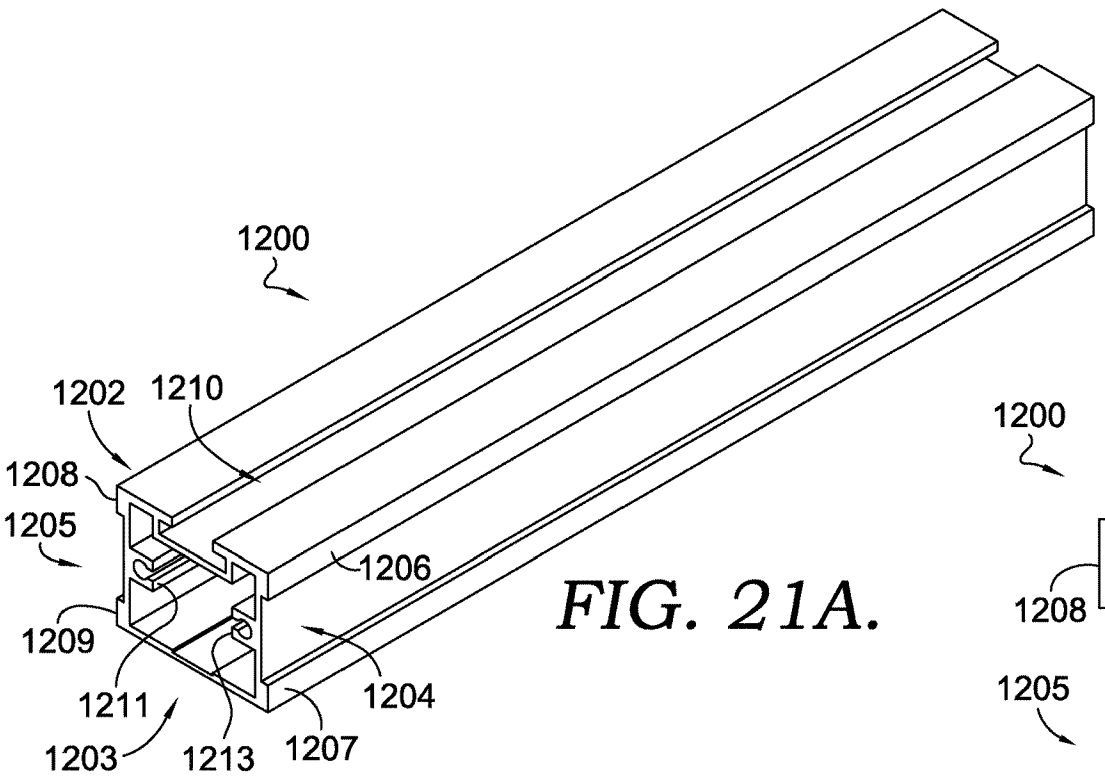
FIG. 21A depicts a top and side perspective view of another example inner frame member, in accordance with aspects hereof.

FIGS. 21A and 21B depict an example inner frame member 1200 having a low profile. In certain aspects, the inner frame member 1200 can have a height extending between a first vertical end 1202 and a second vertical end 1203 that is about 1 inch or more, about 1.25 inches or more, about 1.5 inches or more, or about 1.75 inches. In the same or alternative aspects, the inner frame member 1200 can have a width extending between the first side 1204 and the second side 1205 of about 1.25 inches or more, about 1.5 inches or more, about 1.75 inches or more, about 2 inches or more, or about 2.2 inches.

In various aspects, the inner frame member 1200 can include ridges 1206, 1207, 1208, and 1209. The ridges 1206, 1207, 1208, and 1209 can function similarly to the ridges described herein, e.g., the ridges 328, 329, 330, and 331, in aspects. In certain aspects, the inner frame member 1200 can include a channel 1210. In aspects, the channel 1210 can function similarly to the channel 350 described herein. In various aspect, the inner frame member 1200 can include one or more screw chases, e.g., screw chases 1211 and 1213. In such aspects, the screw chases 1211 and 1213 can include functionality similar to that described herein for the screw chases 342 and 344, for example.

Figure 22C:
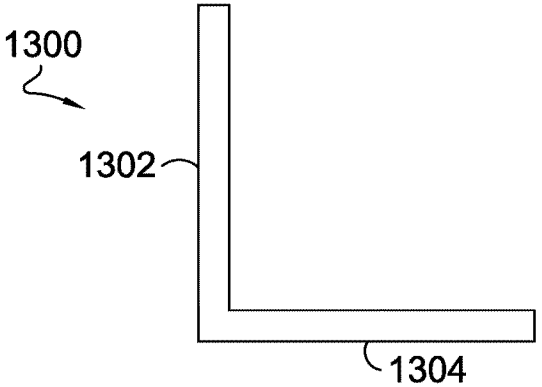
FIGS. 22A-22C depict another example L-bracket, in accordance with aspects hereof.
Figure 22B:
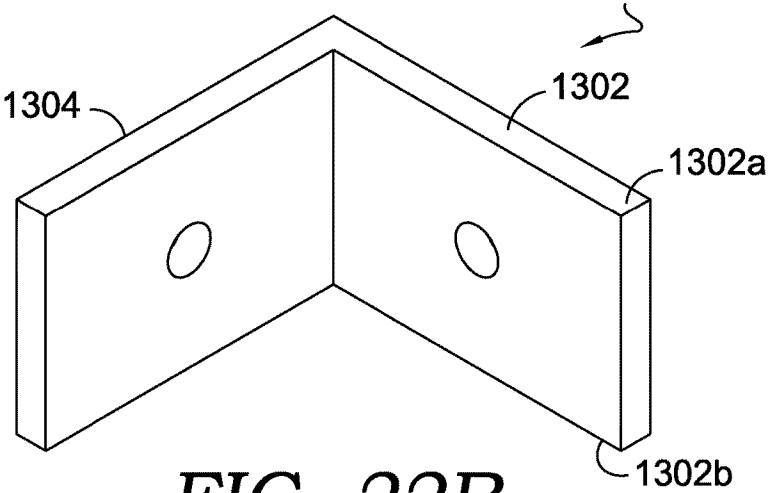
Figure 22A:
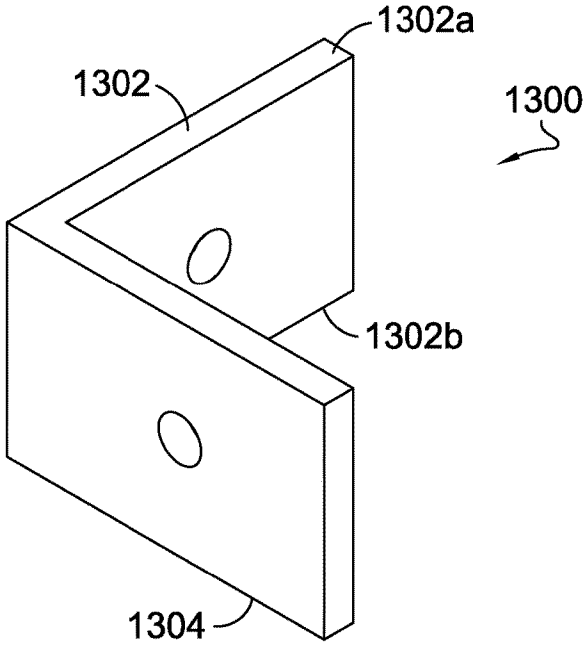

FIGS. 22A and 22B depict an example L-bracket 1300 for coupling together: one or more perimeter frame members, e.g., two perimeter frame members 1100; one or more inner frame members, e.g., two inner frame members 1200; and/or an inner frame member 1200 to a perimeter frame member 1100. In various aspects, the L-bracket 1300 can include a first portion 1302 and a second portion 1304. In certain aspects, the first portion 1302 and the second portion 1304 can be oriented at an angle of about 90° relative to one another.

In certain aspects, the L-bracket 1300 can be sized to engage with one or more structural features of the low-profile frame members described herein. For instance, in one aspect, a top surface 1302*a* of the first portion 1302 can engage with a ridge, e.g., ridge 1206 or 1208 of the inner frame member 1200, and/or can engage with an engagement member, e.g., engagement member 1106 and 1108 of the perimeter frame member 1100, in a manner similar to the L-bracket 604 engaging with the inner per meter member 302 and the perimeter frame member 202 described above with reference to FIG. 6A. In the same or alternative aspects, a bottom surface 1302*b* can engage with a ridge, e.g., ridge 1207 or 1209 of the inner frame member 1200, and/or can engage with an engagement member, e.g., engagement member 1107 and 1109 of the perimeter frame member 1100, in a manner similar to the L-bracket 604 engaging with the inner perimeter member 302 and the perimeter frame member 202 described above with reference to FIG. 6A.

Figure 23C:
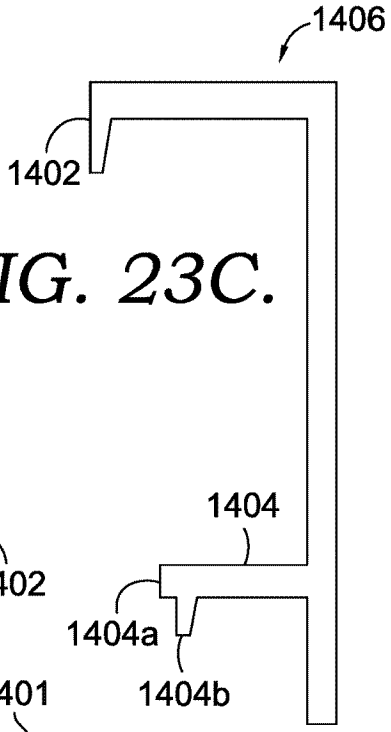
FIGS. 23A-23C depict another example inner frame member hanger, in accordance with aspects hereof.
Figure 23B:
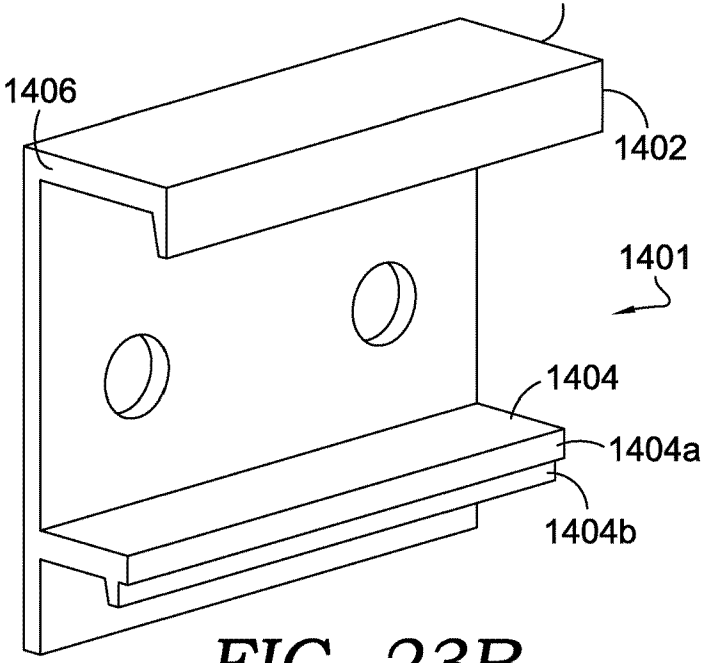
Figure 23A:
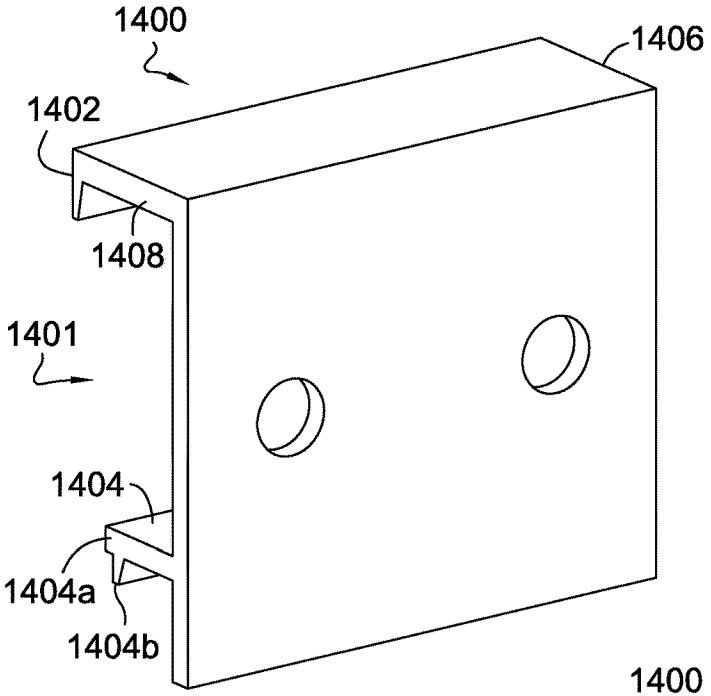

FIGS. 23A, 23B, and 23C depict an inner frame member hanger 1400 that is sized for use with low profile framing members, such as with the perimeter frame member 1100 and/or the inner frame member 1200. In certain aspects, the inner frame member hanger 1400 can function similarly to the inner frame member hanger 602 and/or 611 described above, for example. For instance, in one aspect, the inner frame member hanger 1400 can be utilized to couple together an inner frame member, e.g., the inner frame member 1200, to a perimeter frame member, e.g., the perimeter frame member 1100. In one aspect, the inner frame member hanger 1400 can be coupled to an inner frame member lateral end using one or more fasteners, which may engage with one or more of the screw chases 1211 and 1213. The inner frame member hanger 1400 can include a first tab 1402 and a second tab 1404 extending out from a first side 1401, and the tabs 1402 and 1404 can extend from a first lateral end 1406 to a second lateral end 1408. In aspects, when in an assembled configuration, the first tab 1402 can insert between the channel 1110 and one of the engagement members 1106 and 1108 of the perimeter frame member 1100. In the same or alternative aspects, the second tab 1404 can engage with one of the engagement members 1109 and 1107 of the perimeter frame member 1100. For example, the engagement ridge 1404*b* is configured to engage engagement members 1107 or 1109. Additionally, some aspects of inner frame member hanger 1400 includes spacing ridge 1404*a*. The spacing ridge 1404*a* is positioned proximate to the surface of first side 1104 or second side 1105 while the spacing ridge 1404*a* engages the engagement member 1107 or 1109 respectively.

Figure 24A:
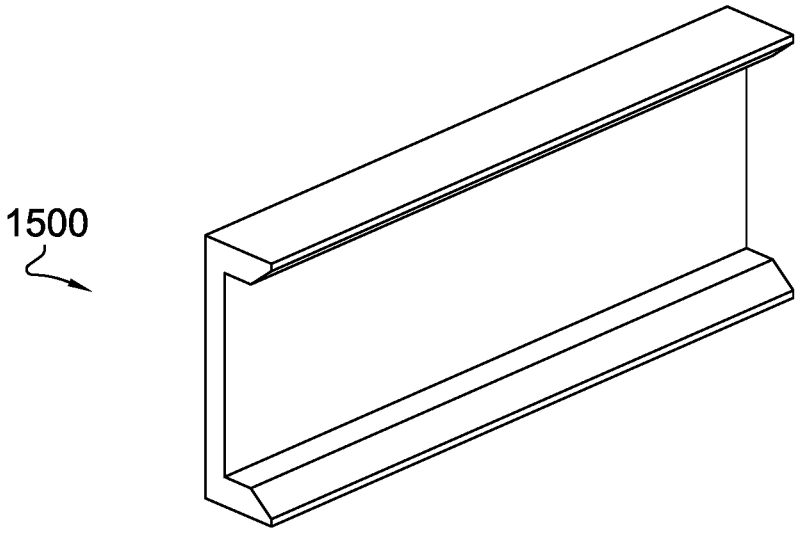
FIGS. 24A and 24B depict another example of an uplift clip, in accordance with aspects hereof.
Figure 24B:
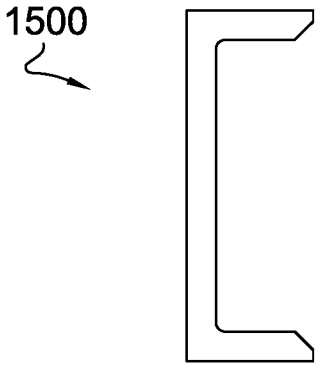

FIGS. 24A and 24B depict an uplift clip 1500. In various aspects, the uplift clip can function similar to the uplift clip 702 described herein with respect to FIGS. 13A and 13B. In one aspect, the uplift clip 1500 can be inserted between one frame member coupled to another frame member, e.g., via a hanger. For instance, the uplift clip 1500 can be positioned between the first tab 1402 and the second tab 1404 of the inner frame member hanger 1400 and between the perimeter frame member 1100, similar to that described above with respect to the uplift clip 702 in FIGS. 13A and 13B. As described above, the uplift clip, e.g., the uplift clip 1500 can prevent and/or restrict upward movement of the inner frame member and/or inner frame member hanger relative to the perimeter frame member.

Figure 25B:
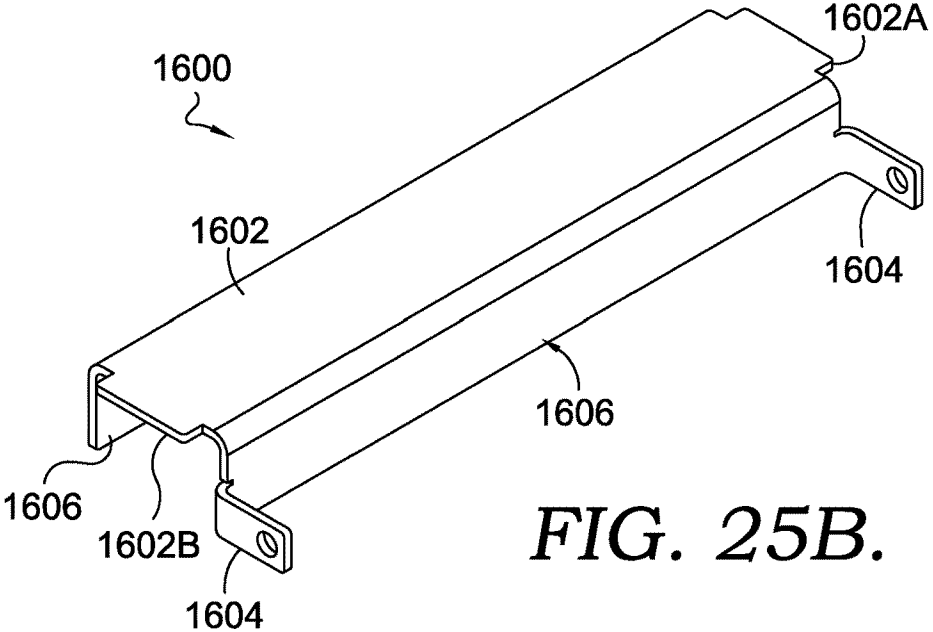
FIGS. 25A and 25B depict a selected portion of an example flat blocked frame structure, in accordance with aspects hereof.
Figure 25A:
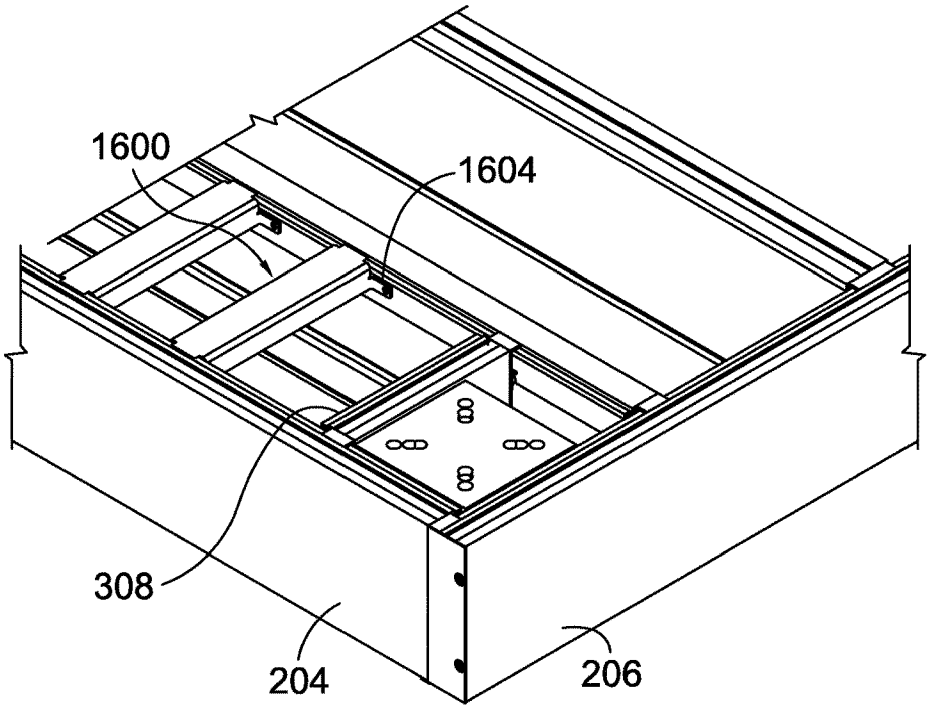

FIG. 25A depicts an enlargement of a selected portion of an example flat blocked portion of a frame structure for a decking system. As depicted, the enlarged portion includes perimeter frame members 204 and 206, inner frame member (e.g., inner frame member 302), inner frame members 308, and a plurality of blocking members 1600. As best depicted in FIG. 25B, blocking member 1600 is a C-shaped, n-shaped, and/or U-shaped member that includes an upper surface 1602 and a pair of side surfaces 1606. Upper surface 1602 includes engagement flange 1602*a* and engagement flange 1602*b* that extend from the blocking member 1600. Additionally, at least one of the side surfaces 1606 includes a locking flange 1604.

As best seen in FIGS. 25A and 25B, the blocking member 1600 spans the gap between the perimeter frame member 204 and the inner frame member. In particular, engagement flange 1602*b* is positioned to provide a substantially flat and/or flush upper surface with the outer surface (e.g., outer surface 220*a*) of the perimeter frame member. Similarly, engagement flange 1602*a* is positioned to provide a substantially flat and/or flush upper surface with the inner frame member. The locking flange 1604 may be configured such that it is positioned below an engagement member of the perimeter frame member and/or the inner frame member. The locking flange 1604 may include an aperture configured to allow a fastener to pass there through. Accordingly, the locking flange 1604 can prevent unintentional removal of the blocking member 1600 via placement of a fastener under the engagement member.

Figure 26A:
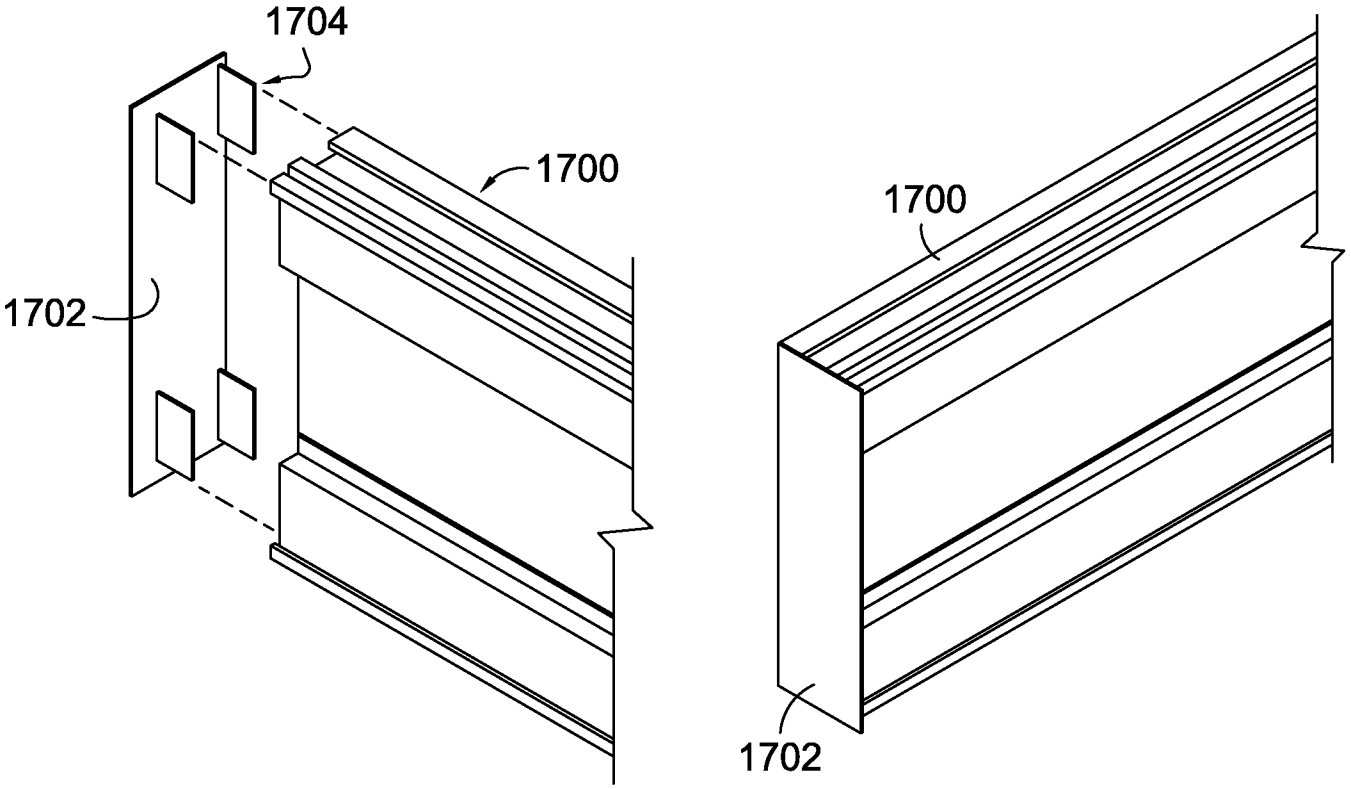
FIGS. 26A and 26B depict a perspective view of example caps for perimeter frame members and/or inner frame members, in accordance with aspects hereof.
Figure 26B:
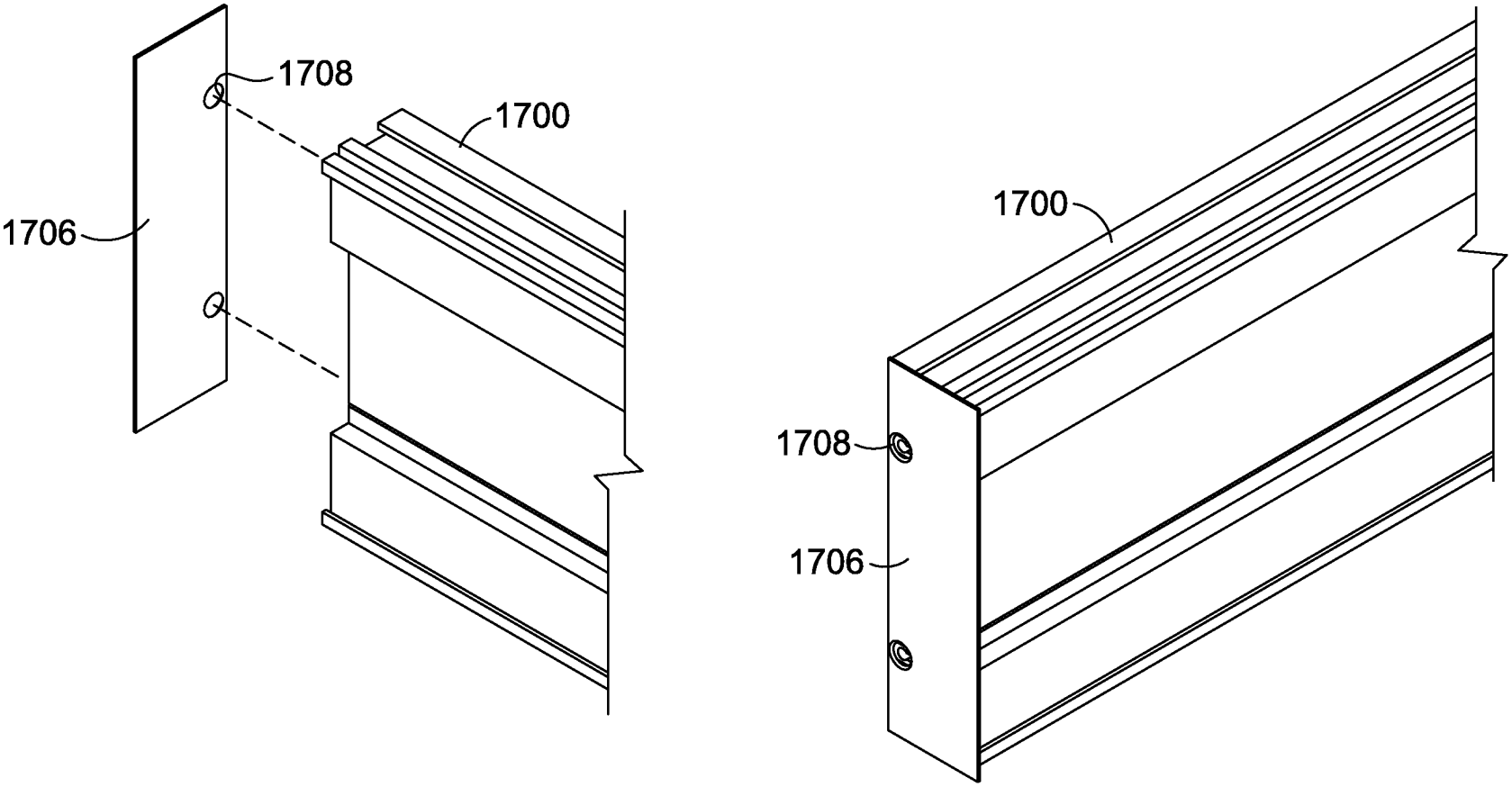

FIGS. 26A and 26B depict example caps for perimeter frame members and/or inner frame members. For example, with specific reference to FIG. 26A, an example cap 1702 is depicted. Cap 1702 includes a plurality of flanges 1704. The flanges are separated such that they are positioned to cooperatively align with the internal support member of the perimeter frame members and/or inner frame member 1700. The flanges 1704 are inserted into an end of the perimeter frame member and/or inner frame member 1700, where the flanges are sized to fit between the screw chases and die internal support member of the perimeter frame member and/or inner frame member 1700. While depicted with a profile to cap the end of an inner frame member, it is contemplated that the profile of example cap 1702 may be any shape suitable to cover the end of any inner frame member or perimeter frame member described herein.

Alternatively; and with specific reference to FIG. 26B, example cap 1706 is depicted. The example cap 1706 includes a pair of voids 1708 that cooperatively align with the internally positioned screw chases of the frame member 1700. The pair of voids 1708 are configured to allow the shaft of a fastener to pass there through. As depicted, the pair of voids 1708 may be vertically aligned, such as to facilitate cooperative alignment with screw chases 262 and 263 of example perimeter frame member 220. Similarly, though not depicted, the pair of voids may be configured to align with the screw chases 342 and 344 of example inner frame member 320. It is contemplated that the profile of example cap 1706 may be any shape suitable to cover the end of any inner frame member or perimeter frame member described herein.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

While specific elements and steps are discussed in connection to one another, it is understood that any element and/or steps provided herein is contemplated as being combinable with any other elements and/or steps regardless of explicit provision of the same while still being within the scope provided herein. Since many possible embodiments may be made of the disclosure without departing from the scope thereof, it is to be understood that all matter herein set forth or shown in the accompanying drawings is to be interpreted as illustrative and not in a limiting sense.

As used herein and in connection with the claims listed hereinafter, the terminology "any of clauses" or similar variations of said terminology is intended to be interpreted such that features of claims/clauses may be combined in any combination. For example, an exemplary clause 4 may indicate the method/apparatus of any of clauses 1 through 3, which is intended to be interpreted such that features of clause 1 and clause 4 may be combined, elements of clause 2 and clause 4 may be combined, elements of clause 3 and 4 may be combined, elements of clauses 1, 2, and 4 may be combined, elements of clauses 2, 3, and 4 may be combined, elements of clauses 1, 2, 3, and 4 may be combined, and/or other variations. Further, the terminology "any of clauses" or similar variations of said terminology is intended to include "any one of clauses" or other variations of such terminology, as indicated by some of the examples provided above.

Clause 1. A perimeter frame member for a decking system, the perimeter frame member comprising: a first lateral end; a second lateral end that is opposite the first lateral end; a first vertical end; a second vertical end that is opposite the first vertical end; a first side extending between the first lateral end and the second lateral end, and extending between the first vertical end and the second vertical end; a second side opposite the first side, the second side extending between the first lateral end and the second lateral end, and extending between the first vertical end and the second vertical end; wherein the first side comprises first and second engagement members, wherein the first engagement member is adjacent the first vertical end, and wherein the second engagement member is adjacent the second vertical end.

Clause 2. The perimeter frame member of clause 1, wherein the first side further comprises a recessed portion.

Clause 3. The perimeter frame member of clause 2, wherein the recessed portion is positioned between the first and second engagement members.

Clause 4. The perimeter frame member of any of clauses 1 to 3, wherein the first vertical end comprises a channel.

Clause 5. The perimeter frame member of any of clauses 1 to 4, further comprising one or more screw chases, wherein the one or more screw chases are positioned between the first side and the second side.

Clause 6. The perimeter frame member of clause 5, wherein the one or more screw chases extend out from an inner surface of the second side towards the first side.

Clause 7. The perimeter frame member of any of clause 2 to 6, further comprising one or more alignment notches, wherein the one or more alignment notches are positioned within the recessed portion.

Clause 8. The perimeter frame member of any of clauses 1 to 7, wherein a midline plane extends parallel to the outer surface of the first vertical end and to the outer surface of the second vertical end, wherein the midline plane is equidistant between the outer surface of the first vertical end and the outer surface of the second vertical end, and wherein the midline plane is equidistant between the first engagement member and the second engagement member and/or wherein a gusset spans between the first side and the second side and is aligned with the midline plane.

Clause 9. The perimeter frame member of clause 8, wherein the midline plane is equidistant between a first edge of the recessed portion and a second edge of the recessed portion.

Clause 10. The perimeter frame member of any of clauses 1 to 9, wherein the perimeter frame member comprises a metal material.

Clause 11. The perimeter frame member of clause 10, wherein the metal material comprises aluminum.

Clause 12. The perimeter frame member of any of clauses 1 to 11, wherein the perimeter frame member is formed of an extruded metal material, wherein the metal material comprises aluminum.

Clause 13. A decking system, comprising: one or more perimeter frame members, wherein each of the one or more perimeter frame members includes: a first lateral end; a second lateral end that is opposite the first lateral end; a first vertical end; a second vertical end that is opposite the first vertical end; a first side extending between the first lateral end and the second lateral end, and extending between the first vertical end and the second vertical end; a second side opposite the first side, the second side extending between the first lateral end and the second lateral end, and extending between the first vertical end and the second vertical end; wherein the first side comprises first and second engagement members, wherein the first engagement member is adjacent the first vertical end, and wherein the second engagement member is adjacent the second vertical end; and one or more inner frame members, wherein, when in an assembled configuration, at least a first inner frame member of the one or more inner frame members is coupled to at least a first perimeter frame member of the one or more perimeter frame members.

Clause 14. The decking system of clause 13, wherein a first inner frame member hanger couples the first inner frame member to the first perimeter frame member, when in an assembled configuration, wherein the first inner frame member hanger is coupled to a first lateral end of the first inner frame member using one or more fasteners such that a second vertical end of the first inner frame member contacts a support surface extension of the first inner frame member hanger, when in an assembled configuration.

Clause 15. The decking system of clause 14, wherein at least a portion of a first hanger tab of the first inner frame member hanger is positioned between a channel on the first vertical end of the first perimeter frame member and the first engagement member of the first perimeter frame member, when in an assembled configuration.

Clause 16. The decking system of clauses 14 or 15, wherein a second hanger tab of the first inner frame hanger engages with the second engagement member of the first perimeter frame member, when in an assembled configuration.

Clause 17. The decking system of any of clauses 13 to 16, wherein an L-bracket is coupled to the first perimeter frame member and to the first inner frame member using one or more fasteners, when in an assembled configuration.

Clause 18. The decking system of clause 17, wherein at least a portion of the L-bracket contacts a recessed portion in the first perimeter frame member, when in an assembled configuration.

Clause 19. The decking system of clause 17, wherein the L-bracket contacts both the first engagement member and the second engagement member of the first perimeter frame member, and wherein the L-bracket contacts first and second ridges of the first inner frame member, when in an assembled configuration.

Clause 20. The decking system of any of clauses 13 to 19, wherein the first perimeter frame member is coupled to a second perimeter frame member of the one or more perimeter frame members, when in an assembled configuration.

Clause 21. The decking system of clause 20, wherein a first perimeter frame member hanger is coupled to a first lateral end of the second perimeter frame member using one or more fasteners such that a second vertical end of the second perimeter frame member contacts a support surface extension of the first perimeter frame member hanger, when in an assembled configuration.

Clause 22. The decking system of clause 21, wherein at least a portion of a first hanger tab of the first perimeter frame member hanger is positioned between a channel on the first vertical end of the first perimeter frame member and the first engagement member of the first perimeter frame member, when in an assembled configuration.

Clause 23. The decking system of clause 22, wherein at least a portion of a second hanger tab of the first perimeter frame member hanger engages with the second engagement member of the first perimeter frame member, when in an assembled configuration.

Clause 24. The decking system of any of clauses 20 to 24, wherein an L-bracket is coupled to the first perimeter frame member and to the second perimeter frame member using one or more fasteners, when in an assembled configuration.

Clause 25. The decking system of clause 24, wherein the L-bracket contacts a recessed portion in the first perimeter frame member and a recessed portion in the second perimeter frame member, when in an assembled configuration.

Clause 26. The decking system of any of clauses 20 to 25, wherein, when in an assembled configuration, the first perimeter frame member is oriented at an angle A of about 90° relative to the second perimeter frame member.

Clause 27. The decking system of clause 20, wherein, when in an assembled configuration, the first perimeter frame member is oriented at an angle A of about 100° to about 180° relative to the second perimeter frame member.

Clause 28. The decking system of clause 27, wherein, an angle bracket couples together the first perimeter frame member and the second perimeter frame member, when in an assembled configuration.

Clause 29. The decking system of clauses 27 or 28, wherein, a first bracket extension of the angle bracket is positioned in an interior portion of the first perimeter frame member and a second bracket extension of the angle bracket contacts a recessed portion of the first perimeter member, when in an assembled configuration.

Clause 30. The decking system of any of clauses 27 to 29, wherein, a third bracket extension of the angle bracket is positioned in an interior portion of the second perimeter frame member and a fourth bracket extension of the angle bracket contacts a recessed portion of the second perimeter member, when in an assembled configuration.

Clause 31. The decking system of any of clauses 13 to 30, wherein an L-post bracket is coupled to the first perimeter frame member.

Clause 32. The decking system of clauses 30 or 31, wherein a first notch of the L-post bracket contacts a bottom surface of the first engagement member of the first perimeter frame member.

Clause 33. An inner frame member for a decking system, the inner frame member comprising: a first lateral end; a second lateral end that is opposite the first lateral end; a first vertical end; a second vertical end that is opposite the first vertical end; a first side extending between the first lateral end and the second lateral end, and extending between the first vertical end and the second vertical end; a second side opposite the first side, the second side extending between the first lateral end and the second lateral end, and extending between the first vertical end and the second vertical end wherein the first side comprises a first ridge, a second ridge, and a main surface extending between the first ridge and the second ridge, wherein the first ridge of the first side is adjacent the first vertical end, and wherein the second ridge of the first side is adjacent the second vertical end.

Clause 34. The inner frame member of clause 33, wherein the second side comprises a first ridge and a second ridge and a main surface extending between the first ridge and the second ridge.

Clause 35. The inner frame member of clause 34, wherein the first ridge of the second side is adjacent the first vertical end, and wherein the second ridge of the second side is adjacent the second vertical end.

Clause 36. The inner frame member of any of clause 33 to 35, wherein the first vertical end comprises a channel.

Clause 37. The inner frame member of any of clause 33 to 36, further comprising one or more screw chases, wherein the one or more screw chases are positioned between the first side and the second side.

Clause 38. The inner frame member of clause 37, wherein a first screw chase of the one or more screw chases extends out from an inner surface of the first side towards the second side and wherein a second screw chase of the one or more screw chases extends out from an inner surface of the second side towards the first side.

Clause 39. The inner frame member of clause 38, wherein the first screw chase is positioned closer to the first vertical end than the second vertical end, and/or wherein the second screw chase is positioned closer to the second vertical end than the first vertical end.

Clause 40. The inner frame member of clause 38 or 39, wherein the first screw chase extends from the first lateral end to the second lateral end and/or wherein the second screw chase extends from the first lateral end to the second lateral end.

Clause 41. The inner frame member of any of clause 33 to 40, wherein a midline plane extends parallel to the outer surface of the first vertical end and to the outer surface of the second vertical end, wherein the midline plane is equidistant between the outer surface of the first vertical end and the outer surface of the second vertical end, and wherein the midline plane is equidistant between the first ridge and the second ridge.

Clause 42. The inner frame member of any of clause 33 to 41, wherein the inner frame member comprises a metal material.

Clause 43. The inner frame member of clause 42, wherein the metal material comprises aluminum.

Clause 44. The inner frame member of any of clause 33 to 43, wherein the inner frame member is formed of an extruded metal material, and wherein the extruded metal material comprises aluminum.

Clause 45. A-decking system, comprising: one or more perimeter frame members; and one or more inner frame members, wherein each of the one or more inner frame members comprises: a first lateral end; a second lateral end that is opposite the first lateral end; a first vertical end; a second vertical end that is opposite the first vertical end; a first side extending between the first lateral end and the second lateral end, and extending between the first vertical end and the second vertical end; a second side opposite the first side, the second side extending between the first lateral end and the second lateral end, and extending between the first vertical end and the second vertical end; wherein the first side comprises a first ridge, a second ridge, and a main surface extending between the first ridge and the second ridge, wherein the first ridge of the first side is adjacent the first vertical end, and wherein the second ridge of the first side is adjacent the second vertical end, wherein, when in an assembled configuration, at least a first inner frame member of the one or more inner frame members is coupled to at least a first perimeter frame member of the one or more perimeter frame members.

Clause 46. The decking system of clause 45, wherein the first lateral end of the first inner frame member is coupled to the first perimeter frame member via a first inner frame member hanger that is secured to the first lateral end of the first inner frame member using one or more fasteners, when in an assembled configuration.

Clause 47. The decking system of clause 46, wherein the one or more fasteners are at least partly positioned within one or more screw chases of the first inner frame member.

Clause 48. The decking system of clause 46 or 47, wherein the second vertical end of the first inner frame member contacts a support surface extension of the first inner frame member hanger.

Clause 49. The decking system of any of clause 46 to 48, wherein at least a portion of a first hanger tab of the first inner frame member hanger contacts a first engagement member of the first perimeter frame member, and wherein a second hanger tab of the first inner frame hanger contacts a second engagement member of the first perimeter frame member, when in an assembled configuration.

Clause 50. The decking system of any of clauses 45 to 49, wherein the first inner frame member is oriented at an angle A of about 90° relative to the first perimeter frame member, when in an assembled configuration.

Clause 51. The decking system of any of clauses 45 to 50, wherein a first L-bracket is secured to the first inner frame member and to the first perimeter frame member using one or more fasteners, when in an assembled configuration.

Clause 52. The decking system of clause 51, wherein the first L-bracket contacts the first ridge, the second ridge, or both on one of the first side or second side of the first inner frame member, when in an assembled configuration.

Clause 53. The decking system of clauses 52, wherein the first L-bracket contacts a first engagement member, a second engagement member, or both of the first perimeter frame member, when in an assembled configuration.

Clause 54. The decking system of any of clauses 51 to 53, wherein at least a portion of the first L-bracket is positioned within a recessed portion of the first perimeter frame member, when in an assembled configuration.

Clause 55. The decking system of any of clauses 45 to 53, wherein a first lateral end of a second inner frame member of the one or more inner frame members is coupled to one of the first or second side of the first inner frame member, when in an assembled configuration.

Clause 56. The decking system of clause 55, wherein a second L-bracket is secured to the first inner frame member and to the second inner frame member, when in an assembled configuration.

Clause 57. The decking system of clause 56, wherein the second L-bracket contacts first and second ridges of one of the first or second side of the first inner frame member, and contacts first and second ridges of one of the first or second side of the second inner frame member, when in an assembled configuration.

Clause 58. The decking system of any of clauses 55 to 57, wherein a second lateral end of the second inner frame member is coupled to a second perimeter frame member, when in an assembled configuration.

Clause 59. The decking system of clause 58, wherein a third L-bracket is secured to the second inner frame member and to the second perimeter frame member, when in an assembled configuration.

Clause 60. The decking system of any of clauses 55 to 59, wherein an L-post bracket is coupled to the second inner frame member using one or more fasteners, when in an assembled configuration.

Clause 61. The decking system of clause 60, wherein a first notch of the L-post bracket contacts a bottom surface of the first ridge of the second inner frame member, when in an assembled configuration.

Clause 62. The decking system of any of clauses 45 to 61, wherein a third inner frame member of the one or more inner frame members is coupled to the first perimeter frame member, and wherein the third inner frame member is substantially parallel to the first inner frame member, when in an assembled configuration.

Clause 63. The decking system of clause 62, wherein a spacing member is coupled to the first perimeter frame member and is positioned between the first inner frame member and the third inner frame member, when in an assembled configuration.

Clause 64. The decking system of any of clauses 45 to 63, wherein the one or more inner frame members, the one or more perimeter frame members, or both, comprise a metal material.

Clause 65. The decking system of clause 64, wherein the metal material comprises aluminum.

Clause 66. The decking system of any of clauses 45 to 65, wherein the one or more inner frame members, the one or more perimeter frame members, or both, are formed of an extruded metal material, and wherein the extruded metal material comprises aluminum.

Clause 67. A joist assembly comprising: a first joist having a terminal end and a second joist having a side; a hanger fastened to the terminal end and removably hooked to the side, wherein the hanger comprises a hook for engaging a channel on the side and comprises a support surface extension extending underneath the first joist.

Clause 68. The joist assembly of clause 67, wherein the terminal end comprises a screw chase and the hanger is fastened to the terminal end via a fastener engaging the hanger and the screw chase.

Clause 69. The joist assembly of clause 66 or clause 67, wherein the first joist comprises an inner frame member and the second joist comprises a perimeter frame member.

Clause 70. The joist assembly of clause 66 or clause 67, wherein the first joist comprises a first perimeter frame member and the second joist comprises a second perimeter frame member.

Clause 71. The joist assembly of any of clauses 66 to 70, wherein the first joist comprises a first lateral end; a second lateral end that is opposite the first lateral end; a first vertical end; a second vertical end that is opposite the first vertical end; a first side extending between the first lateral end and the second lateral end, and extending between the first vertical end and the second vertical end; a second side opposite the first side, the second side extending between the first lateral end and the second lateral end, and extending between the first vertical end and the second vertical end; and wherein the hanger abuts the first lateral end and the support surface extends beneath the first vertical end.

Clause 72. A joist assembly comprising: a first joist spaced apart from a second joist by a distance, and a blocking member spanning the distance between the first joist and the second joist, wherein the blocking member comprises an elongated body having a first terminal end and a second terminal end, the first terminal end comprising a first flange positioned atop the first joist and the second terminal end comprising a second flange positioned atop the second joist; and wherein the first terminal end comprises a first locking flange fastening to a sidewall of the first joist and the second terminal end comprises a second locking flange for fastening to a sidewall of the second joist.

Clause 73. The joist assembly of clause 73, wherein the sidewall of the first joist comprises an engagement member configured to engage a joist hanger, and wherein the first locking flange is positioned below the engagement member.

Clause 74. An assembly for hanging a first joist on a second joist, the assembly comprising: a joist hanger configured to fasten to the end of the first joist and to hook onto a second joist; an uplift-prevention clip positioned between the joist hanger and the second joist; a spacer hooked onto the second joist and adjacent to the joist hanger, wherein the spacer comprises a rib aligned with the uplift-[prevention clip.

Clause 75. The assembly of clause 74, wherein the uplift-prevention clip includes a length that is equal to or less than a width of the joist hanger.

Clause 76. The assembly of clause 73 or clause 74, wherein the joist hanger comprises a hook for engaging a channel on the second joist and comprises a support surface extension extending underneath the first joist.

Clause 77. The assembly of any of clauses 73 through 76, further comprising, an L bracket affixed to the first joist and the second joist and positioned between the spacer and the second joist.

What is claimed is:

1. A perimeter frame member for a decking system, the perimeter frame member comprising:

a first lateral end;

a second lateral end that is opposite the first lateral end;

a first vertical end;

a second vertical end that is opposite the first vertical end;

a first side extending between the first lateral end and the second lateral end, and extending between the first vertical end and the second vertical end;

a second side opposite the first side, the second side extending between the first lateral end and the second lateral end, and extending between the first vertical end and the second vertical end;

wherein the first side comprises first and second engagement members, wherein the first engagement member is adjacent the first vertical end, wherein the second engagement member is adjacent the second vertical end, wherein the first side further comprises a recessed portion positioned between the first and second engagement members, and one or more alignment notches positioned within the recessed portion, wherein a midline plane extends parallel to and equidistant between the outer surfaces of the first and second vertical ends, and wherein the midline plane is equidistant between the first and second engagement members and between first and second edges of the recessed portion.

2. The perimeter frame member of claim 1, wherein the first vertical end comprises a channel.

3. The perimeter frame member of claim 1, further comprising one or more screw chases, wherein the one or more screw chases are positioned between the first side and the second side.

4. The perimeter frame member of claim 3, wherein the one or more screw chases extend out from an inner surface of the second side towards the first side.

5. The perimeter frame member of claim 1, wherein the perimeter frame member comprises a metal material.

6. The perimeter frame member of claim 5, wherein the metal material comprises aluminum.

7. The perimeter frame member of claim 1, wherein the perimeter frame member is formed of an extruded metal material, wherein the metal material comprises aluminum.

8. A decking system, comprising:

one or more perimeter frame members, wherein each of the one or more perimeter frame members comprises:

a first lateral end; a second lateral end that is opposite the first lateral end;

a first vertical end;

a second vertical end that is opposite the first vertical end;

a first side extending between the first lateral end and the second lateral end, and extending between the first vertical end and the second vertical end;

a second side opposite the first side, the second side extending between the first lateral end and the second lateral end, and extending between the first vertical end and the second vertical end;

wherein the first side comprises first and second engagement members, wherein the first engagement member is adjacent the first vertical end, and wherein the second engagement member is adjacent the second vertical end;

wherein the first side further comprises a recessed portion positioned between the first and second engagement members, and one or more alignment notches positioned within the recessed portion, wherein a midline plane extends parallel to and equidistant between the outer surfaces of the first and second vertical ends, and wherein the midline plane is equidistant between the first and second engagement members and between first and second edges of the recessed portion; and one or more inner frame members, wherein, when in an assembled configuration, at least a first inner frame member of the one or more inner frame members is coupled to at least a first perimeter frame member of the one or more perimeter frame members.

9. The decking system of claim 8, wherein a first inner frame member hanger couples the first inner frame member to the first perimeter frame member, when in an assembled configuration, wherein the first inner frame member hanger is coupled to a first lateral end of the first inner frame member using one or more fasteners such that a second vertical end of the first inner frame member contacts a support surface extension of the first inner frame member hanger, when in an assembled configuration.

10. The decking system of claim 9, wherein at least a portion of a first hanger tab of the first inner frame member hanger is positioned between a channel on the first vertical end of the first perimeter frame member and the first engagement member of the first perimeter frame member, when in an assembled configuration.

11. The decking system of claim 9, wherein a second hanger tab of the first inner frame hanger engages with the second engagement member of the first perimeter frame member, when in an assembled configuration.

12. The decking system of claim 8, wherein an L-bracket is coupled to the first perimeter frame member and to the first inner frame member using one or more fasteners, when in an assembled configuration.

13. The decking system of claim 12, wherein at least a portion of the L-bracket contacts a recessed portion in the first perimeter frame member, when in an assembled configuration.

14. The decking system of claim 12, wherein the L-bracket contacts both the first engagement member and the second engagement member of the first perimeter frame member, and wherein the L-bracket contacts first and second ridges of the first inner frame member, when in an assembled configuration.

15. The decking system of any of claim 8, wherein the first perimeter frame member is coupled to a second perimeter frame member of the one or more perimeter frame members, when in an assembled configuration.

* * * * *